US006883895B2

(12) United States Patent
Murakami et al.

(10) Patent No.: US 6,883,895 B2
(45) Date of Patent: Apr. 26, 2005

(54) LIQUID EJECTION APPARATUS, HEAD UNIT AND INK-JET CARTRIDGE

(75) Inventors: Shuichi Murakami, Kawasaki (JP); Noribumi Koitabashi, Yokohama (JP); Masaya Uetsuki, Yokohama (JP); Yoshinori Nakajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 10/131,394

(22) Filed: Apr. 25, 2002

(65) Prior Publication Data

US 2003/0142165 A1 Jul. 31, 2003

Related U.S. Application Data

(62) Division of application No. 08/798,931, filed on Feb. 11, 1997, now Pat. No. 6,435,648.

(30) Foreign Application Priority Data

Feb. 13, 1996 (JP) ..... 8-025646
Feb. 13, 1996 (JP) ..... 8-025700
Feb. 13, 1996 (JP) ..... 8-025701

(51) Int. Cl.[7] ..... B41J 2/165
(52) U.S. Cl. ..... 347/29; 347/34; 347/33
(58) Field of Search ..... 347/29, 34, 21, 347/30, 32, 33, 107, 20, 45, 44

(56) References Cited

U.S. PATENT DOCUMENTS

| | | | | |
|---|---|---|---|---|
| 4,520,366 A | | 5/1985 | Cragin, Jr. | 347/75 |
| 4,599,627 A | | 7/1986 | Vollert | 347/20 |
| 4,628,331 A | | 12/1986 | Ishikawa | 347/34 |
| 5,148,186 A | | 9/1992 | Tochihara et al. | 347/51 |
| 5,189,443 A | | 2/1993 | Arashima et al. | 347/63 |
| 5,208,604 A | | 5/1993 | Watanabe et al. | 347/47 |
| 5,528,271 A | | 6/1996 | Ebisawa | 347/34 |
| 5,534,898 A | | 7/1996 | Kashino et al. | 347/33 |
| 5,751,304 A | | 5/1998 | Hirabayashi et al. | 347/17 |
| 5,805,190 A | | 9/1998 | Tsuchii et al. | 347/100 |
| 5,867,184 A | | 2/1999 | Quintana | 347/29 |
| 5,914,736 A | | 6/1999 | Tamura | 347/37 |
| 5,959,641 A | * | 9/1999 | Yokoi | 347/21 |
| 6,102,537 A | | 8/2000 | Kato et al. | 347/101 |
| 6,120,141 A | | 9/2000 | Tajika et al. | 347/96 |

FOREIGN PATENT DOCUMENTS

| | | |
|---|---|---|
| EP | 0 250 271 | 12/1987 |
| EP | 0 383 019 | 8/1990 |
| EP | 0 398 348 | 11/1990 |
| EP | 0 446 885 | 9/1991 |
| EP | 0 573 238 | 12/1993 |
| EP | 0 587 164 | 3/1994 |
| EP | 0 604 029 | 6/1994 |
| EP | 0 624 470 | 11/1994 |
| EP | 0 673 772 | 9/1995 |
| JP | 53-24486 | 3/1978 |
| JP | 54-41134 | 4/1979 |
| JP | 54-43733 | 4/1979 |
| JP | 55-150396 | 11/1980 |

(Continued)

*Primary Examiner*—Shih-wen Hsieh
(74) *Attorney, Agent, or Firm*—Fitzpatrick, Cella, Harper & Scinto

(57) ABSTRACT

A region to be covered by a cover plate (208) on an ejection opening forming surface (205) of an ink-jet head or an ink-jet head to which the cover plate (208) is installed are determined, on a basis of content of a rebounding mist generated upon ejection of an ink and a processing liquid in overlaying fashion. By this, in the ink-jet printing apparatus performing printing by ejecting the ink and the processing liquid for making the ink insoluble, deposition of the insoluble substance contained in the rebounding mist generated upon ejection of an ink and a processing liquid in overlaying fashion can be successfully prevented.

23 Claims, 52 Drawing Sheets

FOREIGN PATENT DOCUMENTS

| | | | |
|---|---|---|---|
| JP | 56-144163 | | 11/1981 |
| JP | 57-68340 | | 4/1982 |
| JP | 0 063 637 | | 11/1982 |
| JP | 357205157 A | * | 12/1982 |
| JP | 58-128862 | | 8/1983 |
| JP | 61-249755 | | 11/1986 |
| JP | 63-5949 | | 1/1988 |
| JP | 64-63185 | | 3/1989 |
| JP | 64-71757 | | 3/1989 |
| JP | 1-195048 | | 8/1989 |
| JP | 1-275047 | | 11/1989 |
| JP | 2-187362 | | 7/1990 |
| JP | 2-252564 | | 10/1990 |
| JP | 3-72441 | | 7/1991 |
| JP | 3-234539 | | 10/1991 |
| JP | 3-240554 | | 10/1991 |
| JP | 3-262646 | | 11/1991 |
| JP | 3-274154 | | 12/1991 |
| JP | 4-73158 | | 3/1992 |
| JP | 4-169238 | | 6/1992 |
| JP | 4-235039 | | 8/1992 |
| JP | 4-338552 | | 11/1992 |
| JP | 4-355150 | | 12/1992 |
| JP | 5-201000 | | 8/1993 |
| JP | 5-293963 | | 11/1993 |
| JP | 5-338160 | | 12/1993 |
| JP | 5-338204 | | 12/1993 |
| JP | 7-125224 | | 5/1994 |
| JP | 6-255099 | | 9/1994 |
| JP | 7-68792 | | 3/1995 |
| JP | 7-81085 | | 3/1995 |
| JP | 7-148931 | | 6/1995 |
| JP | 7-195823 | | 8/1995 |
| JP | 7-305013 | | 11/1995 |
| JP | 8-13358 | | 1/1996 |
| JP | 8-20720 | | 1/1996 |
| JP | 8-25801 | | 1/1996 |
| JP | 9-216352 | | 8/1997 |

* cited by examiner (DEPOSITION OF REBOUNDING MIST ON EJECTION OPENING FORMING SURFACE)

(BEHAVIOR OF REBOUNDING MIST)

(EJECTION OPENING FORMING SURFACE OF PROCESSING LIQUID EJECTION HEAD)
(EJECTION OPENING FORMING SURFACE OF BLACK INK EJECTION HEAD)

5A
5A
S .....
PROCESSING LIQUID 5A
5A
INK
K .....
INK 5A
5A
S → K .....
PROCESSING LIQUID
COAGULATE
INK 5A
5A
INK
K → S .....
PROCESSING LIQUID
COAGULATE

LIQUID EJECTION APPARATUS, HEAD UNIT AND INK-JET CARTRIDGE

This application is a division of application Ser. No. 08/798,931 filed Feb. 11, 1997 now U.S. Pat. No. 6,435,648.

BACKGROUND OF THE INVENTION

1. Field of the Invention

The present invention relates to a head unit, an ink-jet cartridge and a liquid ejection apparatus. Particularly, the invention relates to an ink-jet head unit, an ink-jet cartridge and an ink-jet printing apparatus for performing printing with ejecting an ink and a printing ability improving liquid (hereinafter simply referred to as "processing liquid") which makes a coloring material in the ink insoluble or coagulates the coloring material.

The present invention is applicable for all of devices or apparatuses which employ a paper, a cloth, a leather, a non-woven fabric, an OHP sheet and so forth, and even a metal and so forth as media (hereinafter simply referred to as "printing medium") receiving inks and the printing ability improving liquid. Concretely, the present invention is applicable for an office machine, such as a printer, a copy machine and a facsimile machine, an industrial production machine and so forth.

2. Description of the Related Art

Conventionally, an ink-jet system has been widely used in a printer, a copy machine and so forth due to its advantages of low noise, low running cost, compactness of the apparatus, and ease of color printing.

However, in a printing apparatus employing such ink-jet system, if a printing medium called plain paper is used, bleeding occurs on the printing medium upon deposition of water or so forth due to insufficiency of resistance of a printed image to water. Also, upon color printing on the plain paper, it has not been possible to achieve both of a high density image without causing feathering and an image without bleeding between colors. Therefore, it may be possible that a color image with sufficient fastness property or satisfactorily high print quality cannot be obtained.

As a solution for the problem set forth above, an ink providing water resistance for a coloring material contained in the ink has been recently put into practice. However, the water resistance of the ink is still insufficient. Also, such water resistive ink is difficult to dissolve in water after once dried in principle, and it has a tendency to easily cause plugging in ejection openings or so forth in an ink-jet printing head. On the other hand, a construction of the apparatus required for preventing plugging of the ejection openings becomes complicated.

Also, there have been various proposals for improving fastness property of the printed products.

For example, Japanese Patent Application Laid Open No. 24486/1978 proposes subjecting a printed product to a post treatment for converting a dye into a lake for fixing in order to enhance color fastness against wetness of the printed product.

On the other hand, Japanese Patent Application Laid-open No. 43733/1979 discloses a method for performing printing with employing a substance containing two or more components which increases a layer forming ability by contacting with each other under room temperature or heated condition, in the ink-jet system. In this method, a printed product having a layer firmly fixed on the printing medium can be obtained by contacting the components on the printing medium.

Also, Japanese Patent Application Laid-open No. 150396/1980 discloses a method for, after printing, applying an agent for making the dye water resistant to a water based ink so as to react with the dye in the ink to form a lake.

Furthermore, Japanese Patent Application Laid open No. 128862/1983 discloses an ink-jet printing apparatus for performing printing by preliminarily recognizing positions on which dots are formed and by providing a printing ink and a processing ink on the recognized positions in overlaying manner. Here, enhancement of water resistance of the printing product has been attempted by ejecting the processing ink in advance of ejection of the printing ink, conversely by ejecting the processing ink over the preliminarily ejected printing ink, or by ejecting the printing ink after overlaying the printing ink on the preliminarily ejected processing ink.

On the other hand, it has been well known that the ink-jet printing system encounters the following problem.

At first, in the ink-jet system, a fine ink droplet which is much smaller than an ink droplet to be ejected may be generated associated with ejection of the ink droplet. Further, a fine liquid droplet may be generated when the ink droplet ejected rebounds on the printing medium. These liquid droplets will occasionally form a mist of fine liquid droplets, and such mist may deposit on a surface of an ink-jet head on which an ejection opening is formed. When a large amount of the mist is deposited around the ejection opening, or when paper dust or other foreign matter adheres on the mist deposited around the ejection openings, ink ejection can be affected, causing variation in the ejecting direction of the ink droplet (hereinafter also simply referred to as "deflection"), failure of ejection of the ink droplet and so forth.

Secondly, in the ink-jet head, while ejection is not performed, particularly when a non-ejection state is maintained for a long period, viscosity of the ink in the ejection openings can increase and the ink can solidify. Also in this case, deflection, ejection failure or so forth can be caused.

It has been known that the following construction is provided in the ink-jet printing system for avoiding the foregoing inconvenience.

Concerning the first problem, in order to prevent the mist from depositing on non-specified portions of the ink-jet head, improvement of the head per se or introduction of air flow generated by a blower fan into a gap between the head and the printing medium are attempted, for example. By the effect of the former, reduction of the amount of the mist to be generated can be observed. However, in the latter case, since the flying direction of the ejected ink droplet can be disturbed by the air flow, the air flow has to be relatively weak and then the weakness of the air flow can cause the mist deposit prevention to be insufficient.

Furthermore, it is also known to deposit the ink mist to a predetermined region by applying an electric field to the ink mist per se. The fine ink droplets forming the ink mist may not be polarized at specific polarity upon separation into the fine droplets, and also, a non-polarized ink droplet may be generated. As a result, control of the ink mist deposit region by the electric field cannot be performed effectively.

In addition, as a means for cleaning and removing the ink, paper dust or so forth once deposited on an ejection opening forming surface of the head due to generation of the ink mist, it has been generally known to wipe the ejection opening forming surface, using a blade made of an elastic material, such as rubber or so forth.

Concerning the second problem, it has been known to cover the ejection opening forming surface with a cap while not printing, so as to prevent the ink from evaporating and drying, so that increasing of viscosity and solidification of the ink in the ejection opening of the ink-jet head can be prevented. Also, if the ejection failure is caused by increasing of viscosity or solidifying of the ink, or if foreign-matter that cannot be removed by the blade which is set out with respect to the first problem, resides on the ejection opening forming surface, normal ejection is recovered by suctioning the ink of increased viscosity in the ejection opening or the ink deposited on the ejection opening forming surface with a suction pump connected to the cap, so as to expel the ink of increased viscosity or so forth.

Furthermore, in printing operation of an on-demand type ink-jet printing system, while it depends on the printing data, not all of a plurality of ejection openings provided on the head are used for printing in most cases. Therefore, some ejection openings may not be used for a predetermined period or longer. Also, in the case where an ink-jet head is provided for each color, such as in a color printing apparatus, depending on printing color, printing data may be not transferred (ejection of the ink is not performed), and all of ejection openings of the head for ejecting the certain color of ink may be held in non-use. Therefore, the printing operation may be continuously performed under the condition where non-use ejection openings are present. Also in such case, the ink is evaporated and drying of the ink in the ejection opening or on the ejection opening forming surface of the head is promoted where the ink ejection is not performed to result in lowering of ejection performance and thereby cause lowering of printed image quality.

For such problem, it has been further known to perform a preliminary ejection operation in addition to the suction recovery as set forth above or separately therefrom. In the preliminary ejection operation, ink ejection is performed at a predetermined position irrespective of the printing data at a given interval so as to expel the ink in the ejection opening and introduce fresh ink to maintain an appropriate condition of the head for ejection. The preliminary ejection is performed by ejecting the ink into the cap of the recovery unit or toward a preparatory ejection receptacle member provided separately, for example, so that scattering of the ejected ink to the printing medium or the inside of the apparatus causing contamination, can be successfully avoided.

However, in the ink-jet printing apparatus, it is possible that the conventionally known problem of water resistance of the printing product and the problem associated with ejection failure cannot be easily solved simultaneously.

More specifically, when the processing liquid which makes the ink insoluble is used for water resistance and enhancement of the image quality, while water resistance and the image quality and so forth can be improved, the ink in mist state, which becomes insoluble, is deposited at the ejection opening portions and the vicinity thereof or the ejection opening forming surface, and such deposits become difficult to remove by wiping or preliminary ejection set forth above to result in more a critical problem, such as relatively serious ejection failure.

Deposition of the insoluble ink is caused mainly by the following two phenomena. The first phenomenon is the case where the ink droplet and the processing liquid ejected from the ink-jet heads rebound on the printing medium and deposit in the ink-jet head in admixed form. Particularly, the first phenomenon arises in the case where the ink droplet is ejected to a portion to which the processing liquid is already ejected and where the processing liquid and the ink droplet rebound and deposit as an already reacted insoluble substance. The second phenomenon is that the printed portion of the paper is in contact with the ejection opening portion of the ink-jet head, and can form the insoluble substance upon occurrence of jamming of the paper or so forth as the printing medium or occurrence of feeding of a plurality of papers in a stacked manner.

On the other hand, the inventors of the present application have studied the ink mist generated in the conventional apparatus and determined that most of the conventionally recognized ink mists have droplets of relatively large volume so as to have relatively high motion speed. More specifically, the conventionally well known ink mist is moved by its own motion energy along a direction which is determined when the motion energy is given to the ink mist to certainly reach the head, the printing medium or functional portion within the apparatus so as to cause the deposition phenomena set forth above. Accordingly, in order to prevent deposition phenomena of the ink mist, certain means, which can oppose the motion energy of the ink mist, becomes necessary.

On the other hand, providing such opposing means in the printing apparatus results in affecting the ejected ink droplets for formation of the image in most cases, and can increase the cost. As a result of this, practical problems are encountered.

The inventors have re-studied conditions under which ink mist is generated, and have conducted extensive research from a viewpoint which has not been considered conventionally to reach a novel invention.

Particularly in the case where the processing liquid is used together with the ink, since the later ejected liquid droplet collides with the liquid state droplet formed at prior effected ejection, on the printing medium, most of the mist generated is caused by rebounding. In this case, the rebounding mist has large motion energy to deposit on the non-specified positions. The inventors have studied this case to reach the present invention.

SUMMARY OF THE INVENTION

It is an object of the present invention to provide a head unit, an ink-jet cartridge and an ink-jet printing apparatus which can prevent or reduce deposition of an insoluble substance onto the ejection opening portion of an ink-jet head and can make ejection in stable state.

Another object of the present invention is to provide an ink-jet head, an ink-jet cartridge and an ink-jet printing apparatus which can prevent deposition of ink droplet or processing liquid or the mixture thereof on the ejection opening portion of the ink-jet head due to rebounding of the liquid or generation of the mist which occur during printing operation.

A further object of the present invention is to provide a head unit, an ink-jet cartridge and an ink-jet printing apparatus which can prevent deposition of insoluble substance on an ejection opening portion when an ejection opening forming surface of an ink-jet head and a printing medium contact each other.

A still further object of the present invention to provide a head unit, an ink-jet cartridge and an ink-jet printing apparatus which has means for appropriately determining a range at which an ejection opening forming surface is covered on a basis of behavior of mist generated by rebounded liquid due to collision of an ink and a processing liquid on a printing medium.

A yet further object of the present invention is to provide a technology fundamentally improving generation of an ink mist to establish a state facilitating control and restriction thereof.

A further object of the present invention is to provide a liquid ejection apparatus and a liquid ejection method which positively control a range of deposition of insoluble substance to reduce the amount of the insoluble substance depositing on an ejection opening portion and in a vicinity thereof so as to constantly maintain good ejecting condition.

A still further object of the present invention is to provide a liquid ejection apparatus and a liquid ejection method, which can move mist generated by liquid ejection from a head in a direction away from ejection openings by air flow and thereby prevent ejection failure due to deposition of mist on the ejection openings, and which can make mist to be in a floating condition, that is, a facilitated condition to be controlled by air flow to easily control the range of deposition of the mist.

A yet further object of the invention is to provide a liquid ejection apparatus and a liquid ejection method which preliminarily controls position of deposition of mist due to ink, processing liquid or mixture thereof, to be away from the ejection openings, and reduces possibility of entering of the ink or so forth into the ejection openings when wiping is performed with a wiping member.

A still further object of the invention is to provide a liquid ejection apparatus which performs wiping of foreign matter away from ejection openings with a wiping member, and makes possibility of entering of the foreign matter into the ejection openings when the wiping is performed.

A yet further object of the invention is to provide a liquid ejection apparatus which can appropriately wipe a region despite presence of a stepping portion between an ejection opening forming surface and a cover member covering the former.

In a first aspect of the present invention, there is provided an ink-jet printing apparatus for performing printing by using an ink-jet head ejecting an ink and by ejecting the ink toward a printing medium, comprising:

covering means for covering a range around an ink ejecting opening in the ink-jet head at least when said ink-jet head performs ink ejection for printing.

In a second aspect of the present invention, there is provided an ink-jet printing apparatus for performing printing by using an ink ejecting portion for ejecting an ink and a processing liquid ejecting portion for ejecting a processing liquid for processing the ink, and by ejecting the ink and the processing liquid on a printing medium in overlaying manner, comprising:

covering means for covering a range around at least one of an ink ejection opening of the ink ejecting portion and a processing liquid ejection opening of the processing liquid ejecting portion at least when said ink ejecting portion and said processing liquid ejecting portion perform ejection of the ink and the processing liquid, respectively, for printing.

In a third aspect of the present invention, there is provided a head unit for ejecting an ink, comprising:

a plate member covering around an ink ejection opening in the head unit.

In a fourth aspect of the present invention, there is provided a head unit having an ink ejecting portion for ejecting an ink and a processing liquid ejecting portion for ejecting a processing liquid for processing the ink, comprising:

a plate member for covering a range around at least one of an ink ejection opening of the ink ejecting portion and a processing liquid ejection opening of the processing liquid ejecting portion.

In a fifth aspect of the present invention, there is provided an ink-jet cartridge having an ink-jet head for ejecting an ink and an ink tank integral with the ink-jet head and storing an ink to be supplied to the ink-jet head, comprising:

a plate member for covering a range around an ink ejection opening in said ink-jet head.

In a sixth aspect of the present invention, there is provided an ink-jet cartridge integrally having an ink ejecting portion for ejecting an ink, a processing liquid ejecting portion for ejecting a processing liquid for processing the ink, an ink tank storing the ink to be supplied to said ink ejecting portion and a processing liquid tank storing the processing liquid to be supplied to said processing liquid ejecting portion, comprising:

a plate member covering a range around at least one of an ink ejection opening of the ink ejecting portion and a processing liquid ejection opening of the processing liquid ejecting portion.

In a seventh aspect of the present invention, there is provided a liquid ejection apparatus for ejecting a liquid to a medium by using ejecting means, comprising:

moving means for moving the ejecting means provided with an ejection opening for ejecting the liquid relative to the medium; and air flow generating means for generating an air flow which is generated by utilizing relative movement of the ejecting means and the medium by means of said moving means, said air flow flowing along a direction away from the ejection opening in a vicinity space of an ejection opening forming surface of said ejecting means, for which said ejection opening is provided.

In an eighth aspect of the present invention, there is provided a liquid ejecting method for ejecting a liquid to a medium from an ejection opening while ejection means provided with said ejection opening for ejecting the liquid move relative to said medium, comprising the step of:

ejecting the liquid with generating air flow which is the air flow generated by utilizing relative movement of said ejection means and the medium, said air flow flowing away from the ejection opening in a vicinity of an ejection opening forming surface of said ejection means where said ejection opening is provided.

In a ninth aspect of the present invention, there is provided a liquid ejecting method for ejecting a liquid to a medium from an ejection opening while ejection means provided with said ejection opening for ejecting the liquid move relative to said medium, comprising the step of:

ejecting the liquid with generating air flow which is the air flow floating the liquid between said ejection means and the medium and being generated by utilizing relative movement of said ejection means and the medium, said air flow flowing away from the ejection opening in a vicinity space of an ejection opening forming surface of said ejection means where said ejection opening is provided.

In a tenth aspect of the present invention, there is provided a liquid ejection apparatus for ejecting a liquid to a medium by using ejection means provided with an ejection opening for ejecting the liquid, wherein said ejecting means is provided with a projecting portion, and by means of said projecting portion and an air flow generated by air flow generating means, there is generated the air flow flowing away from the ejection opening in a vicinity space of an ejection opening forming surface of said ejection means where said ejection opening is provided.

In an eleventh aspect of the present invention, there is provided a liquid ejecting method comprising the steps of:

ejecting a droplet having a volume less than or equal to 25 pl from ejecting means at a kinetic momentum less than or equal to 400 pl-m/s; and floating a mist generated by collision of the ejected droplet with the medium or a liquid on the medium in a space between said ejecting means and said medium.

In a twelfth aspect of the present invention, there is provided a liquid ejection apparatus for ejecting a liquid to a medium by using ejecting means, comprising:

moving means for moving said ejecting means provided with an ejection opening for ejecting the liquid relative to the medium;

deposition range control means for generating an air flow by utilizing relative movement of said ejection means and the medium, said air flow flowing away from said ejection opening in a vicinity space of an ejection opening forming surface of said ejection means where said ejection opening is provided, so as to deposit mist at a position away from said ejection opening; and wiping means having a wiping member for wiping the ejection opening forming surface including said position way from the ejection opening.

In a thirteenth aspect of the present invention, there is provided an ejection recovery method in a liquid ejection apparatus for ejecting a liquid to a medium from an ejection opening while ejection means provided with said ejection opening for ejecting the liquid moves relative to the medium, comprising the step of:

generating an air flow floating said liquid between said ejection means and the medium and being generated by utilizing relative movement of said ejection means and said medium, said air flow flowing away from the ejection opening in the vicinity of an ejection opening forming surface of said ejection means where said ejection opening is provided, so as to deposit the floated liquid at a position away from said ejection opening; and wiping the ejection opening forming surface including said position.

In a fourteenth aspect of the present invention, there is provided a liquid ejection apparatus using ejection means for ejecting an ink and performing printing by ejecting the ink to a printing medium, comprising:

wiping means having a wiping member for removing foreign matter deposited on an ejection opening forming surface of said ejection means, said wiping means removing the foreign matter deposited on the ejection opening forming surface in a direction away from said ejection opening.

In a fifteenth aspect of the present invention, there is provided a liquid ejection apparatus using an ejecting portion for ejecting an ink and performing printing by ejecting the ink toward a printing medium, comprising:

two stepped portions located at both sides of the ejection opening of said ejecting means; and wiping means having a wiping member for wiping a region including said ejection opening between two stepped portions on an ejection opening forming surface of said ejection means.

BRIEF DESCRIPTION OF THE DRAWINGS

The present invention will be understood more fully from the detailed description given herebelow and from the accompanying drawings of the preferred embodiment of the invention, which, however, should not be taken to be limitative of the present invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

First Embodiment

The present invention has been developed from a novel viewpoint resulting from study of behavior of mist generated due to rebounding of liquid from a printing medium caused by ejection.

More specifically, a problem encountered upon occurrence of rebounding mist is that an insoluble matter in the rebounding mist is deposited on an ejection opening portion of an ink-jet head and/or a portion in the vicinity thereof to cause serious ejection failure. Accordingly, in a first example of a first embodiment of the present invention, there is provided a cover for covering a region of the head, which region is decided by study of behavior of the rebounding unit so that the insoluble matter can be prevented from being deposited on a ejection opening forming surface per se as well as on the ejection openings or the portion in the vicinity thereof or an amount of the insoluble matter deposited can be reduced.

When such a cover is provided, a range to provide the cover means becomes a problem to study. Therefore, discussion will be given hereinafter with respect to study for the range to be covered.

Figures 1A, 1B, 1C:
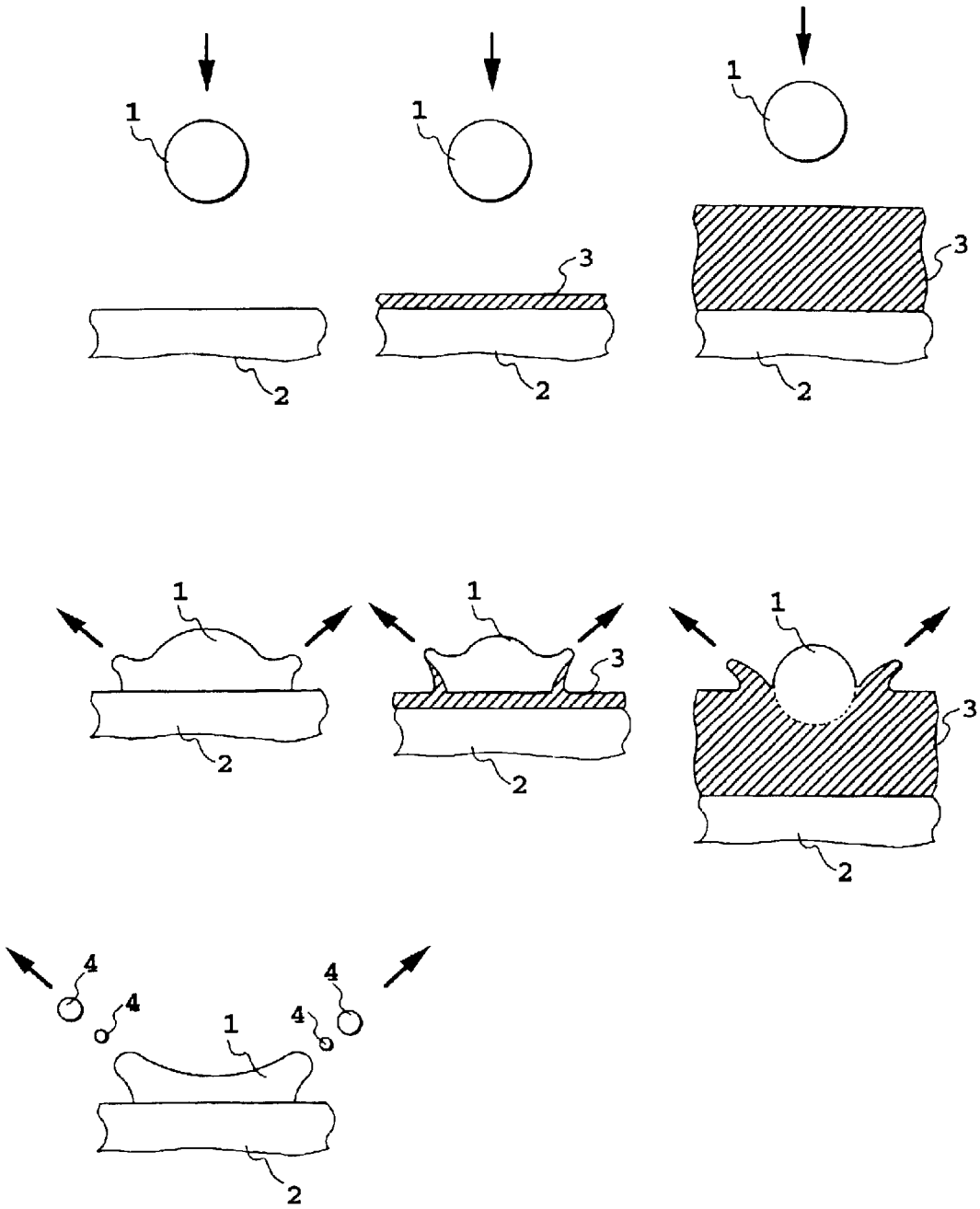
FIGS. 1A to 1C are explanatory illustrations for explaining generation of rebounding mist of an ink and so forth in one embodiment of the present invention.

FIGS. 1A to 1C are diagrammatic illustrations for explaining behavior in rebounding or so forth caused by colliding of a liquid droplet with a liquid layer formed on the printing medium. FIG. 1A shows the case where the liquid droplet directly collides with the printing medium, FIG. 1B shows the case where the liquid droplet collides with a relatively thin liquid layer on the printing medium, and FIG. 1C shows the case where the liquid droplet collides with a relatively thick liquid layer. It should be noted that FIGS. 1A to 1C show variations of behavior associated with elapsing of time sequentially from the upper views to the lower views. Also, in the respective state 9 shown by FIGS. 1A to 1C, a speed of the liquid droplets are the same.

As shown in FIG. 1A, when a liquid droplet 1 directly collides with a printing medium 2, the liquid droplet 1 deforming on the printing medium 2 by collision projects at the circumferential portion. Finally, a part of the liquid is separated to cause a plurality of fine liquid droplets 4 which form the rebounding mist. Then, the flying direction of the liquid droplets 4 becomes obliquely upward.

In the case of the example shown in FIG. 1B, substantially the same behavior as the former example of FIG. 1A is caused. More specifically, most of the rebounding liquid droplet (not shown) is a part of the ejected liquid droplet 1, and the rebounding liquid droplet forms cone-shaped mist. In each individual liquid droplet of the rebounding mist, however, a liquid forming a liquid layer 3 is admixed to the ejected liquid droplet 1 at a ratio depending upon property of the liquid layer 3 formed on the printing medium.

In contrast to the foregoing two examples, in the example shown in FIG. 1C, the direction of the rebounding liquid droplet (not shown) is the same as the former examples. However, most of the liquid forming the liquid droplets which form the rebounding mist is the liquid of the liquid layer 3. This is because, upon occurrence of collision of the liquid droplet 1 with the liquid layer 3, due to thickness of the liquid layer 3, an energy of collision is transferred to the liquid forming the liquid layer 3 rather than reactively acting on the liquid droplet 1. It should be noted that when the speed of the liquid droplet 1 is increased, the behavior upon collision becomes closer to the condition shown in FIG. 1B.

As can be clear from the discussion given hereabove, since the rebounding mist is rebounded in cone shaped configuration, possibility of deposition of the rebounding mist on the ejection openings or the portion in the vicinity thereof is low in a certain condition. Even if the rebounding mist deposits on the ejection openings or the portion in the vicinity thereof, the deposition amount can be small. When a covering means is provided in the shown embodiment, it is a problem that a portion on the ejection opening forming surface becomes a region on which the rebounding mist showing behavior set forth above is deposited.

As can be clear from the discussion given with respect to FIGS. 1A to 1C, the rebounding mist in cone shape has low possibility of deposit on the ejection opening per se which ejected the liquid droplet, such as the ink droplet or the processing liquid droplet. Even if deposited, the deposition amount is quite small. However, in the case of an ink-jet head arranged with a plurality of ejection openings, it is possible that the rebounding mist caused by the ink or so forth ejected from an adjacent ejection opening may be deposited on the ejection opening or in the vicinity thereof.

Therefore, as a basic manner of the covering range, the covering range is set to open only at the portion corresponding to the ejection opening and the circumference in the vicinity thereof. By this, the amount of deposition of the rebounding mist particularly on the adjacent ejection opening and in the vicinity thereof, can be reduced.

Next, the inventors have found that depositing condition of the liquid including the depositing region is significantly differentiated depending upon a distance between the ink-jet head and the printing medium (hereinafter referred to as "a paper distance"). In a second example of the shown embodiment, the covering range is set appropriately in this viewpoint.

FIGS. 2A to 2D are diagrammatic illustrations showing difference of rebounding mist and depositing condition depending upon the paper distance. Respective conditions shown in these figures are illustrated under a condition where the ejection amount of each ejection openings is 7 to 15 [pl] at ejection speed of 10 to 20 [m/sec]. In addition, respective ejection duties are mutually the same.

It should be noted that FIGS. 2A to 2D are illustrated under the condition where a phase of rebounding mist is symmetric with respect to the ejection openings of the ink-jet head. However, in many actual printing apparatuses, the ink-jet head moves relative to the printing medium. Therefore, symmetry of the phase in a precise sense cannot be guaranteed. However, the following discussion is in touch with the deposition of the rebounding mist and essentially not in touch with symmetry. Furthermore, even with the relative movement, offset from the symmetric position, due to a component in the relative motion direction of the speed of the liquid droplet, is quite small. Accordingly, the following discussion is essentially reasonable even for the case where the ink-jet head moves relative to the printing medium.

Figure 2A:
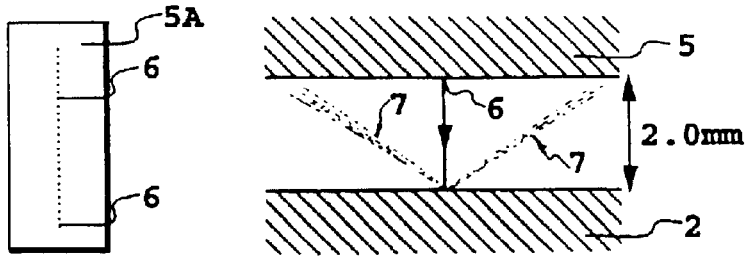
FIGS. 2A to 2D are explanatory illustrations for explaining formation and deposition of rebounding mist depending upon a distance to a paper, in one embodiment of the present invention.

FIG. 2A is an illustration showing behavior of the rebounding mist at the paper distance of 2.0 mm and a condition of deposition of the mist on the ejection opening forming surface. As shown in FIG. 2A, ink droplets ejected from an ejection opening 6 of an ink-jet head 5 rebound on the printing medium 2 to form rebounding mist 7. Most of the droplets of rebounding mist 7 do not reach an ejection opening forming surface 5A for a relatively large paper distance. Accordingly, little mist may be deposited on the ejection opening forming surface 5A.

Figure 2B:
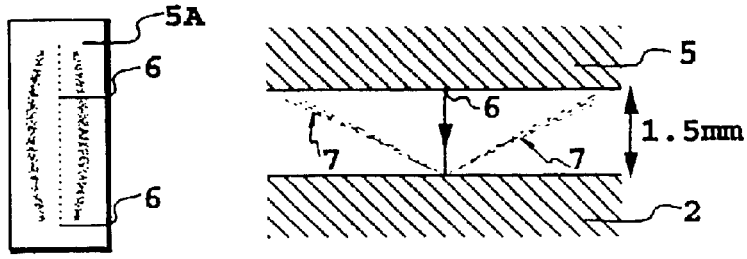
Figure 2C:
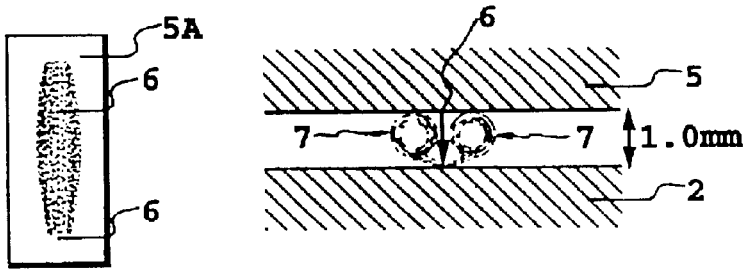
Figure 2D:
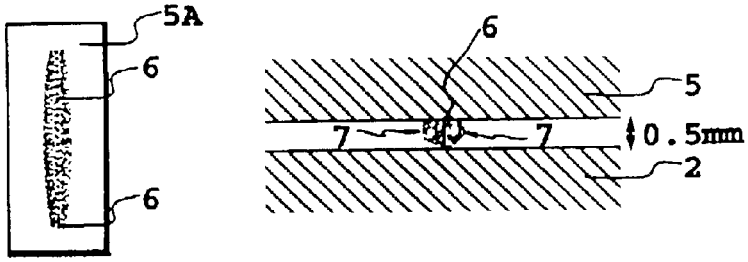

Reducing the paper distance from the foregoing case, a little mist 7 starts to be deposited on a portion around but distanced from the ejection openings. For example, as shown in FIG. 2B, when the paper distance is set at 1.5 mm, the mist may be deposited on a region relatively close to the ejection openings 6. However, even in this case, little mist is deposited on the ejection opening or in the vicinity thereof. Then, as shown in FIGS. 2B, 2C and 2D, while each rebounding mist associated with each individual ejection opening becomes a cone shaped configuration as set forth above, if ejection is performed simultaneously with a given ejection duty through a plurality of ejection openings, mist may be deposited at both sides of the array of ejection openings substantially along the alignment direction of the ejection openings.

Next, when the paper distance is reduced to be about 1.0 mm, the condition of the rebounding mist becomes different from those discussed with respect to FIGS. 2A and 2B. More specifically, paying attention to one ejection opening, when the ejection duty is relatively low and thus ejection is effected intermittently, for example, the rebounding mist to be formed with respect to the ejection opening in question becomes substantially the same as those discussed with reference to FIGS. 2A and 2B. However, as the ejection duty is increased beyond a certain value, ejection becomes continuous, generating a swirl of the rebounding mist. For such swirl formation, the ejection duty is one important factor, but the paper distance and the ejection period are also important factors.

Figure 3:
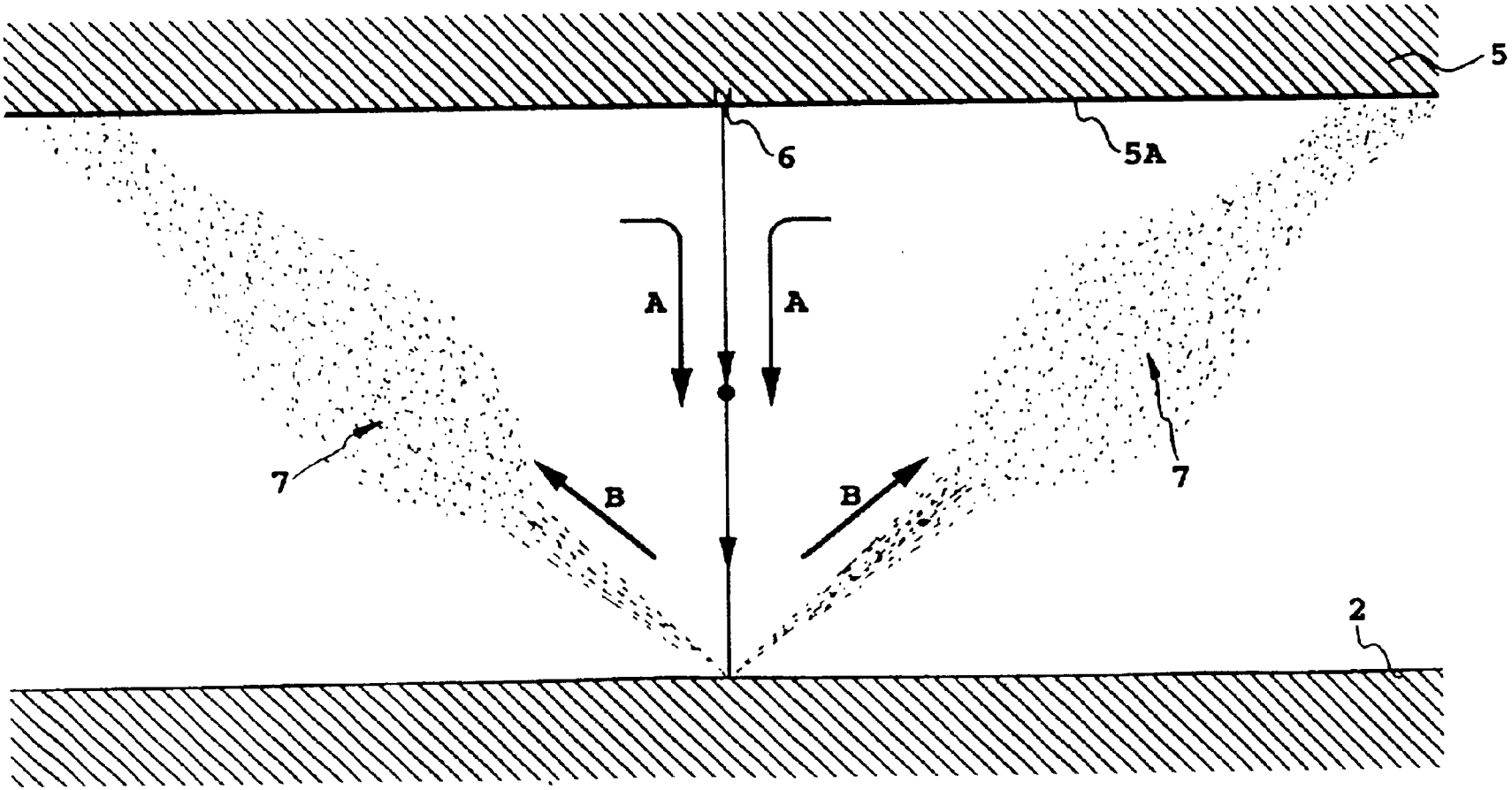
FIG. 3 is an illustration for explaining the foregoing rebounding mist.
Figure 4:
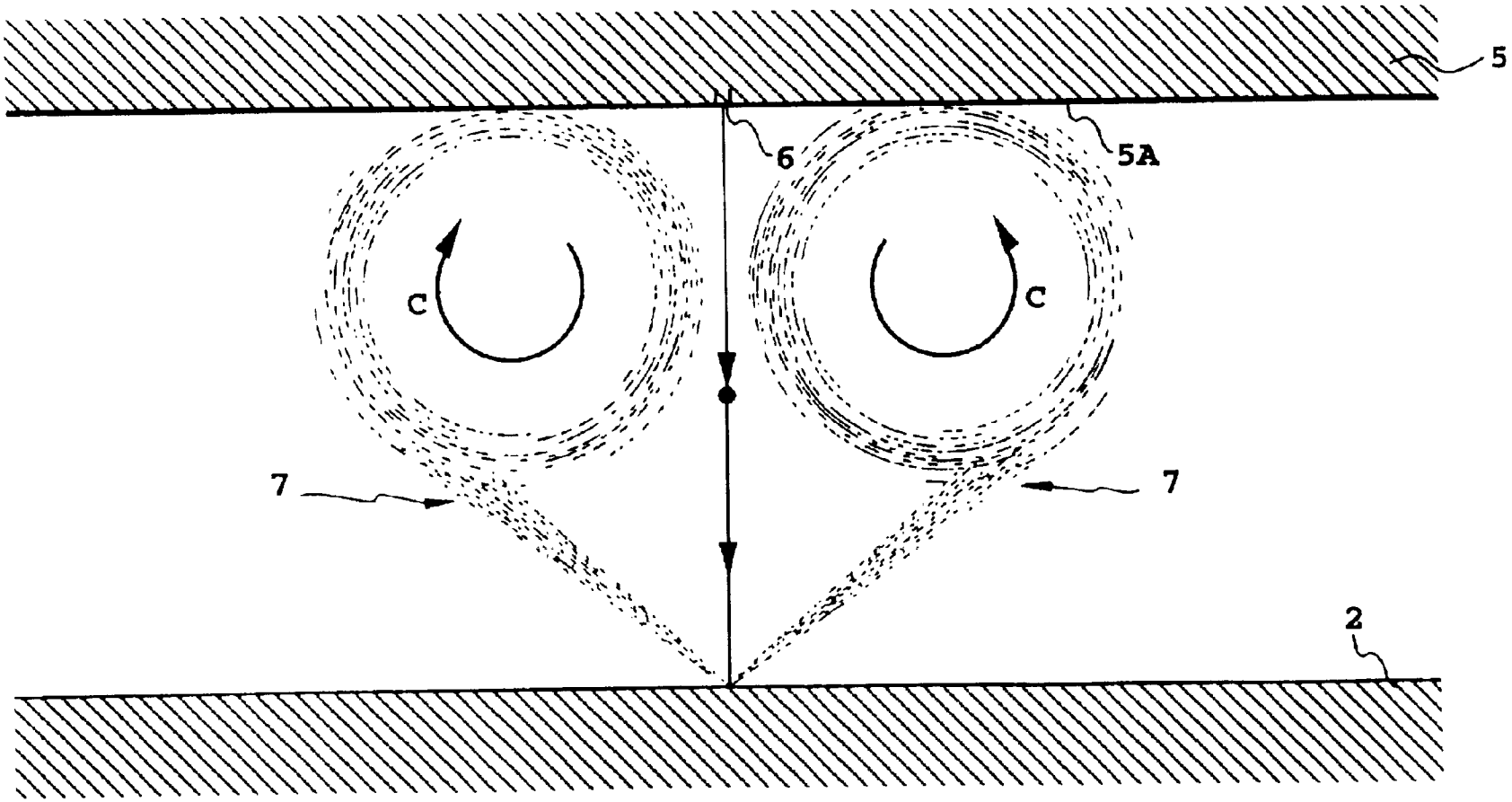
FIG. 4 is an illustration for explaining formation of swirls by the rebounding mist.

FIGS. 3 and 4 are diagrammatic illustrations for explaining the process of formation of the swirl by the rebounding mist. It should be noted that the following discussion including discussion for formation of the swirl has been given on a basis of prediction from condition of mist deposition on the ejection opening forming surface.

As shown in FIG. 3, when ejection of ink or so forth is performed through the ejection opening 6 of the ink-jet head 5, the rebounding mist 7 directed to a direction B in FIG. 3 is formed. In the case that when the ejection is continuous, air flow is generated as shown by A in FIG. 3 by flying ink droplets ejected continuously. It is considered that by this, the rebounding mist 7 is gradually subject a force oriented toward the center in FIG. 3 for finally forming the swirl as shown in FIG. 4.

It should be noted that, even in formation of the swirl, the relative motion of the ink-jet head to the printing medium may cause some effect. More specifically, when ejection is performed continuously, the hitting position of the liquid droplet on the printing medium is continuously shifted due to the relative motion. Therefore, the swirl shown in FIG. 4 will not be generated in a precise sense. However, as set forth above, since the rebounding mist per se has a speed component in the direction of the relative motion, and the ejection speed is much higher than the speed component in the relative motion direction, it can be presumed that the swirl substantially as illustrated in FIG. 4 is formed.

Referring again to FIGS. 2A to 2D, due to formation of the swirl, the amount of mist to be deposited in the vicinity of the ejection openings on the ejection opening forming surface 5A is increased, and the size of a deposited droplet becomes large as shown in FIG. 2C.

When the paper distance is further reduced to be about 0.5 mm, the amount of the mist deposited on the ejection opening portion and in the vicinity thereof is abruptly increased.

As can be clear from discussion given hereabove, a region of the ejection opening forming surface where the rebounding mist is deposited, is differentiated depending upon the paper distance. Accordingly, in the shown embodiment, the range to be covered with the member for covering the ejection opening forming surface is determined depending upon the paper distance set in an apparatus construction. For example, in the case of the apparatus in which the paper distance is relatively large as shown in FIG. 2A and thus there is no the possibility of deposition of the rebounding mist, no problem will arise even when the covering member is not provided. Further, in the case of the apparatus, in which the range of deposition of the mist is the distanced circumferential portion as shown in FIG. 2B, it should be effective to cover at least the circumferential portion. Also, in the case of the apparatus, in which the rebounding mist may be deposited on the vicinity of the ejection openings, the substantially overall portion has to be covered, with an opening only at the portion corresponding to the ejection opening and the portion in the vicinity of the ejection opening.

On the other hand, in the shown embodiment, depending upon the form of the cover member as set forth above, a construction for wiping the ejection opening forming surface should be differentiated. By this, deposition of the insoluble matter on the ejection opening forming surface can be appropriately prevented. Furthermore, water droplets caused by dew condensation due to temperature variation of the ink-jet head or paper dust can be removed effectively.

In the third example of the shown embodiment, a covering manner of the cover means for the ink-jet head is differentiated depending upon ejection order of the ink and the processing liquid for making the ink insoluble or an ink containing the processing liquid. Hereinafter, discussion will be given for conditions of deposition of the insoluble matter on respective ink-jet heads depending upon the ejection order.

FIGS. 5A to 5D are diagrammatic illustrations for explaining difference of the liquid droplet to be deposited on respective ejection opening forming surfaces depending upon the order of ejection when an ink-jet head for ejecting a processing liquid S (hereinafter referred to as "processing liquid head") and an ink-jet head for ejecting a black ink K (hereinafter referred to as "black ink head") are employed. It should be noted that, in these drawings, an array of the ejection openings in the ejection opening forming surface is omitted from illustration.

Figures 5A, 5B, 5C, 5D:
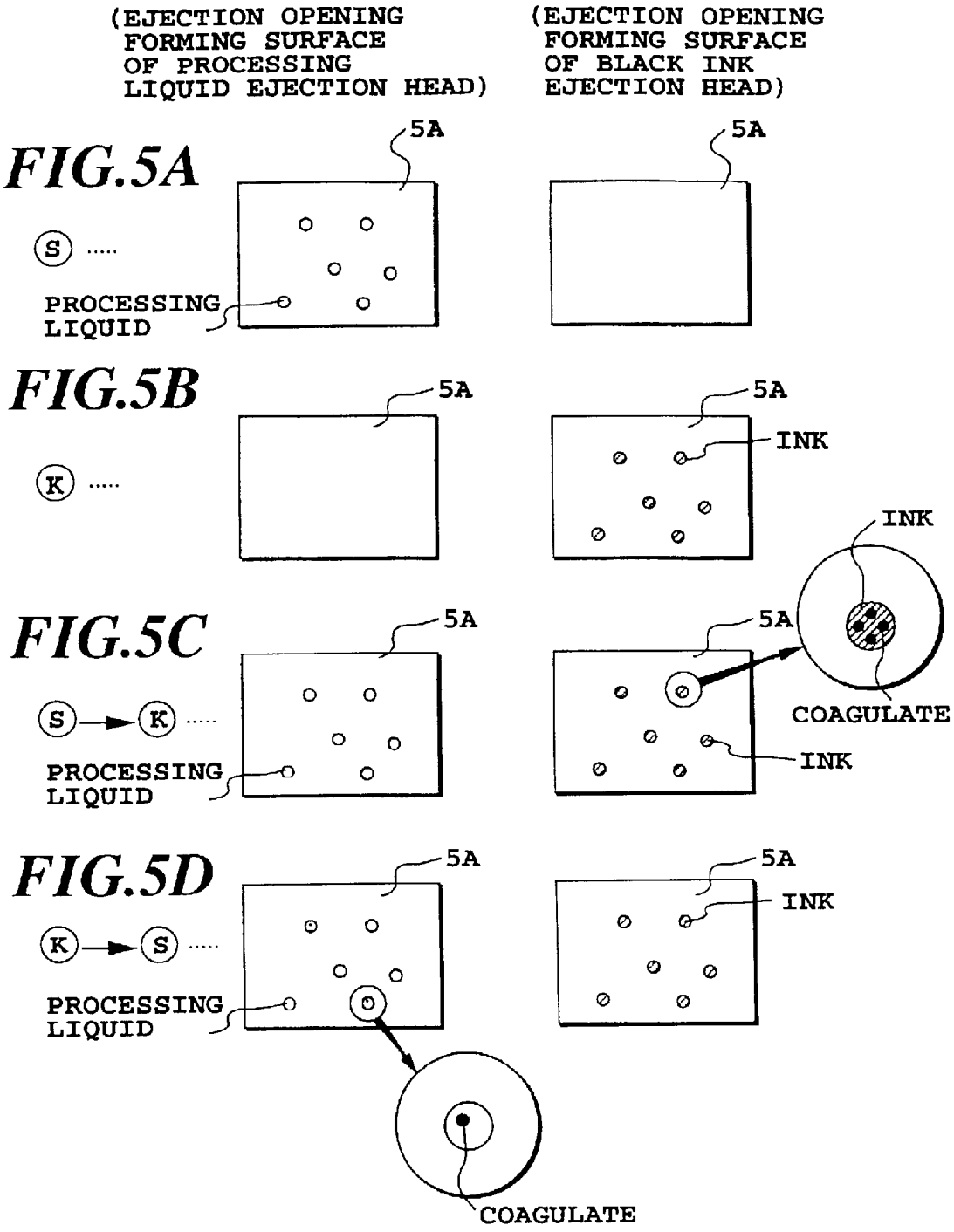
FIGS. 5A to 5D are illustrations for explaining difference of content of the rebounding mist depending upon order of ejection of the ink and the processing liquid, in one embodiment of the invention.

As shown in FIG. 5A, when ejection is performed only with the processing liquid head, only processing liquid is deposited on the ejection opening forming surface 5A of the processing liquid head due to the rebounding mist discussed with respect to FIGS. 2 to 4. Similarly, when ejection is performed only with the black ink head, only black ink is deposited on the ejection opening forming surface 5A, as shown in FIG. 5B.

In contrast to this, when a black dot is to be formed in actual printing, when ejection is performed in the order of the processing liquid S and the black ink K as shown in FIG. 5C, a liquid droplet of the processing liquid is S deposited on the ejection opening forming surface 5A of the processing liquid head. On the other hand, on the ejection opening forming surface 5A of the black ink head, a liquid droplet containing a relatively large amount of particles of coagulated substance created by reaction of the processing liquid S and the black ink K, in the black ink, is deposited. The liquid droplet containing coagulated substance becomes an insoluble substance on the ejection opening forming surface 5A and is difficult to remove.

On the other hand, as shown in FIG. 5D, when ejection is performed in the order of the black ink K and then the processing liquid S, a droplet of the processing liquid S containing one or two coagulated substances may be occasionally deposited on the ejection opening forming surface 5A of the processing liquid head, and a deposition amount is smaller than that of the black ink head shown in FIG. 5C. On the other hand, on the ejection opening forming surface 5A of the black ink head, a liquid droplet of only black ink is deposited.

Figure 6A:
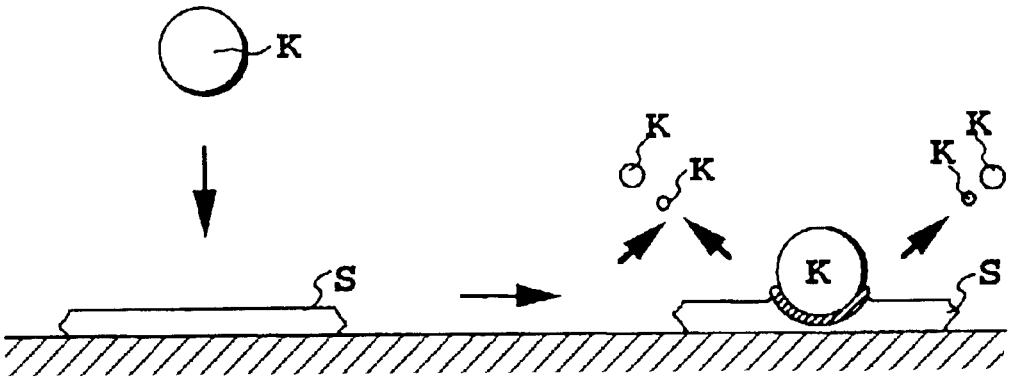
FIGS. 6A and 6B are illustrations for explaining a principle of a difference of the foregoing content.
Figure 6B:
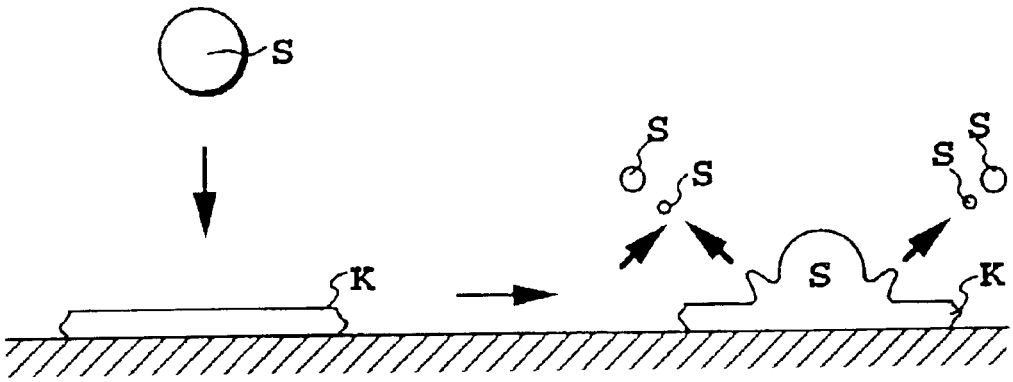

FIGS. 6A and 6B are illustrations showing difference of liquid deposition depending upon difference of the order of ejection shown in FIGS. 5C and 5D. FIG. 6A corresponds to FIG. 5C and shows generation of the rebounding mist when ejection is performed in the order of the processing liquid S and then the black ink K. FIG. 6B corresponds to FIG. 5D and shows generation of the rebounding mist when ejection is performed in the order of the black ink K and then the processing liquid S.

As also shown in FIG. 1A, the rebounding mist is generated in a manner that the liquid droplet collides with the printing medium so that a part of the colliding liquid droplet is separated to fly, as the rebounding mist. More specifically, when the processing liquid or the black ink has already been ejected depending upon order of ejection, the already ejected processing liquid or the black ink forms a thin layer of liquid on the printing medium. Then, subsequent hitting of the black ink or the processing liquid causes its own deformation and separation to cause flying of fine droplets rather than splashing to generate the fine flying droplet of the liquid in the thin layer while crowding out the liquid surface of the thin layer. Accordingly, most of the liquid droplet forming the rebounding mist is the later ejected liquid and partly contains the preliminarily ejected liquid at the boundary of two liquids contacting with the later ejected liquid upon collision.

In the case shown in FIG. 6A, the processing liquid S has already been ejected and forms the thin layer, and when the black ink K is ejected to this portion, collision of the black ink with the processing liquid causes flying fine droplets primarily containing the black ink and partly containing the black ink K. In this case, between the black ink K and the processing liquid S, reaction having directionality directed from the processing liquid S side to the black ink K side is caused to generate the coagulated substance to contain a relatively large amount of coagulated substance in the black ink which forms the rebounding mist.

In contrast to this, as shown in FIG. 6B, when the order of ejection is the black ink K and then the processing liquid S, the directionality of the reaction set forth above becomes opposite with respect to the flying direction of the rebounding liquid droplet. Therefore, the coagulated substance presented in the liquid droplet of the processing liquid S forming the rebounding mist becomes a quite small amount.

As set forth above, a deposition amount of the insoluble substance is different depending upon the order of ejection. Therefore, in the third example of the shown embodiment, in a plurality of ink-jet heads ejecting the processing liquid S and other inks, the arrangement of the covering means is differentiated depending upon the order of ejection.

In the fourth example of the shown embodiment, the cover means is provided for preventing deposition of the insoluble substance at least on the ejection opening and in the vicinity thereof while deposition of the insoluble substance on the ejection opening forming surface is permitted.

Figure 7:
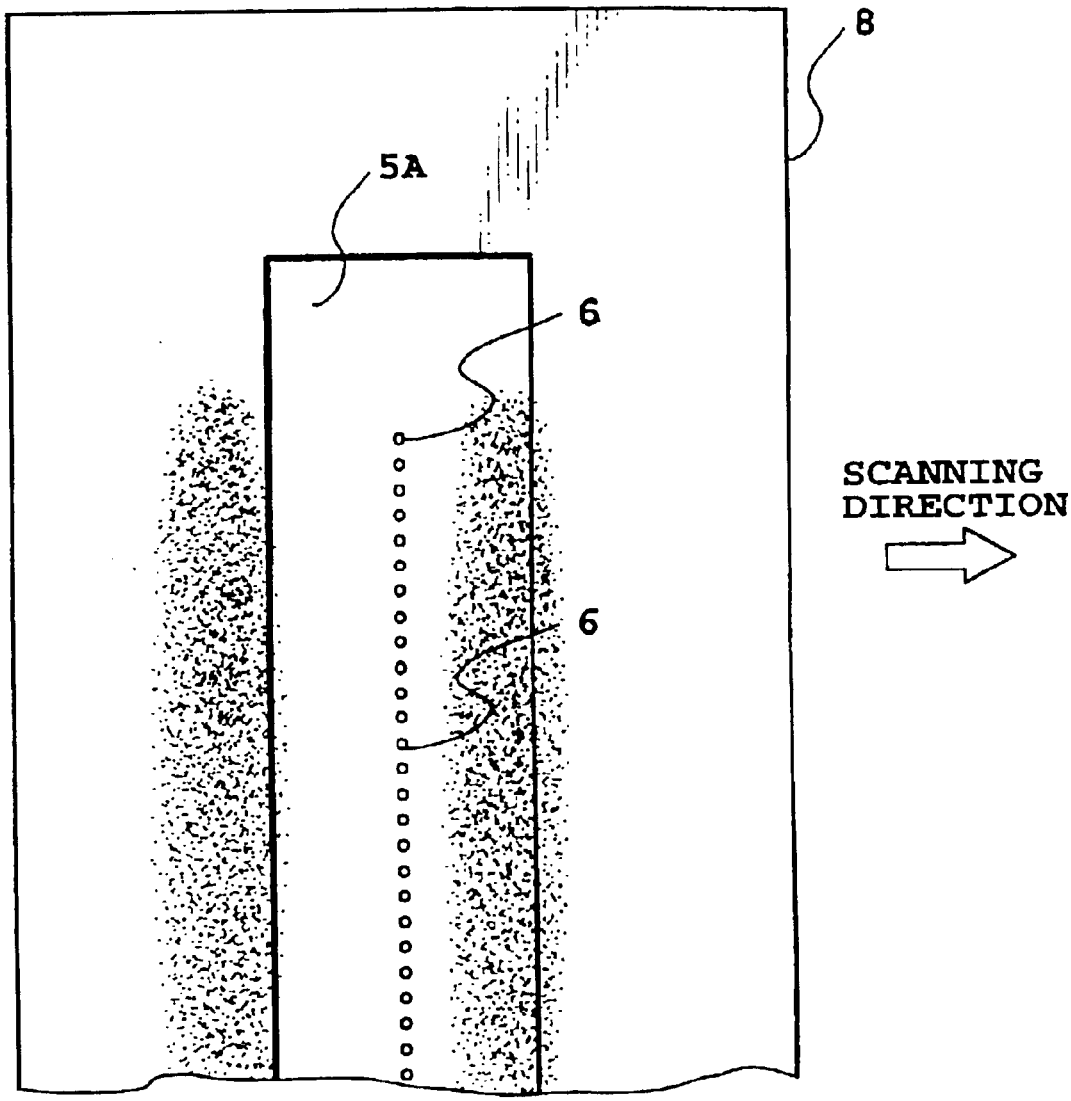
FIG. 7 is an illustration for explaining difference of depositing position of the rebounding mist depending upon an arrangement of a cover plate, in one embodiment of the invention.

FIG. 7 shows one example of the fourth example of the covering means, which covers the circumferential portion distanced from the ejection opening array of the ejection opening forming surface 5A of the ink-jet head to a certain extent in the case that the paper distance is set at the distance shown in FIG. 2C.

More specifically, the fourth example has been developed with attention paid to for the fact that, when the cover shown in FIG. 7 is employed in the case of the foregoing paper distance, while the rebounding mist may be deposited on the ejection opening portion and in the vicinity thereof, a deposition distribution shown in FIG. 7 is caused by air flow generated by scanning of the ink-jet head as discussed later in connection with a second embodiment.

It should be noted that while the covering member set forth above is intended to finally prevent or reduce deposition of the insoluble substance, the covering member can of course achieve a similar function and effect in preventing deposition of the ink on the ejection opening forming surface even in the ink-jet apparatus employing only normal ink.

Figure 8:
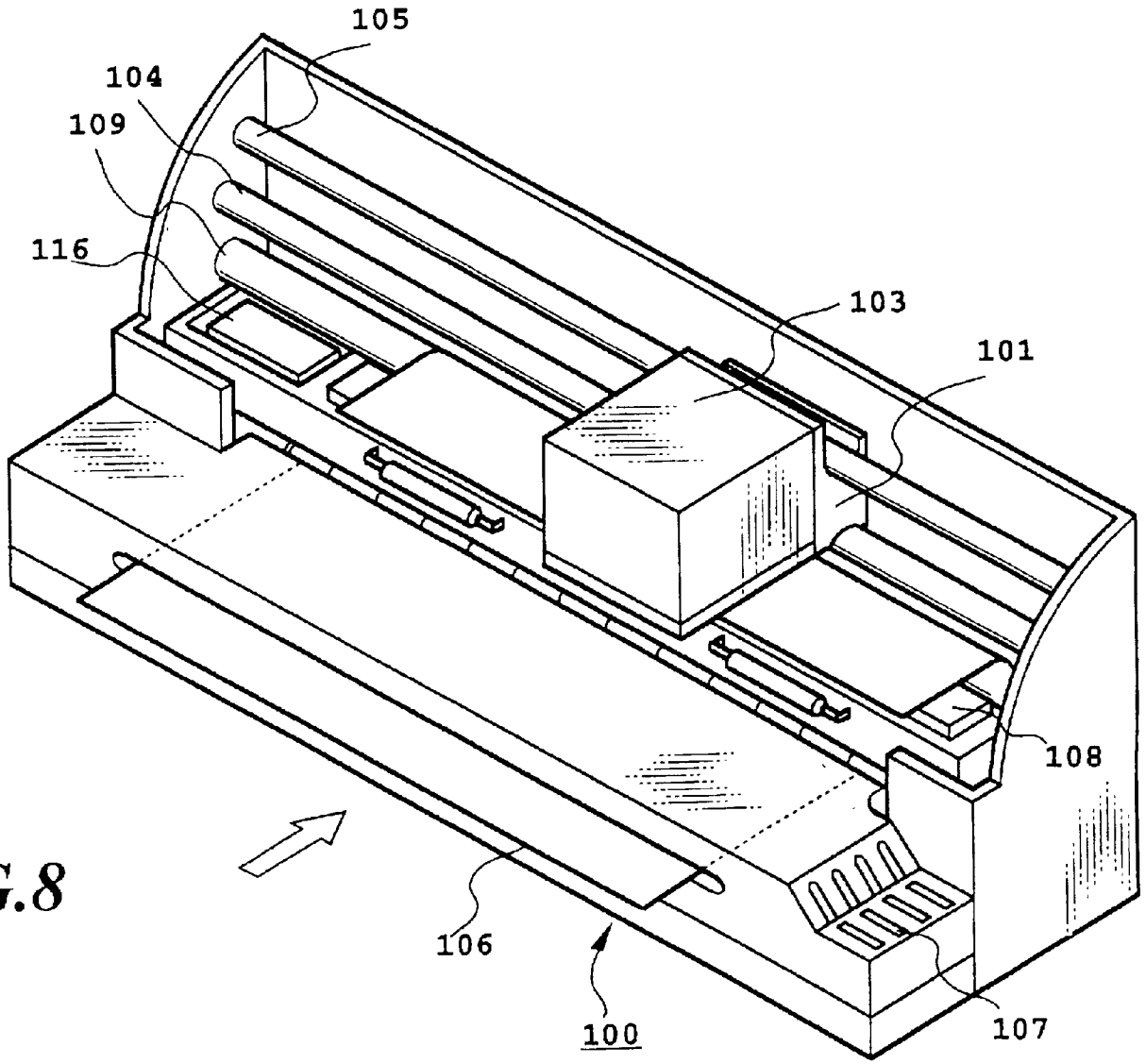
FIG. 8 is a general perspective view showing one embodiment of an ink-jet printing apparatus according to the present invention.

FIG. 8 is a perspective view showing a general construction of one embodiment of an ink-jet printing apparatus according to the present invention.

In FIG. 8, a printing paper 106 inserted into a paper feeding position of an apparatus is fed, by a feeder roller 109, to a region where printing can be effected by an ink-jet head unit 103 (hereinafter referred to as "printing region"). In the printing region, a platen 108 is provided on the back surface portion of the printing medium.

A carriage 101 is constructed for movement in a predetermined direction by two guide bars 104 and 105. By this, the ink-jet head unit 103 can reciprocally scan the printing region. The carriage 101 can mount respective ones of the following units. Namely, on the carriage 101, the ink-jet head unit 103, including ink-jet heads for ejecting a plurality of colors of inks and the processing liquid and ink tanks for supplying the ink or the processing liquid for respective ink-jet heads, is mounted. For example, as a plurality of colors of inks, black (Bk), cyan (C), magenta (M) and yellow (Y) inks may be employed.

At the left end of the range of motion of the carriage 101, a recovery system unit 110 is provided at the lower portion. During a non-printing state or so forth, the ejection opening portion of the ink-jet head can be capped by the recovery system unit 110. In the shown case, the left end position is referred to as home position of respective ink-jet heads.

The reference numeral 107 denotes a switch portion and a display element portion. The switch portion is used for turning ON and OFF of a power source of the ink-jet printing apparatus, setting of various printing modes and so forth. On the other hand, the display portion is used for displaying various states of the printing apparatus.

Figure 9:
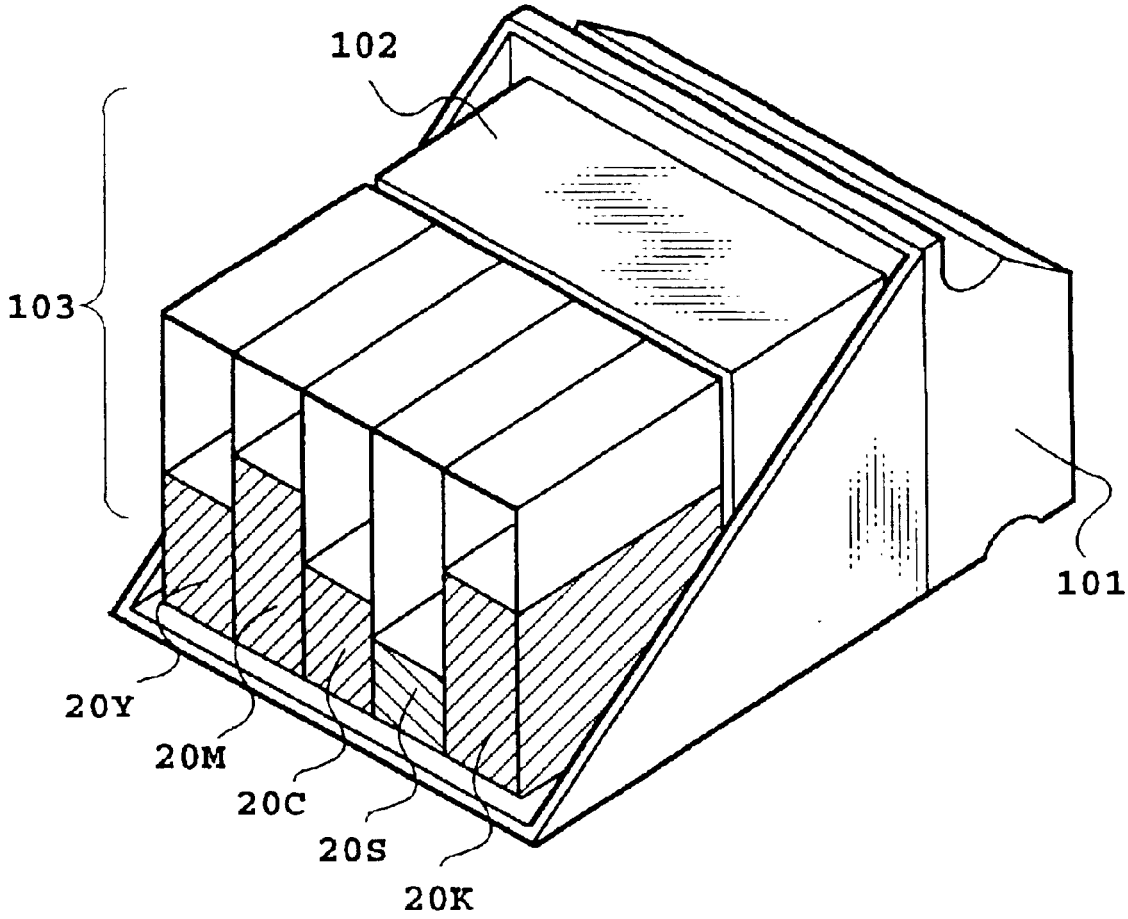
FIG. 9 is a perspective view showing an ink-jet unit employed in the foregoing apparatus.

FIG. 9 is a perspective view showing one example of the ink-jet head unit 103 which can be mounted on the carriage 101.

In the shown example, there is shown a construction where respective ink tanks for black, cyan, magenta and yellow inks and the processing liquids can be exchanged independently of the other.

On the carriage 101, five ink-jet heads respectively ejecting Bk, C, M and Y inks and the processing liquid are mounted as a head unit 102. Also, Bk ink tank 20K, C ink tank 20C, M ink tank 20M, T ink tank 20Y and processing liquid tank 21 are also mounted on the carriage 101. Respective tanks are connected to corresponding ink-jet heads through connecting portions for supplying the ink or the processing liquid. It should be noted that the construction of the ink-jet head unit is not specified to the shown construction but can be constructed in various fashions. For instance, the processing liquid tank and the Bk ink tank may be integrated with each other, and also the C ink tank, M ink tank and Y ink tank may be formed as an integrated construction.

Figure 10:
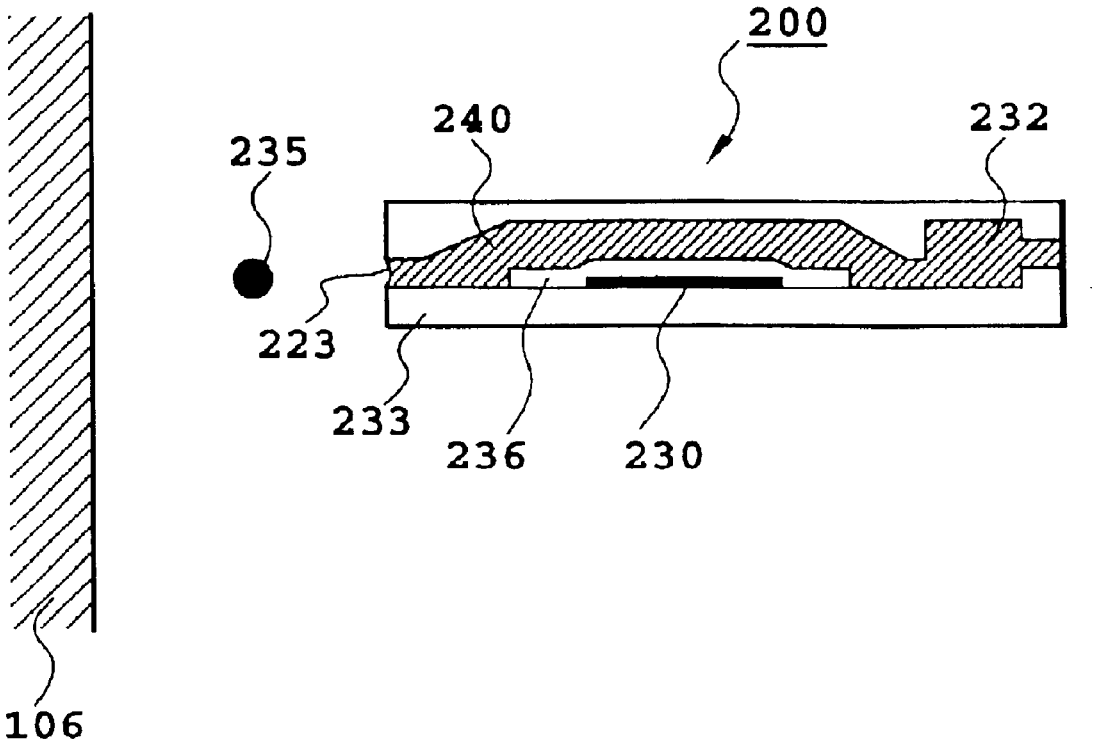
FIG. 10 is a longitudinal section showing one example of construction of an ink-jet head forming the foregoing ink-jet unit.

FIG. 10 is an enlarged section showing a detailed construction of the ink-jet head for ejecting each color of ink or the processing liquid.

As shown in FIG. 10, an ink-jet head 200 employs a system, in which a plurality of ejection openings is provided, and a plurality of heating bodies of electrothermal transducers is arranged corresponding to respective ejection openings for ejecting the ink or the processing liquid by applying driving signals corresponding to ejection information to respective of the heater elements.

The heater elements 230 are constructed to heat independently per the ejection opening. The ink or the processing liquid in an ink passage 240 abruptly heated by heating of the heater element 230, generates a bubble by film boiling for ejecting the ink or the processing liquid 235 toward the printing paper 106 by the pressure of generation of the bubble. Thus, characters, graphic images or so forth are printed on the printing medium 106. At this time, the volume of any ejected liquid drop of colors of inks and the processing liquid is normally 5 to 80 ng.

For each ejection opening 223, the ink passage 240 communicated thereto is provided. At the back side of the portion where the ink passage 240 is provided, a common liquid chamber 232 is arranged for supplying the ink or the processing liquid for respective of the ink passages 240. In the ink passages 240 respectively corresponding to the ejection openings 223, the foregoing heat elements 230 set forth above and electrode wiring (not shown) for supplying an electric power to the former are provided. These heater elements 230 and the electrode wiring are formed on a substrate 233 of silicon or so forth by layer forming technology. On the heater element 230, a protection layer 236 is formed for preventing the ink from directly contacting with the heater body. Also, on the substrate, a partitioning wall 234 of resin or glass material is laminated to form the ejection opening, the ink passage and the common liquid chamber.

Thus, since the printing system employing the heater body utilizes bubbles formed by application of thermal energy for ejection of the ink droplets, it is called a bubble-jet system.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 Am in pore size (tradename: Fluoropore filter manufactured by Sumitomo Electric Industries, Ltd.), and thereafter, the pH of the mixture is adjusted to a level of 4.8 by adding sodium hydroxide whereby liquid A1 can be obtained.

[Components of A1]

| | |
|---|---|
| low molecular weight ingredients of cationic compound; stearyl- trimethyl ammonium salts (tradename: Electrostriper QE, manufactured by Kao Corporation), or stearyl- trimethyl ammonium chloride (tradename: Yutamine 86P, manufactured by Kao Corporation) | 2.0 parts by weight |
| high molecular weight ingredients of cationic compound; copolymer of diarylamine hydrochloride and sulfur dioxide (having an average molecular weight of 5000) (tradename: polyaminesulfon PAS-92, manufactured by Nitto Boseki Co., Ltd) | 3.0 parts by weight |

-continued

| | |
|---|---|
| thiodiglycol | 10 parts by weight balance |
| water | balance |

Preferable examples of ink which become insoluble by mixing with the aforementioned processing liquid are noted below.

Specifically, the following components are mixed together, the resultant mixture is pressure-filtered with the use of a membrane filter of 0.22 μm in pore size (tradename: Fuloroporefilter, manufactured by Sumitomo Electric Industries, Ltd.) so that yellow ink Y1, magenta ink M1, cyan ink C1 and black ink K1 can be obtained.

Y1

| | |
|---|---|
| C.I. direct yellow 142 | 2 parts by weight |
| thiodiglycol | 10 parts by weight |
| acetynol EH (tradename: manufactured by Kawaken Fine Chemical Co., Ltd.) | 0.05 parts by weight |
| water | balance |

M1 having the same composition as that of Y1 other than that the dyestuff is changed to 2.5 parts by weight of C. I. acid red 289.

C1 having the same composition as that of Y1 other than that the dyestuff is changed to 2.5 parts by weight of acid blue 9.

K1 having the same composition as that of Y1 other than that the dyestuff is changed to 3 parts by weight of C. I. food black 2.

According to the present invention, the aforementioned processing liquid a nd ink are mixed with each other at the position on the printing medium or at the position where they enter in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymers.

By the way, the term "insoluble" or "aggregation" refers to observable events in only the above first stage or in both the first and second stages.

When the present invention is carried out, since there is no need to use the cationic material having a high molecular weight and polyvalent metallic salts like the prior art or even if there is need to use them, it is sufficient that they are assistantly used to improve an effect of the present invention, a quantity of usage of them can be minimized. As a result, the fact that there is no reduction of color exhibition, which is a problem in the case that an effect of water resistibility is asked for by using the conventional cationic high molecular weight material and the polyvalent metallic salts, can be noted as another effect of the present invention.

With respect to a printing medium usable for carrying out the present invention, there is no specific restriction, and so called plain paper such as copying paper, bond paper or the like conventionally used can preferably be used. Of course, coated paper specially prepared for ink jet printing and OHP transparent film can preferably be used. In addition, ordinary high quality paper and bright coated paper can preferably be used.

Figure 11:
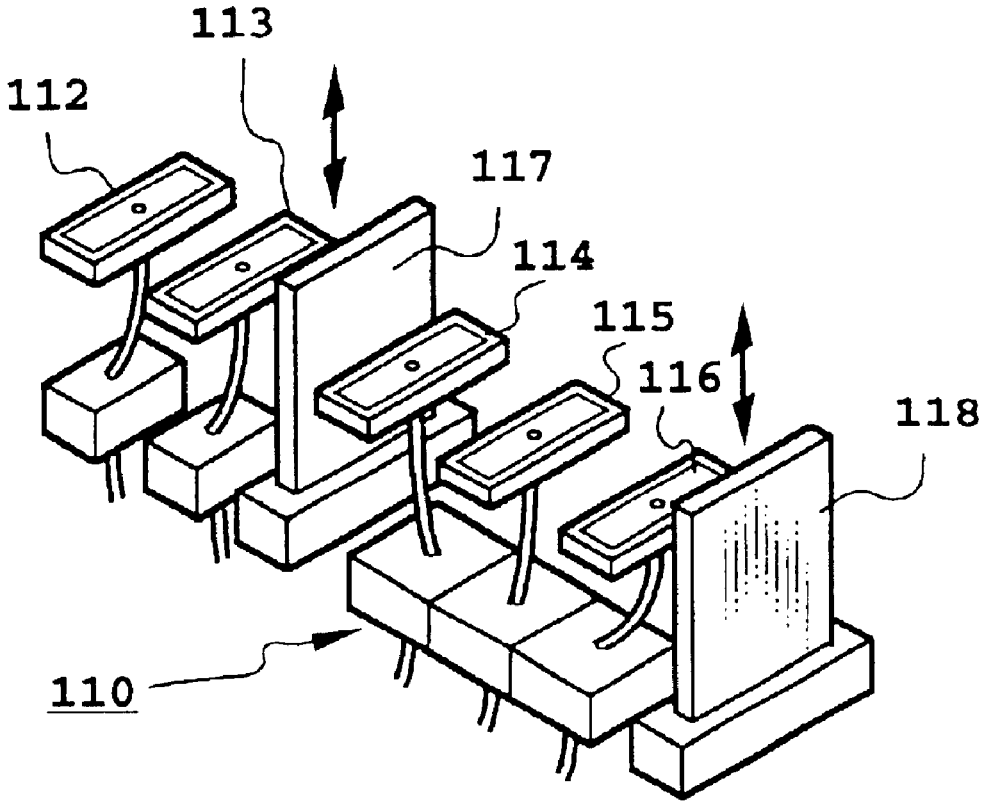
FIG. 11 is a perspective view showing a detail of a recovery unit provided in the foregoing apparatus.

FIG. 11 is a perspective view showing one example of the recovery unit 110 in the shown embodiment of the printing apparatus.

Corresponding to the head unit shown in FIG. 9, a Bk ink head cap 112, a C ink head cap 114, an M ink head cap 115, a Y ink head cap 116 and a processing liquid head cap 113 are provided. Respective caps are provided movably in the vertical direction. By this, when the head unit is located at the home position, respective caps are fitted onto the ejection opening forming surface of respective corresponding ink-jet heads for capping to prevent evaporation of the ink or the processing liquid in the ejection openings of the ink-jet heads and thereby prevent ejection failure due to increasing of viscosity and plugging by the ink caused by evaporation. Respective caps in the recovery unit are connected to pump units (not shown) so that vacuum pressure may be generated within the caps upon the suction recovery process for suctioning the ink in the condition where the cap units and the ink-jet heads are mated with each other. The pump units are provided as a pump unit dedicated for the processing liquid, and as respectively independent pump units for respective of heads for ejecting inks. Waste liquid resulting from suction recovery is fed to a waste tank through respectively independent waste liquid passages. This is for preventing respective colors of inks from contacting with the processing liquid in the cap or in the pump and becoming insoluble in the pump. It should be noted that the pump units may also number two, wherein one is for the processing liquid and the other is for respective colors of inks.

In the recovery unit, a processing liquid wiping blade 117 for performing wiping of the ejection opening forming surface of the processing liquid ejecting ink-jet head, and a printing ink wiping blade 118 for wiping the ejection opening forming surfaces of the printing ink ejecting ink-jet heads are provided. These blades are formed of an elastic material, such as rubber or so forth, for wiping the ink or the processing liquid depositing on the ejection opening forming surfaces of respective ink-jet heads. On the other hand, respective wiping blades are movable between an extracted or lifted-up position for wiping the ejection opening forming surfaces by motion of respective ink-jet heads and a retracted or lowered position so as not to interfere with the ejection opening forming surfaces by means of a not shown lifting device. It should be noted that detailed operation thereof will be discussed later.

As can be clear from FIG. 11, in order to prevent admixing of the ink and the processing liquid on the ejection opening forming surfaces by the wiping operation to form an insoluble substance, the processing liquid wiping blade 117 for wiping the processing liquid ejecting portion and the printing ink wiping blade 118 for wiping the ink ejecting portion are provided independently. Also, the processing liquid wiping blade 117 and the printing ink wiping blade 118 are constructed to independently move in the vertical direction.

Figure 12:
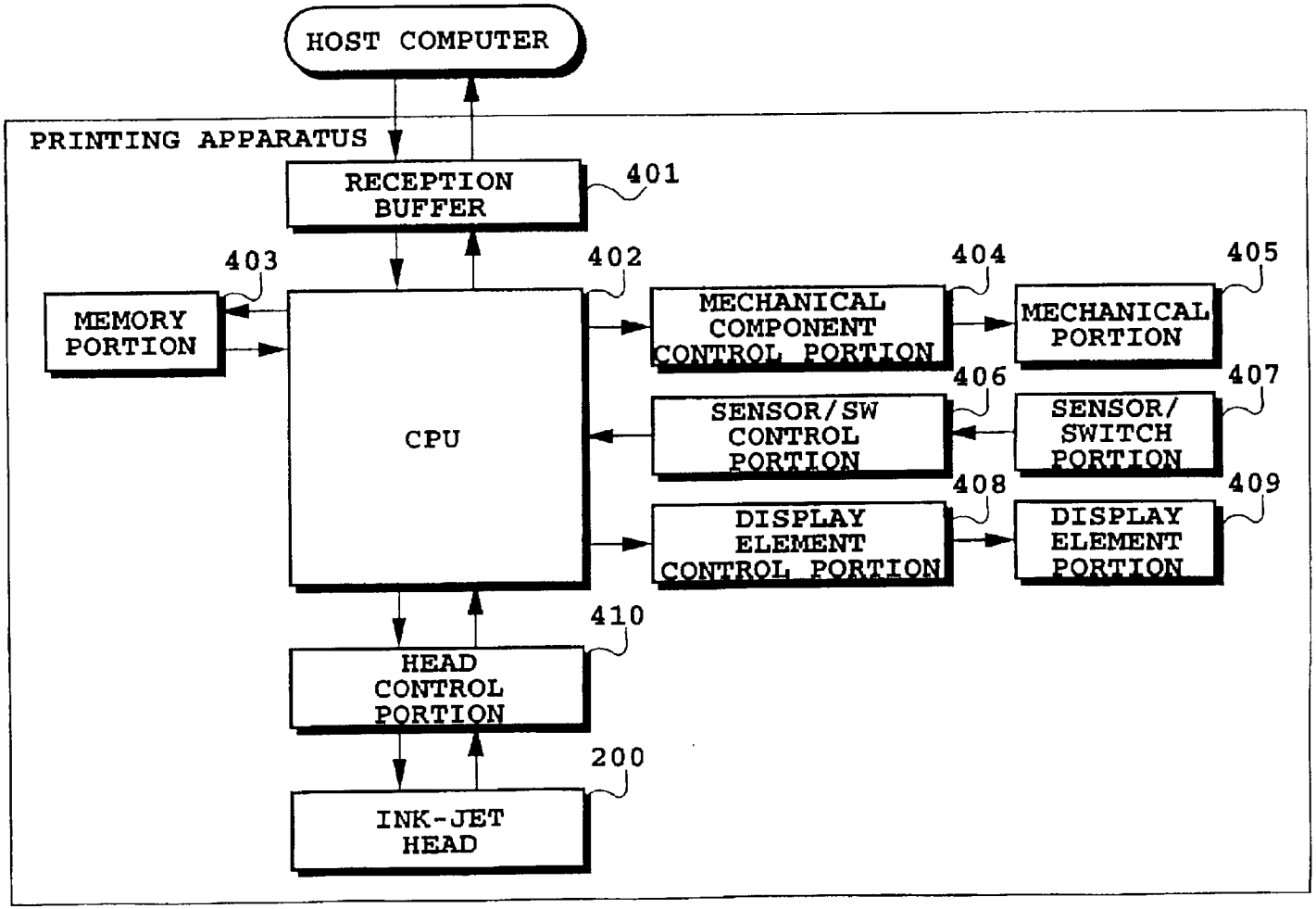
FIG. 12 is a block diagram showing a construction of a control system of the foregoing apparatus.

FIG. 12 is a block diagram showing a construction of a control system of the shown embodiment of the ink-jet printing apparatus.

In FIG. 12, data of character and image for printing (hereinafter referred to as "image data") from a host computer is input to a reception buffer 401 of the shown embodiment of the printing apparatus. On the other hand, data confirming whether the data is accurately transferred or not, or data for notifying of an operating condition at the printing apparatus side is transferred from the printing apparatus to the host computer. The image data stored in the reception buffer 401 is transferred to a memory portion 403 under management of a CPU 402 and is temporarily stored in a RAM (random-access memory). A mechanical component control portion 404 is responsive to a command from the CPU 402 for driving mechanical components 405, such as a carriage motor, a line feeding motor and so forth. A sensor/SW control portion 406 transfers signals from a sensor/SW portion 407 comprising various sensors and SW (switches). A display element control portion 408 controls a display element portion 409, comprising an LED display panel group, a liquid crystal display element group and so forth, in response to a command from the CPU 402. A head control portion 410 is responsive to a command from the CPU 402 for controlling driving of respective ink-jet heads 200. On the other hand, concerning states of ink-jet heads 200, the head control portion 410 provides temperature information or so forth detected by a not shown sensor to the CPU 402.

Figure 13:
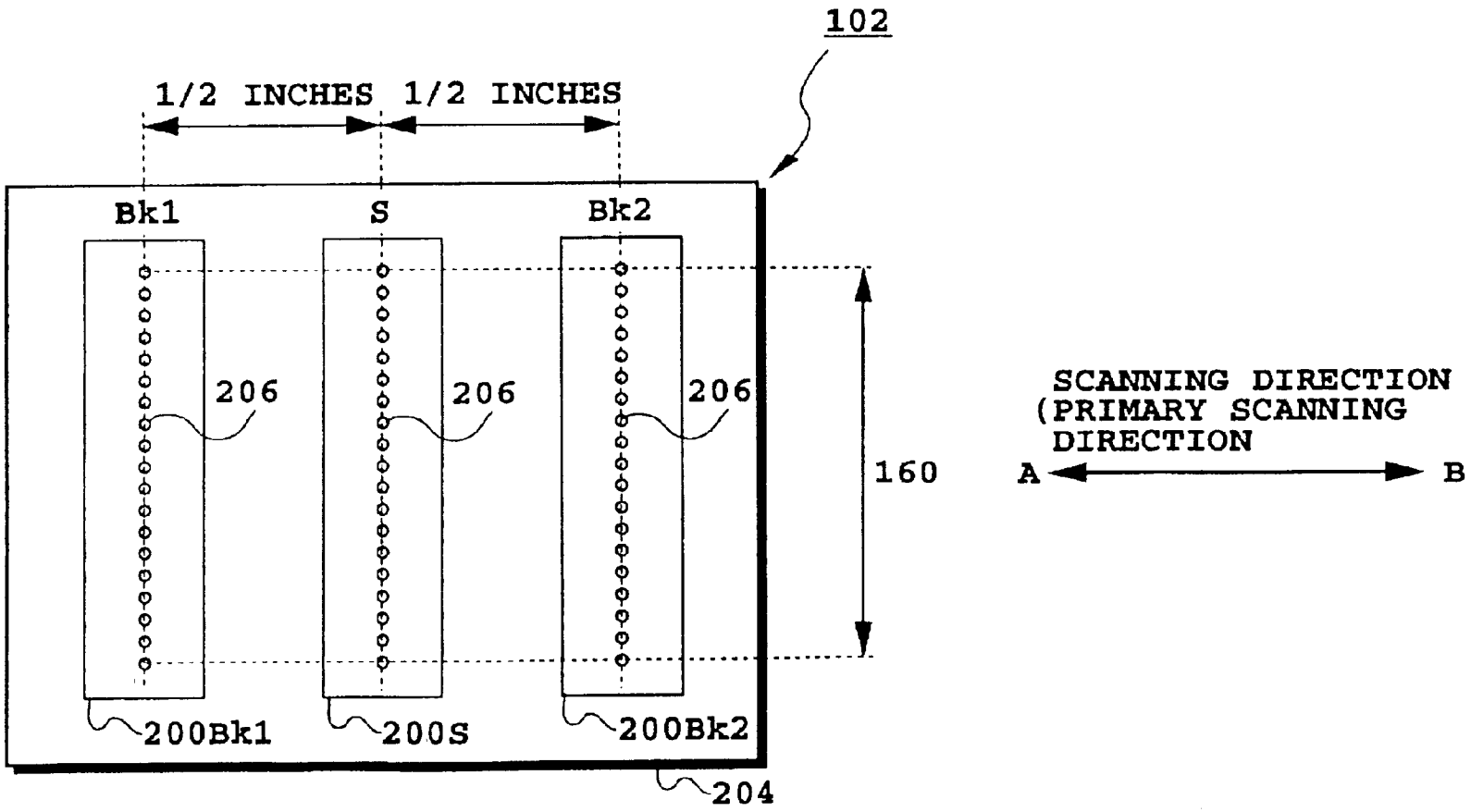
FIG. 13 is a front elevation showing one example of a head unit which can be employed in the foregoing apparatus.

FIG. 13 is an illustration showing one example of a head unit at the ejection opening forming surface, which can be used as the ink-jet head unit 103 shown in FIG. 8.

The head unit 102 is constructed with two ink-jet heads 200Bk1 and 200Bk2 both ejecting the black ink and a ink-jet head 200S ejecting the processing liquid S. Respective head chips are arranged with a pitch of ½ inches within a frame 204. It should be noted that respective head chips are arranged obliquely ($\tan\theta=1/160$) in consideration of driving timing in the alignment direction of the ejection openings. Respective head chips 200Bk1, 200S and 200Bk2 have a construction similar to that shown in FIG. 10. The ejection characteristics are as shown below.

<Bk1/S/Bk2>

(Ejection Characteristics)

Number of Ejections: 160 (Number of Divided Blocks: 16 blocks driven sequentially)

Resolution: 360 dpi

Driving Frequency: 8.0 (KHz)

Ejection Amount: Vd=80+4 (pl/droplet)

Ejection Speed: 15+0.5 (m/s).

As shown in FIG. 13, the ink-jet heads 200Bk1 and 200Bk2 for ejecting black ink K are arranged at both sides of the ink-jet head 200S ejecting the processing liquid S. By this arrangement of the head unit 102, printing of black image can be performed in both scanning directions A and B of the carriage 101.

In this case, in the third example relating to the order of ejection, in view of avoidance of deposition of the insoluble substance, ejection is performed in the order of the ink-jet head 200Bk1 and then the ink-jet head 200S during printing in the scanning direction A, and in the order of the ink jet head 200Bk2 and then the ink-jet head 200S during printing in the scanning direction B. Therefore, it is preferred that ejection of black ink K is always performed in advance of ejection of the processing liquid S. By this, concerning the rebounding mist depositing on the ink-jet head 200S, little insoluble substance is admixed. Then, in this case, if the cover member set out later is provided on the head though only little insoluble substance is admixed, the cover member can be set on the ejection opening forming surface of the ink-jet head 200S.

On the other hand, in the head unit 102 shown in FIG. 13, in the case that the order of ejection is set to first eject the processing liquid S and then the black ink K, the cover member can be provided on the ejection opening forming surfaces of the black ink ejecting heads 200Bk1 and 200Bk2. By this, it can be possible to prevent the rebounding mist containing a relatively large amount of coagulates from deposition on the ejection openings and in the vicinity thereof.

It should be noted that, when the head unit is employed as shown in FIG. 13, in either direction of bidirectional printing, ejection can be performed in the same order, regarding the processing liquid S and the black ink K. By this, it becomes possible to prevent the printing quality from lowering due to difference of density and color taste caused by difference of the order of ejection (order of overlaying in formation of dots).

In addition, as a modification of the printing method employing the head unit shown in FIG. 13, in scanning in one direction for a unidirectional printing or a bidirectional printing, it is possible to perform printing using all of the ink-jet heads 200Bk1, 200S and 200Bk2 so that ejection may be performed in the order of first black ink K, then the processing liquid S and then the black ink K for each pixel. Namely, ejection of the black ink K is performed twice so that the processing liquid S is overlaid on the black ink K, and then the black ink K is again overlaid on the processing liquid S.

With this modification, by further overlaying the black ink K on the processing liquid S which is overlaid on the black ink K, the amount of dye of the black ink to be maintained on the surface of the printing paper can be increased to enhance optical density.

Figure 14:
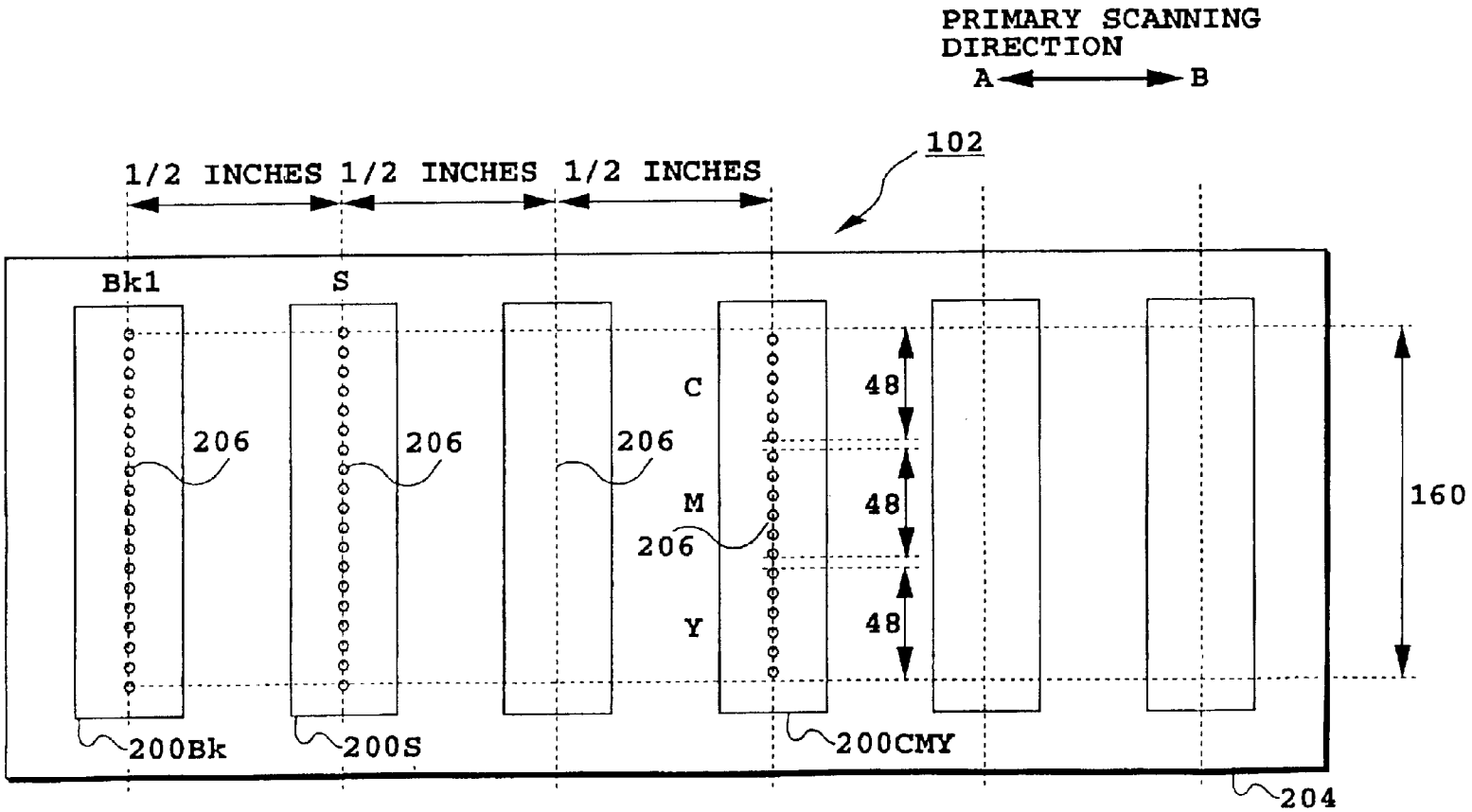
FIG. 14 is a front elevation showing another example of the head unit.

FIG. 14 is a diagrammatic illustration showing another example of the head unit at the ejection opening forming surface, which forms the ink-jet head unit 103 shown in FIG. 8.

The head unit in the shown embodiment is constructed with an ink jet head 200Bk for ejecting the black ink, an ink-jet head 200S ejecting the processing liquid, and an ink-jet head 200CMY, in which respective ejection portions eject the C, M and Y inks. Respective head chips of the ink-jet heads are arranged at a pitch of ½ inches or heads 200Bk, 200S and 200CMY are arranged at distances of ½ inch and 1 inch, respectively, within frame 204. The reason why 1 inch of pitch is provided between the head 200S and the head 200CMY is to enable the use of an ink tank employed in the construction shown in FIG. 13 for black ink and the processing liquid. The ink-jet head 200Bk for ejecting the black ink K is similar to that illustrated in FIG.

13. Ejection characteristics of the ink-jet heads 200S and 200CMY of the processing liquid S and respective color inks C, M and Y, respectively are as follows:

<S>

Number of Ejection Openings: 160 (Number of Divided Blocks: 16 blocks)

Resolution: 360 dpi

Driving Frequency: 8.0 (KHz)

Ejection Amount: Vd=40+4 (pl/droplet)

Ejection Speed: 12+0.5 (m/s)<.

CMY>

Number of Ejection Openings: Corresponding to 160 ejection openings; 48 ejection openings for respective colors (48×3)/Interval of 8 Ejection Openings (8×2) for Sealing Between Each Color (Number of Divided Blocks: 16 Block)

Resolution: 360 dpi

Driving Frequency: 8.0 (KHz)

Ejection Amount: Vd=40+4 (pl/dot)

Ejection Speed: 12+0.5 (m/s)

Opening Period per 1 Block: Tb=7.5 ($\mu$sec).

The head unit shown FIG. 14 is also employed for bidirectional printing. In this case, similarly to the construction shown in FIG. 13, with the third example concerning order of ejection, it is preferred that ejection is performed in the order of black ink K and then the processing liquid S in printing in the direction A, and ejection is performed in the order of cyan C, magenta M and yellow Y and then the processing liquid S in printing in the direction B. This is because the amount of insoluble substance to be deposited on the ejection opening forming surface of the ink-jet head 200S for ejecting the processing liquid S can be made quite small.

On the other hand, conversely to the above, when the processing liquid S is ejected in advance of ejection of respective colors of inks, it is preferred to provide covers on respective ejection opening forming surfaces of respective ink-jet heads 200Bk and 200CMY respectively ejecting the black ink K and inks C, M and Y.

Figures 15A, 15B:
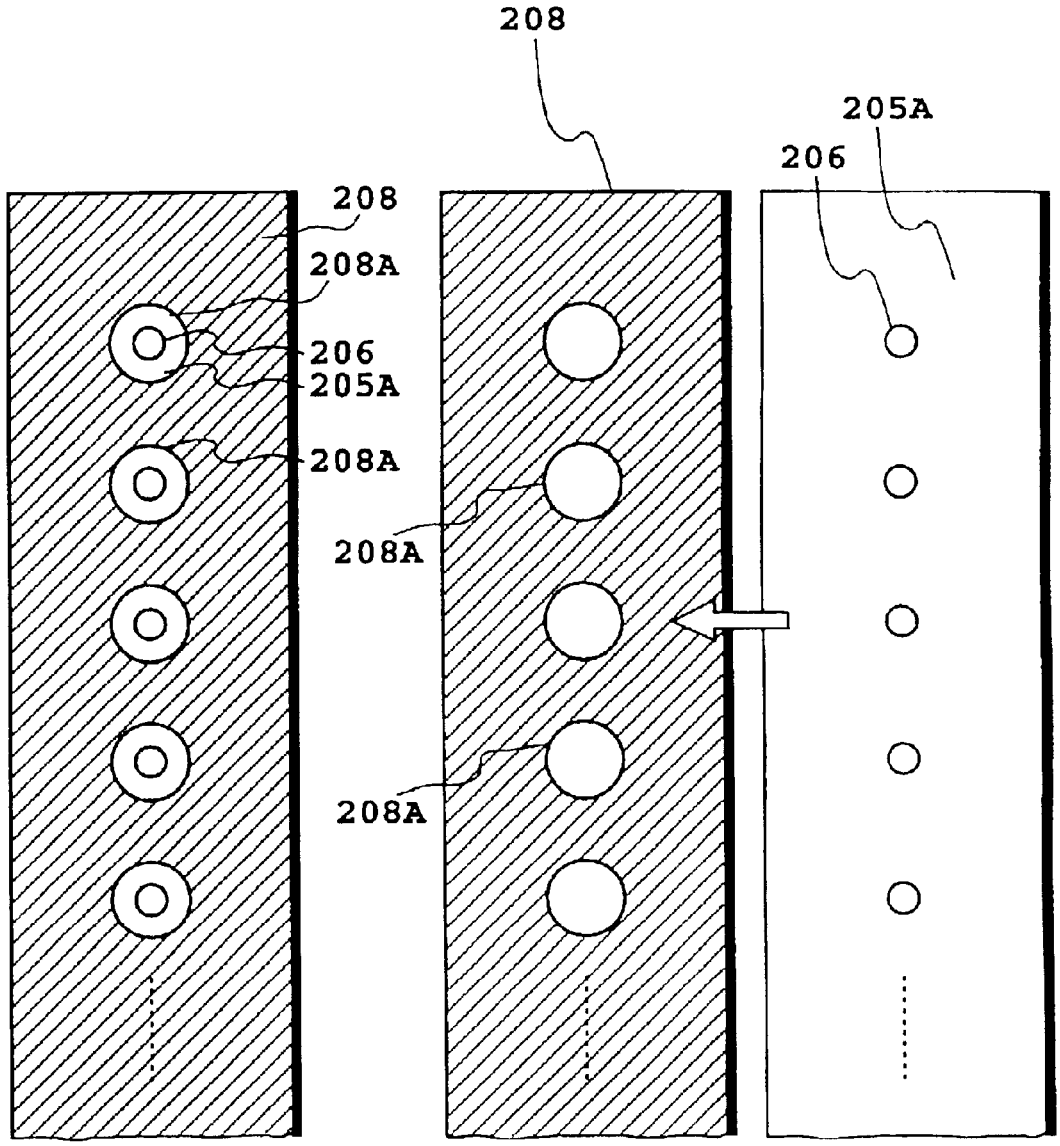
FIGS. 15A and 15B are illustrations showing a cover plate for shielding the rebounding mist and a non-shielding condition, in a first embodiment of the present invention.

FIGS. 15A and 15B are diagrammatic illustrations for explaining the first example of a cover plate as the covering means which can be provided for respective ink-jet heads set out with respect to the shown embodiment, and FIGS. 16A to 16E are illustrations for explaining the wiping operation for the ejection opening forming surfaces of respective ink-jet heads when the cover plates are set.

As shown in FIG. 15A, the cover plate 208 has an ejection hole 208A corresponding to respective ejection openings. By this, the ejection opening forming surface 205A can be covered except for the ejection holes 208A. In the second example of the shown embodiment, a diameter of the ejection hole 208A may be determined depending upon the paper distance as set forth above. Assuming that the paper distance in the shown embodiment of the apparatus is 1 mm for example, the swirl is generated by the rebounding mist to make it possible for the mist to be deposited on the positions quite close to the ejection opening. Therefore, the diameter of the ejection hole 208A is set to be 50 $\mu$m so that deposition of the mist may not occur even when the swirl of the rebounding mist is generated.

Figure 17:
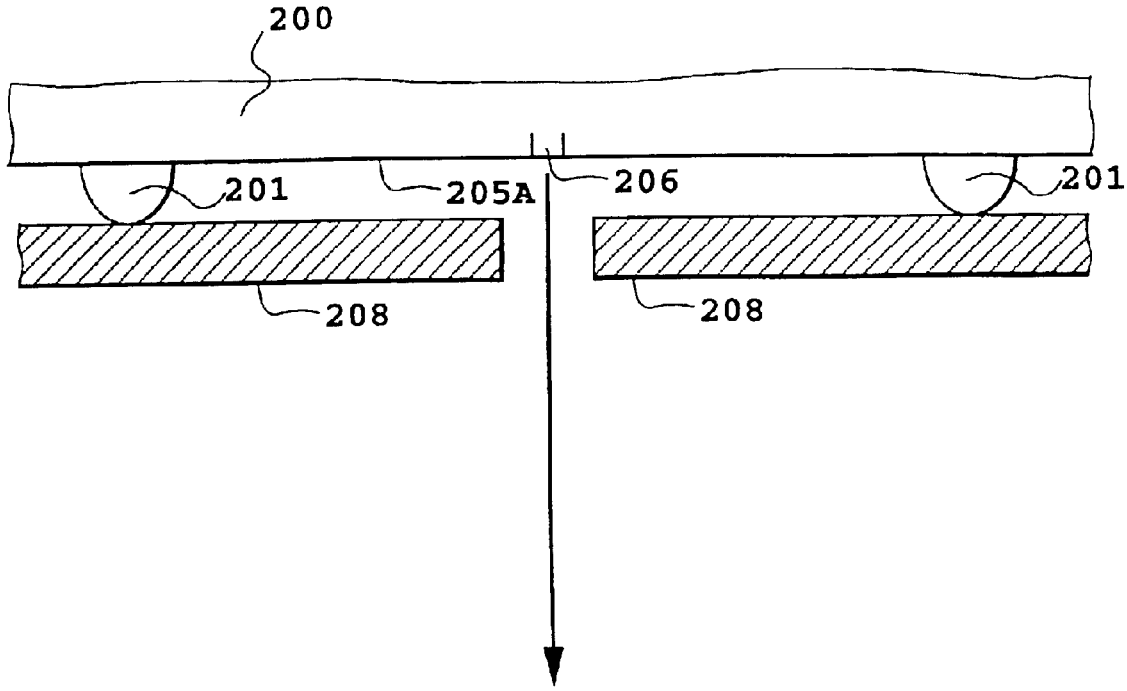
FIG. 17 is an illustration for explaining a mating condition of the cover plate and the ink-jet head.

Installation of the cover plate 208 onto the ink-jet head can be done by providing a spacer 201 on the ejection opening forming surface 205A as shown in FIG. 17 and by slidably providing the cover plate 208 with respect to the ink-jet head 200. In addition, the cover plate 208 can be fixed to the ink-jet head by using a material which can be drawn by a magnetic force to make the cover plate, and by forming a part of the spacer 201 of the ink-jet head as a part of the electromagnet. Upon wiping by the blade and capping, drawing force by the electromagnet is released to permit sliding of the cover plate 208 as shown in FIG. 15B.

Figure 16A:
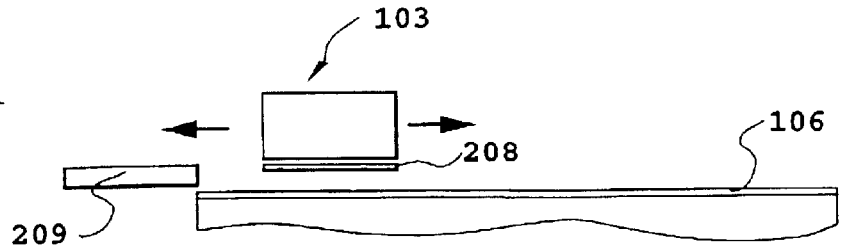
FIGS. 16A to 16E are illustrations for explaining a wiping operation in the case where a cover plate of the first embodiment is provided.

FIGS. 16A to 16E show the wiping operation associated with the sliding described above. FIG. 16A shows a condition where scanning is performed for printing by providing a cover plate 208 on each ejection opening forming surface of the ink-jet head unit 103, using the holding force of the electromagnet.

Figure 16B:
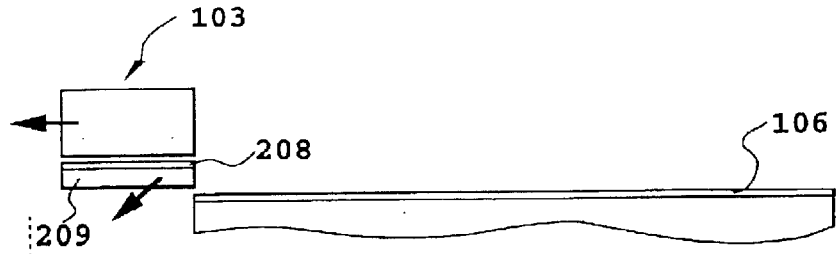
Figure 16C:
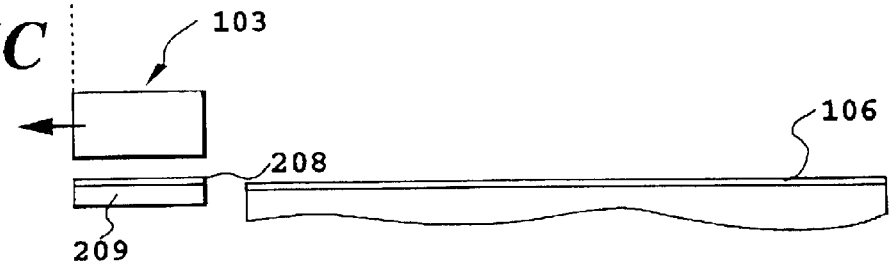
Figure 16D:
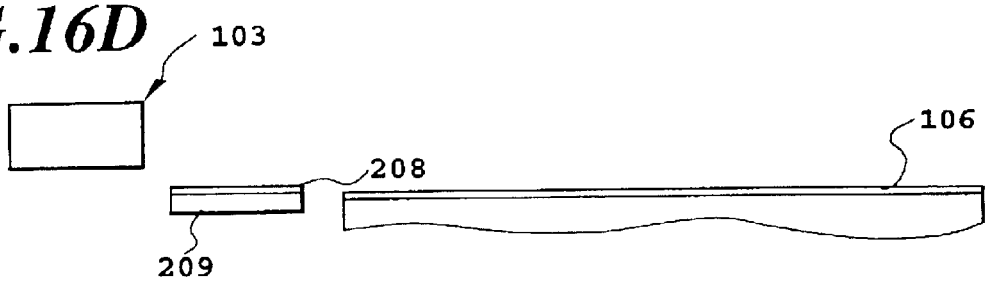
Figure 16E:
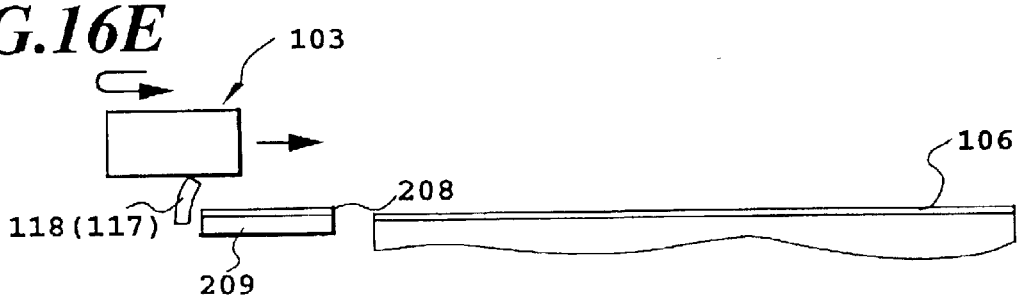

When it is time to perform ejection recovery process by wiping, the ink-jet head unit 103 is moved to the home position and the cover plate 208 is placed opposite to a plate holder 209 located adjacent to the recovery unit 116 (see FIG. 8). Then, by forming the plate holder 209 with the electromagnet, th cover plate 208 can be held by switching the electromagnet (FIG. 16B). At this time, the plate holder 209 is moved to a high position then a stand-by position, and is lowered to the stand-by position after holding the cover plate 208 by a sliding mechanism (not shown). As it lowers, the ink-jet unit reverses direction after reaching an end position (FIG. 16D). Associating with reversal motion, the blade 118 or 117 (see FIG. 11) is lifted up, depending upon the timing of the corresponding ink-jet head, for wiping a respective ejection opening forming surface (FIG. 16E).

Figure 18C:
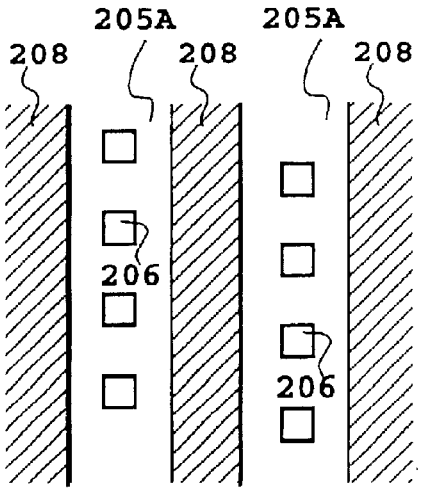
FIGS. 18A to 18D are illustrations showing modifications of the first embodiment.
Figure 18A:
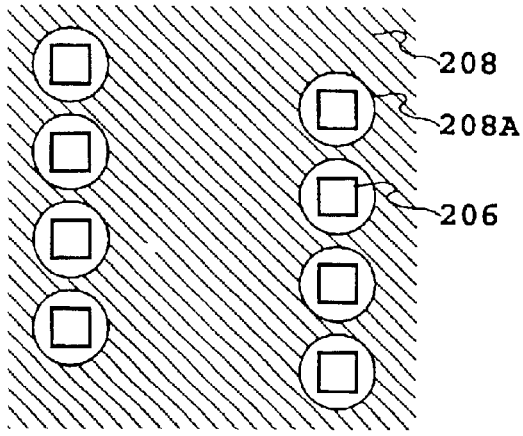
Figure 18D:
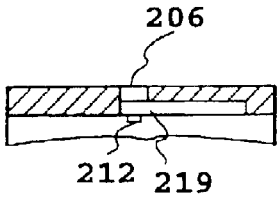
Figure 18B:
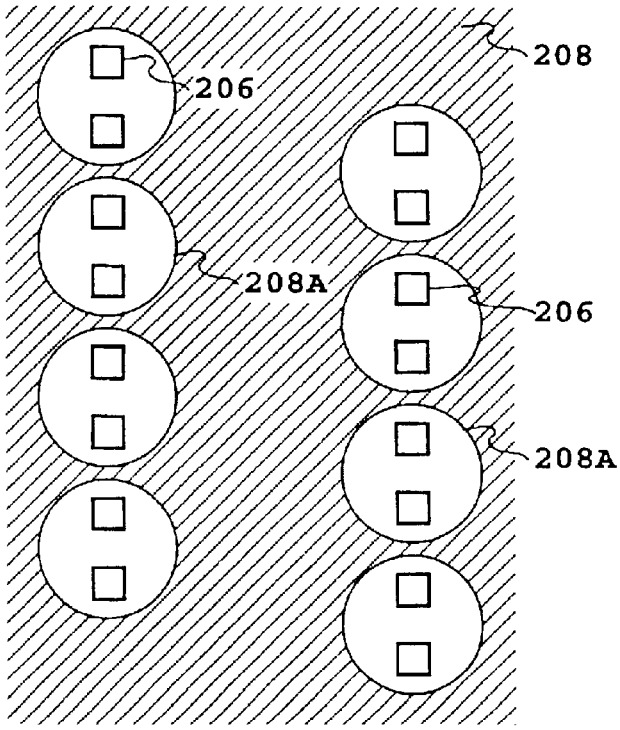

FIGS. 18A to 18C are plan views showing modifications of the first example of the cover plate, and FIG. 18D is a section of the ink-jet head covered by these cover plates.

The ink-jet heads shown in these drawings have two ejection opening arrays for each color of ink or for the processing liquid, and by offsetting arrangement positions of the ejection openings in respective arrays, the ejection opening array achieves twice the resolution with respect to the amount of each color ink or the processing liquid that can be provided. The ejecting system is adapted to eject ink droplets in a direction perpendicular to a plane of the heater 212 constructed with the electrothermal transducer. Further, from the head shown in the drawings, relatively fine ink droplet can be ejected by appropriately setting the distance between the heater 212 and the ejection opening 206.

With respect to the ink-jet head having the ejection opening array set forth above, in the example shown in FIG. 18A, the ejection holes 208A are formed for respective individual ejection openings similarly to the cover plate of FIG. 15. In the example of FIG. 18B, the ejection holes 208A are formed per every two ejection openings. In the example of FIG. 18C, instead of providing the ejection hole, an opening portion is provided corresponding to the entire ejection opening array. The configurations or the sizes of the opening in these examples are also determined in consideration of the deposition region of the rebounding mist determined depending upon the paper distance as shown in second example of the shown embodiment.

It should be noted that, in the shown example, the cover plate 208 is slidably provided with respect to the ink-jet head to enable ejection recovery operation, such as wiping or so forth directly to the ejection opening forming surface of the ink-jet head. However, the cover slate is not necessarily slidable with respect to the ejection opening forming surface, and can be fixed thereon. In this case, capping is performed with respect to the cover plate. However, in such case, a water droplet or so forth other than the rebounding mist deposited on the ejection opening forming surface cannot be removed by wiping. Accordingly, in this case, for example, driving of the electrothermal transducer is appropriately controlled to generate a bubble which does not cause ejection to project the meniscus of the ink or so forth for admixing the water droplet located in the vicinity of the ejection opening to remove the water droplet through the preliminary ejection operation.

In addition, the cover plate may be fixed on the ink-jet head, or can be detachable with respect to the head.

Figure 19:
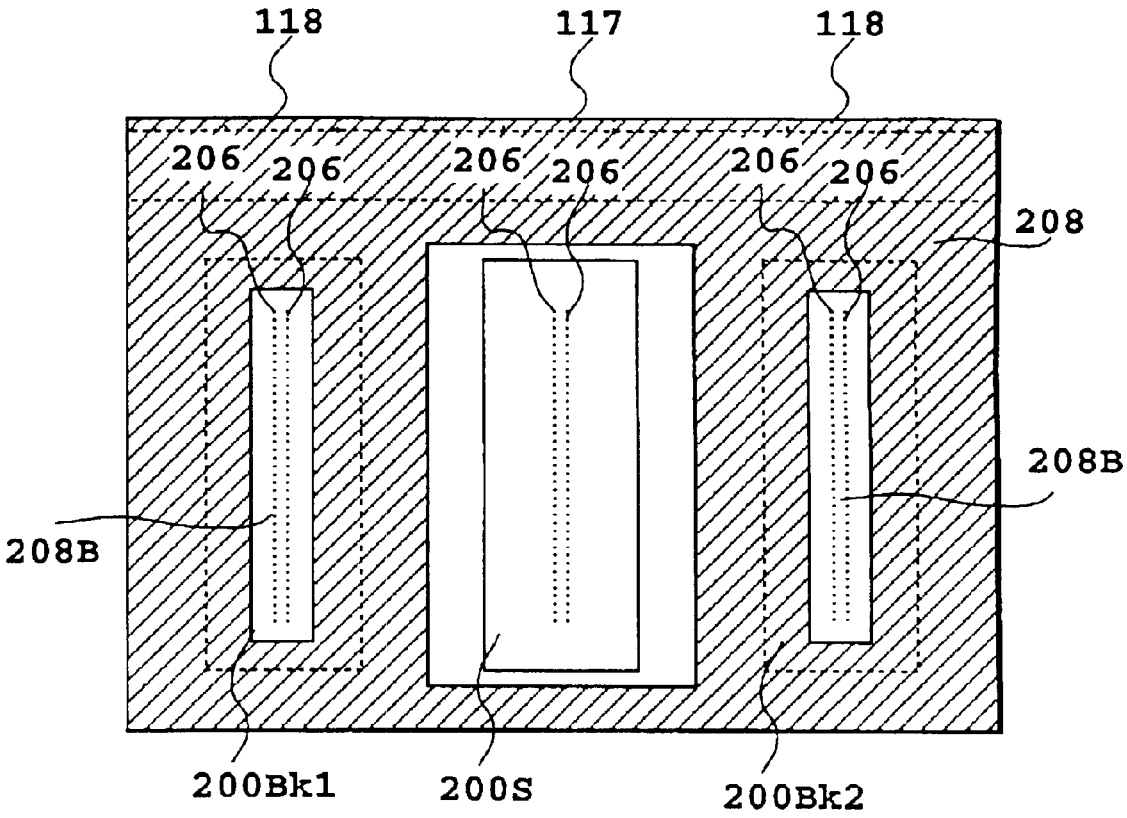
FIG. 19 is an illustration showing another form of the cover plate in the first embodiment of the invention.

FIG. 19 is a diagrammatic illustration showing a second example of the head unit and the cover plate thereof. The cover plate of the shown example is adapted to the head unit in different form than the head unit shown in FIG. 13. Here, the cover plate is slidably provided on the head unit. On the other hand, FIGS. 21A to 21E are illustrations for explaining the wiping operation in the shown example.

The head unit of the shown example is provided with two ejection opening arrays for each ink-jet head. In respective arrays, the arrays are offset by half of a pitch of the ejection openings. By this arrangement, twice the resolution of each ejection opening array can be realized.

As can be clear from FIG. 19, with respect to two ink-jet heads 200Bk1 and 200Bk2, the cover plates 208 are formed integrally for covering the ejection opening forming surfaces of two ink-jet heads except for opening portions 208B. The range to be covered is determined according to the second example of the shown embodiment set forth above. On the other hand, with respect to the ink-jet head 200S, the amount of the insoluble substance contained in the mist to be deposited on the ejection opening forming surface is not as large as set forth above. Therefore, no serious problem will arise even when this surface is not covered with the cover plate.

Figure 21A:
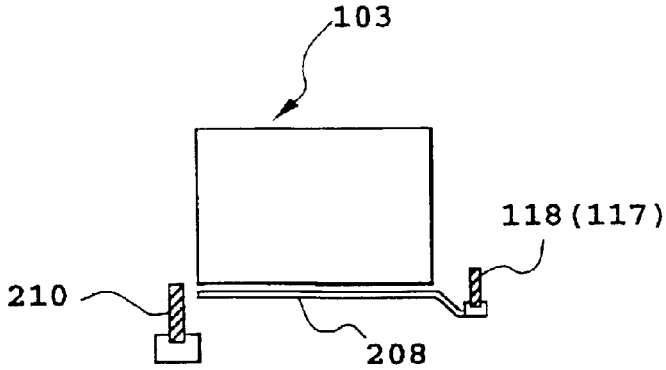
FIGS. 21A to 21E are illustrations for explaining a wiping operation of the ink jet head having another form of the cover plate set forth above.
Figure 21B:
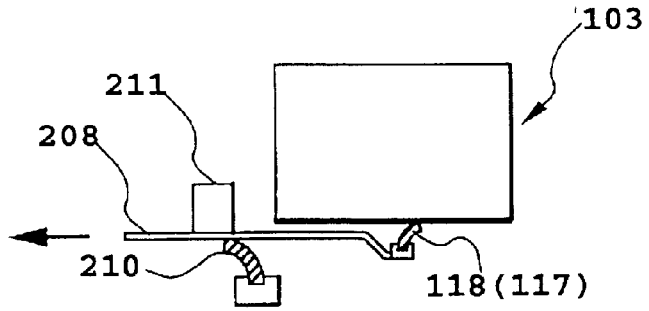

The wiping operation with respect to the construction set forth above (and releasing operation of the cover plate for capping) is differentiated from the case of the foregoing first example. The directions of sliding of the cover plate and of wiping become aligning directions of the ejection openings of respective ink-jet heads. More specifically, as shown in FIG. 21A, when the ink-jet unit 103 is moved at the position opposite to the recovery unit 116 (see FIG. 8), at the condition where the ink-jet unit 103 stops, the cover plate 208 slides in the primary scanning direction and in the vertical direction (FIG. 21B). It should be noted that the sliding is enabled by a plate holding and sliding mechanism (not shown).

Associated with the sliding of the cover plate 208, blades 118 and 117 mounted on this plate perform wiping of the ejection opening forming surface of the ink-jet head respectively corresponding thereto. In conjunction therewith, the surface of the cover plate 208 is also wiped by a blade 210 (FIG. 21B). When the deposited amount of the insoluble substance on the surface of the cover plate 208 is large, to the extent that removal thereof by means of the blade 210 is not easily done, it is preferred that a solvent for dissolving the insoluble substance is impregnated in the blade 210.

Figure 21C:
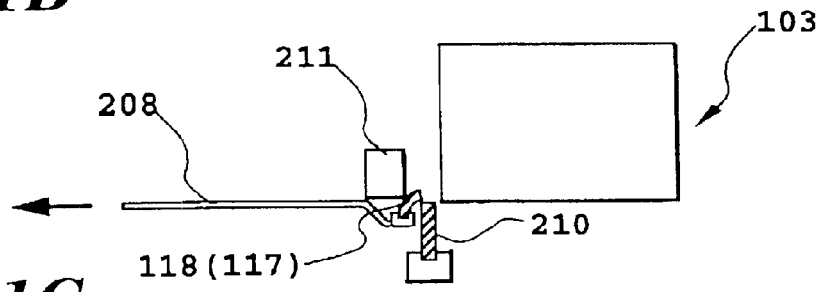
Figure 21D:
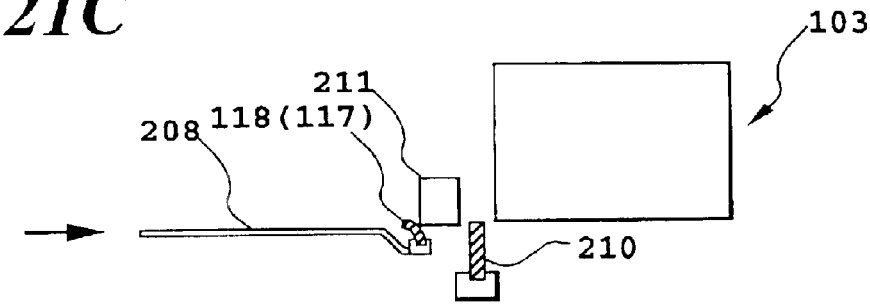
Figure 21E:
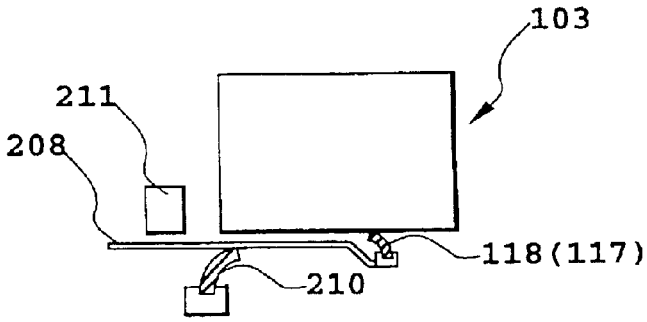

Furthermore, by sliding of the cover plate 208, the blades 118 and 117 mounted on the cover plate 208 are in contact with a wiper cleaner 211 so that water droplets and so forth depositing on the blades 118 and 117 may be removed by relative sliding movement (FIG. 21C). Subsequently, the cover plate slides in the direction opposite to the former sliding direction, in which wiping operation by means of the blades 118, 117 and 210 similar to the foregoing is performed (FIGS. 21D and 21E).

It should be noted that, with respect to the cover plate of the foregoing example, it should not be limited to the shown slidable cover plate but can be a fixed cover plate or so forth.

Figure 20:
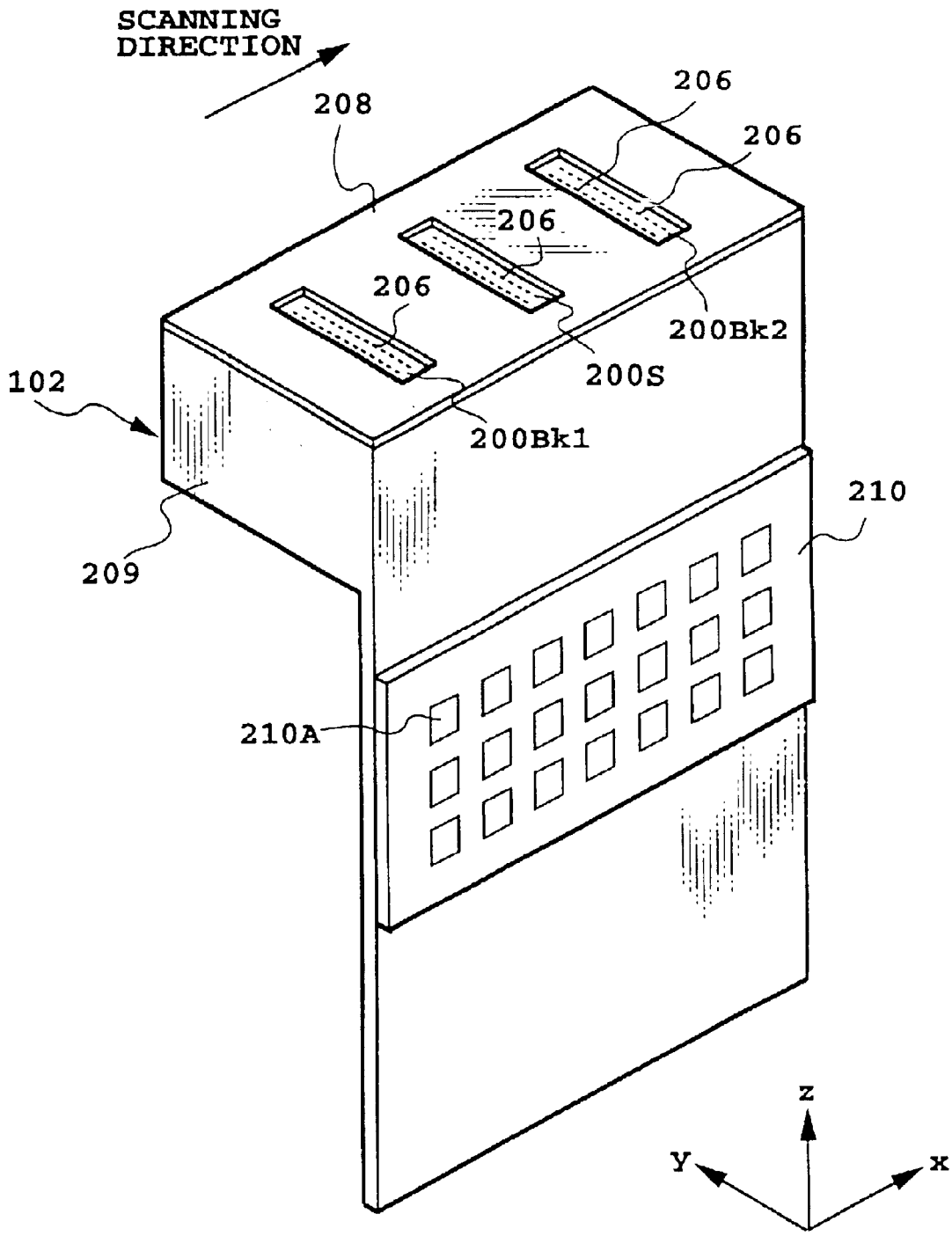
FIG. 20 is a perspective view showing a cover plate and the ink-jet head in a modification of another form of FIG. 19.

FIG. 20 is a perspective view showing modification of the cover plate 208. The head unit 102 of the shown modification is the same as that in FIG. 19, and only the cover plate is differentiated. The cover plate 208 shown in FIG. 20 is adapted to cover the ejection opening forming surface 205 except for the portion around two ejection opening arrays even for the ink-jet head 200S.

In FIG. 20, for respective of ejection openings of respective ink-jet heads 200BK1, 200S and 200BK2, ink passages are provided for communication with the ejection opening. In each of the ink passages, the electrothermal transducer for generating thermal energy is formed. A contact pad 210A provided on a wiring substrate 210 is used for establishing electrical contact between the ink-jet head and the main body of the apparatus.

The cover plate 208 is formed by bonding a stainless (SUS) plate on the ejection opening forming surface by a bonding material. The ink-jet heads of respective colors are fixed by support members 209. Then, similarly to the above, ejection is performed in the order of heads 200BK2, 200S and then 200BK1, namely in the order of the black ink, the processing liquid and then the black ink for printing one pixel.

In the shown modification, a thickness of the cover plate 208 is 0.3 mm, and the opening portion of the cover plate 208 measures 2.5 mm in the x-direction in the drawing by 18 mm in the y-direction. The three opening portions illustrated are of the same dimensions. In addition, the entire cover plate measures 40 mm in the x direction by 20 mm in the y-direction in the drawing. The plate width between respective heads in the x direction is 10.2 mm. Also, an edge of the opening portion is desirably substantially perpendicular to the general surface of the cover plate.

Each ink-jet head is designed for ejecting 8.5 pl in volume ejected liquid droplet at 18 m/s of ejection speed. On the other hand, ejection openings are arranged for achieving a resolution of 300 dpi in one array. Also, the distance from the ejection openings to the printing paper 106, that is, the paper distance, is 1.3 mm. Furthermore, the driving frequency of respective head is 10 kHz, and the printing resolution is 600 dpi.

Figure 22B:
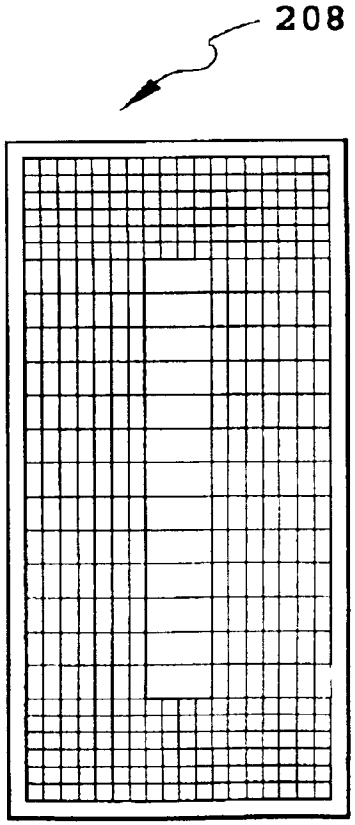
FIGS. 22A and 22B are illustrations showing a further form of the cover plate in the first embodiment of the invention.
Figure 22A:
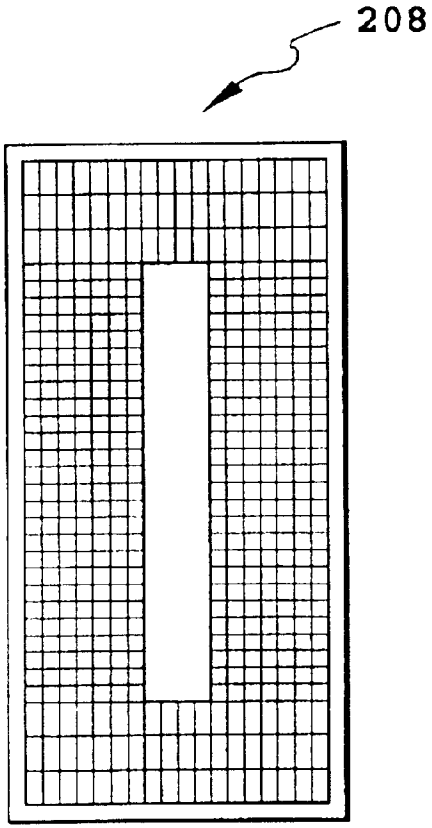

FIGS. 22A to 22B are diagrammatic illustrations showing a third example of the cover plate.

In the shown embodiment, as shown in FIGS. 22A and 22B, the cover plate is constructed by forming a mesh of fiber of a predetermined material. By determining the appropriate density of the mesh, the rebounding mist can certainly be captured. It should be noted that the example shown in FIG. 22B is designed to provide a distribution of the mesh density so that the density of the mesh for the portion corresponding to the ejection opening array is smaller than that of other portions, so as not to interfere with the ejection of ink or so forth and to capture the rebounding mist having greater diameter than possible diameter of the rebounding mist depositing in the vicinity of the ejection openings.

The fourth example of the shown embodiment employs the cover plate as the covering means set forth above for controlling range of deposition of the rebounding mist.

Figure 23:
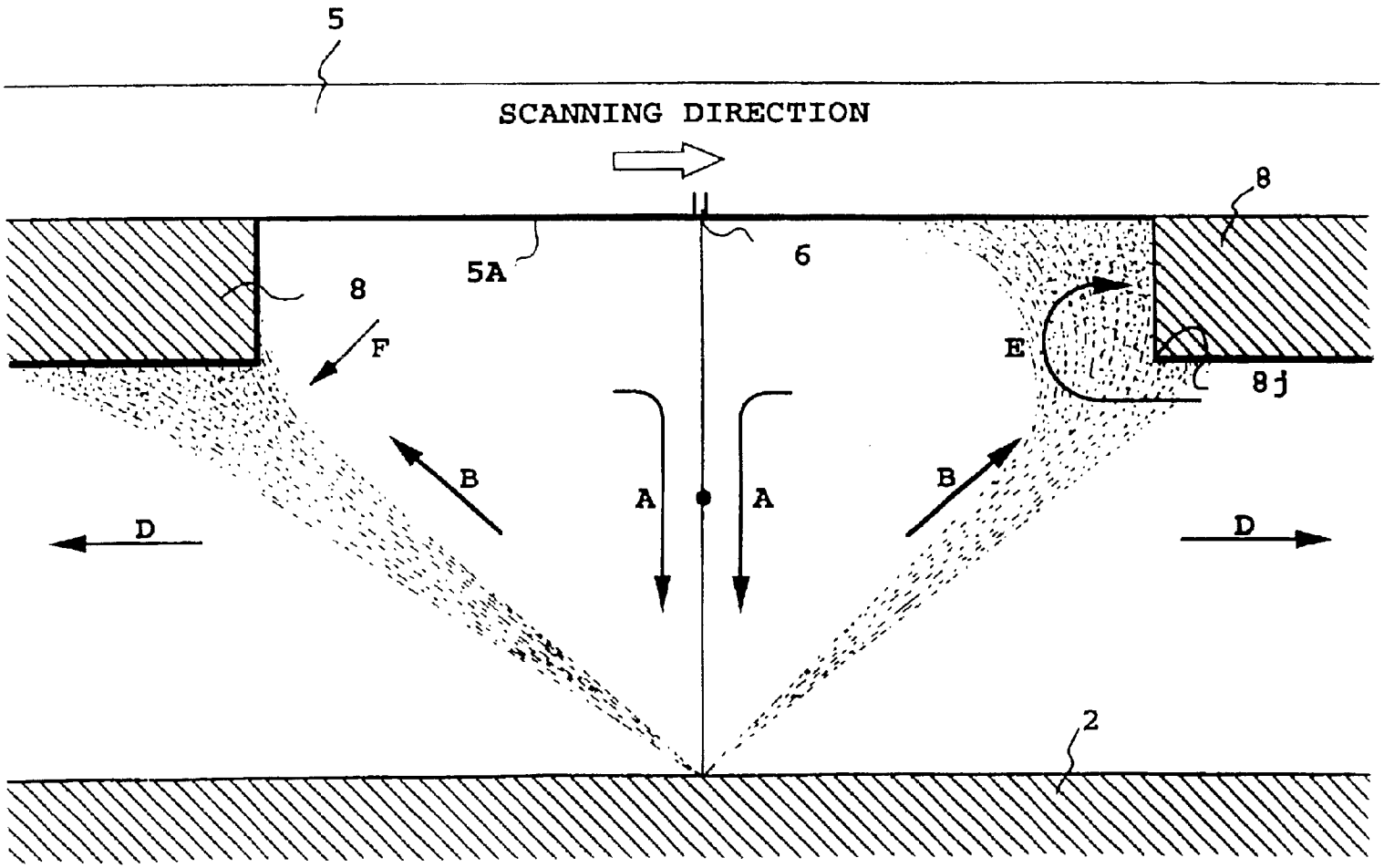
FIG. 23 is an illustration for explaining one example of deposition range control of rebounding mist in a second embodiment of the invention.
Figure 24:
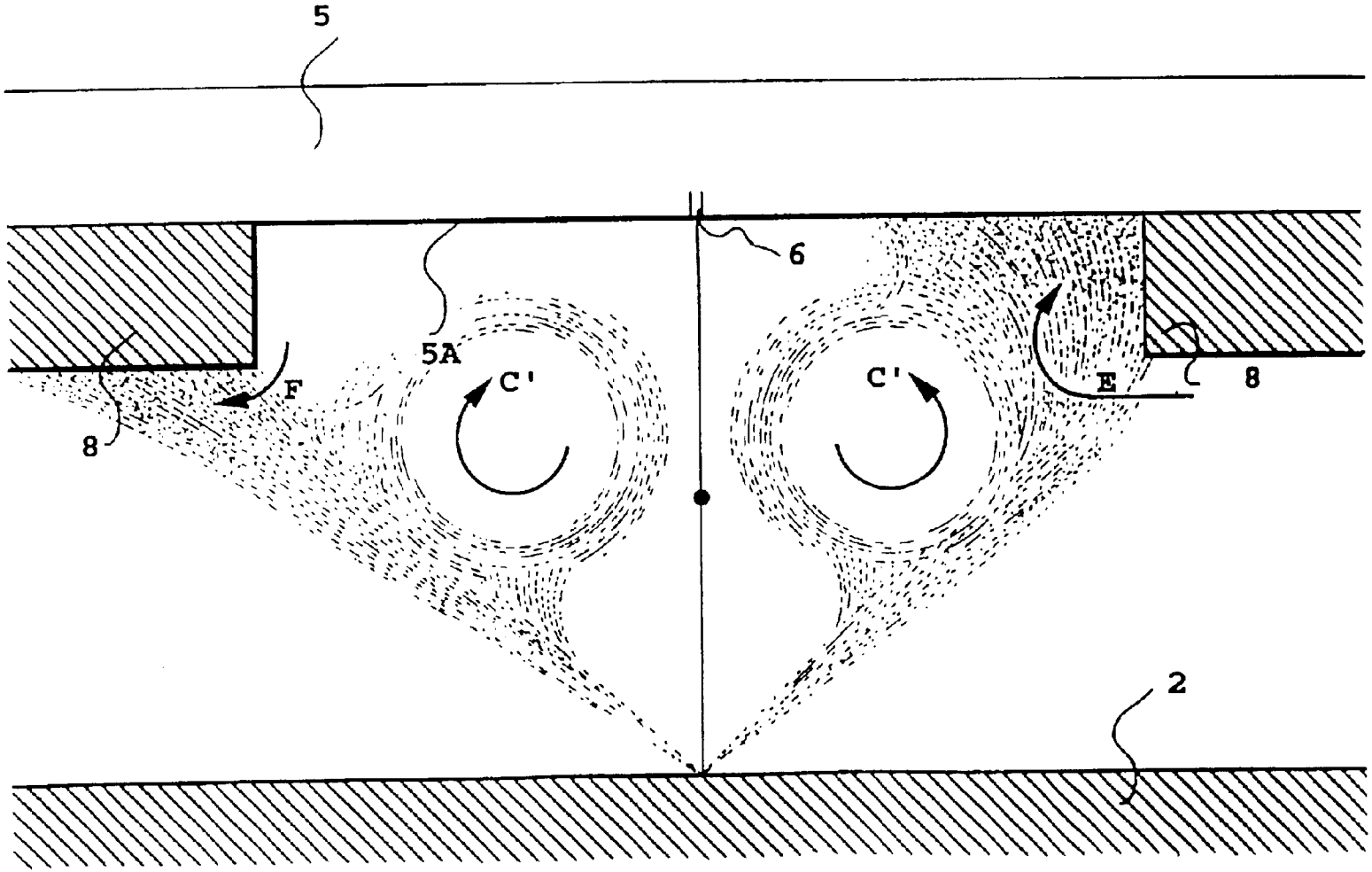
FIG. 24 is an illustration for explaining another example of deposition range control of rebounding mist in the second embodiment of the invention.

Namely, with respect to the foregoing examples, by arranging the cover plate at an appropriate position, the depositing position of the rebounding mist can be controlled. Details will be discussed with respect to FIGS. 23 and 24 illustrating the second embodiment of the present invention, and not discussed herein.

It should be noted that, with respect to the foregoing examples, discussion has been given for the examples, in which the ink-jet head and the ink tank are separated from each other, but application of the present invention should not be limited to the shown construction and can be extended to those in which the ink-jet head and the ink tank are integrated to form a so-called ink-jet cartridge.

Ink usable for carrying out the present invention should not be limited only to dyestuff ink; pigment ink having pigment dispersed therein can also be used. Any type of processing liquid can be used, provided that pigment is aggregated with it. The following pigment ink can be noted as an example of pigment ink adapted to cause aggregation by mixing with the processing liquid A1 previously discussed. As mentioned below, yellow ink Y2, magenta ink M2, cyan ink C2 and black ink K2 each containing pigment and anionic compound can be obtained.

[Black Ink K2]

The following materials are poured in a batch type vertical sand mill (manufactured by Aimex Co.), glass beads each having a diameter of 1 mm are filled as media using anion based high molecular weight material P-1 (aqueous solution containing a solid ingredient of styrene methacrylic acid ethylacrylate of 20% having an acid value of 400 and average molecular weight of 6000, neutralizing agent: potassium hydroxide) as a dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 mm is produced.

(Composition of carbon black dispersing element)

| | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow Ink Y2]

Anionic high molecular P-2 (aqueous solution containing a solid ingredient of 20% of stylenacrlylic acid methyl methaacrylate having an acid value of 280 and an average molecular weight of 11,000, neutralizing agent: diethanolamine) is used as a dispersing agent and dispersive treatment is conducted in the same manner as production of the black ink K2 whereby yellow color dispersing element having a weight-average grain size of 103 nm is produced.

Composition of Yellow Dispersing Element

| | |
|---|---|
| P-2 aqueous solution (having a solid ingredient of 20%) | 35 parts |
| C.I. pigment yellow 180 (tradename: Nobapalm yellow PH-G, manufactured by Hoechst Aktiengesellschaft Co.) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan Ink C2]

A cyan colored-dispersant element having a weight-average grain size of 120 nm is produced using anionic high molecular P-1 as the dispersing agent, and moreover, using the following materials by conducting dispersing treatment in the same manner as the carbon black dispersing element.

Composition of Cyan Colored-Dispersing Element

| | |
|---|---|
| P-1 aqueous solution (having solid ingredients of 20%) | 30 parts |
| C.I. pigment blue 153 (tradename: Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta Ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

Composition of the Magenta Colored Dispersing Element

| | |
|---|---|
| P-1 aqueous solution (having a solid ingredient of 20%) | 20 parts |
| C.I. pigment red 122 (manufactured by Dainippon Ink And Chemicals, Inc.) | 24 parts |
| glycerin | 15 parts |
| isopropyl alcohol | 3 parts |
| water | 135 carts |

Magenta ink M2 for ink jet printing and having pigment contained therein is obtained by sufficiently dispersing the magenta colored dispersing element in water. The final product of ink has a solid ingredient of about 9.2%.

As can be clear from discussion given herein, according to the first embodiment of the present invention, while the mist is generated by rebounding on the printing medium when the ink and the processing liquid are ejected in overlaying manner, at least deposition of the mist on the ejection opening forming surface of the ink ejecting portion can be prevented by the covering means.

As a result, it becomes possible to prevent plugging of the ink ejection opening or causing of ejection failure by deposition of the insoluble substance contained in the rebounding mist on the ejection opening forming surface.

Second Embodiment

The second embodiment of the present invention has been worked out in a different viewpoint with respect to the cover plate shown in the first embodiment. More specifically, the second embodiment of the present invention has been made in consideration of air flow generated around the cover plate when the cover plate is provided. The shown embodiment is designed for controlling a deposition range of the mist of the ink or so forth by means of the air flow.

In the shown embodiment, attention is particularly paid to the rebounding mist when the ink or the processing liquid is ejected during scanning of the ink-jet head (ejecting means).

As shown in FIGS. 1A to 1C, the ink droplet or the processing liquid droplet hitting on the printing medium generates substantially cone-shaped rebounding mist in a given angle. The mist flows back to the ink-jet head at substantially the given angle.

When the processing liquid and the ink are ejected from their respective ink-jet heads with a certain time difference, the latter ejected droplet of processing liquid or ink hits the ink or processing liquid that was ejected first, and has already hit the printing surface. In such case, the substantially cone-shaped rebounding mist is generated. In this case, the mist is generated by collision of the ink with the processing liquid having mutually different properties, and a mixture of the processing liquid and the ink may be contained in the mist.

As set forth above, it has been found that the content of the rebounding mist can be significantly different depending upon the order in which the processing liquid and the ink are ejected. When the processing liquid is ejected before the ink, a relatively large amount of coagulate or insoluble substance resulting from reaction of the processing liquid with the ink is contained in the mist. On the other hand, when the ink is ejected first and the processing liquid hits the ink droplet on the printing medium, only a small amount of coagulate is contained in the mist. One example of the shown embodiment is designed for controlling the deposition range of the mist in consideration of the order of ejection of the ink and the processing liquid.

Also, as discussed with respect to FIGS. 2 to 4, the form of the rebounding mist may be varied primarily depending upon distance between the ink-jet head and the printing medium.

Namely, when the paper distance is greater than or equal to a given distance, the substantially the cone shaped mist is formed.

When the paper distance becomes shorter, while the cone-shaped rebounding mist may be generated at an initial stage of continuous ejection, if ejection is continuous, the air flow is generated by flying of the ink droplets ejected continuously, and then due to this air flow, the rebounding mist is gradually subjected to a force directed toward the center portion, finally forming a swirl.

Even if any form of the rebounding mist is generated, there is a possibility that the mist would be deposited on the ejection opening portion or in the vicinity thereof on the ejection opening forming surface of the ink-jet head. Particularly, when mist containing a large amount of insoluble substance is deposited on the ejection opening portion or in the vicinity thereof, serious ejection failure can be caused as set forth above.

For this, in one example of the shown embodiment, in any case where a cone-shaped mist is generated or a swirl mist is generated, the possibility of deposition of the mist on the ejection opening or so forth can be reduced by appropriately controlling the deposition range of the mist.

FIGS. 23 and 24 are illustrations for explaining such control of the deposition range.

In a first example of the shown embodiment, in order to prevent deposition of the mist onto the ejection opening forming surface of the ink-jet head, the cover plate is positively used for controlling the deposition range.

As set forth above, the condition of the rebounding mist is either cone-shaped (FIG. 23) or swirl-shaped depending upon the paper distance (FIG. 24). In either case, air flow relative to the ink-jet head is generated by the scanning motion of the ink-jet head 5. This air flow causes turning flow E by presence of the cover plate 8 located on the upstream side of the air flow. More specifically, the air flowing along the surface of the cover plate 8 causes separation of the flow at the corner 9*j* of the upstream side cover plate 8 to cause the flow E to turn into the backside of the cover plate 8. Because of this, the rebounding mist is guided to flow into the backside of the cover plate distanced away from the ejection opening 6.

On the other hand, at the cover plate 8 located at the downstream side, an air flow D a certain distance from the cover plate 8 is present. In relation to this air flow D having relatively high flow velocity, the air flow around the downstream side cover plate 8 has relatively large pressure so as to form a flow as illustrated by F. By this, the rebounding mist is guided to flow into the surface of the downstream side cover plate 8 distanced away from the ejection opening 6.

Thus, in the first example of the shown embodiment, by appropriately arranging the cover plate 8, the deposited position of the rebounding mist can be controlled.

In another example of the shown embodiment, in order to control deposition range of the rebounding mist by means of the air flow shown in FIGS. 23 and 24, projecting portions provided at the boundary of the ejection opening forming surfaces or respective colors of ink ejecting portions may be utilized in place of the cover plate as set forth above. More specifically, by appropriately determining the configuration or so forth of such projection portions, deposition range of the rebounding mist can be controlled to the desired range.

Here, a desired configuration of the general projecting portion including the cover plate set forth above, is to cause a flow turning into the back side of the projecting portion as the projecting portion located upstream side of the air flow. As the configuration causes the air to turn around, a configuration which initially caused flow along the profile of the projecting portion and then cause separation therefrom, may be considered. On the other hand, for the projecting portion located on the downstream side of the air flow, a configuration which may; not disturb a flow caused at a position distanced therefrom is desired.

In a further example of the shown embodiment, control of the mist deposition range is positively utilized.

More specifically, the mist formed as set forth above is floating between the ink-jet head and the printing medium. Namely, a motion energy applied to the mist upon ejection from the head, particularly from the energy applied when a droplet less than or equal to 25 pl is ejected with kinetic momentum less than or equal to 400 pl-m/sec, is consumed by air resistance or so forth after rebounding on the printing medium, and finally becomes quite small in a cone shape or swirl form. As a result, since the liquid droplet of the ejected ink or the processing liquid is relatively small, the mist begins to float. The mist in the floating condition can be easily moved utilizing the air flow, for example. In the shown example, utilizing this fact, the position of deposition is varied depending upon the primary component of the mist.

As set forth above, in the case where the ink and the processing liquid that makes the ink insoluble are employed, or in the case that the same color or different colors of inks mutually reacted to become insoluble are employed, it is not desirable to deposit the insoluble substance on the ejection opening or in the vicinity thereof. Therefore, by appropriately determining the air flow and/or the position of the projecting portion, such as the cover plate or so forth, the deposit position of the mist can be set away from the ejection opening.

In contrast to this, in the case that the inks do not react with each other, and no insoluble substance is created, by concentrating the deposited range of the mist to the ejection opening forming surface, deposition of the mist to other portions can be prevented. Then, the mist deposited on the ejection opening forming surface may be wiped away.

The second embodiment of the present invention will be discussed hereinafter more concretely. The ink-jet printing apparatus, the processing liquid and so forth to be employed in the shown embodiment are similar to those employed in the first embodiment. Therefore, they will not be discussed again, to avoid redundant discussion and to keep the disclosure simple enough to facilitate clear understanding of the invention.

Figure 25:
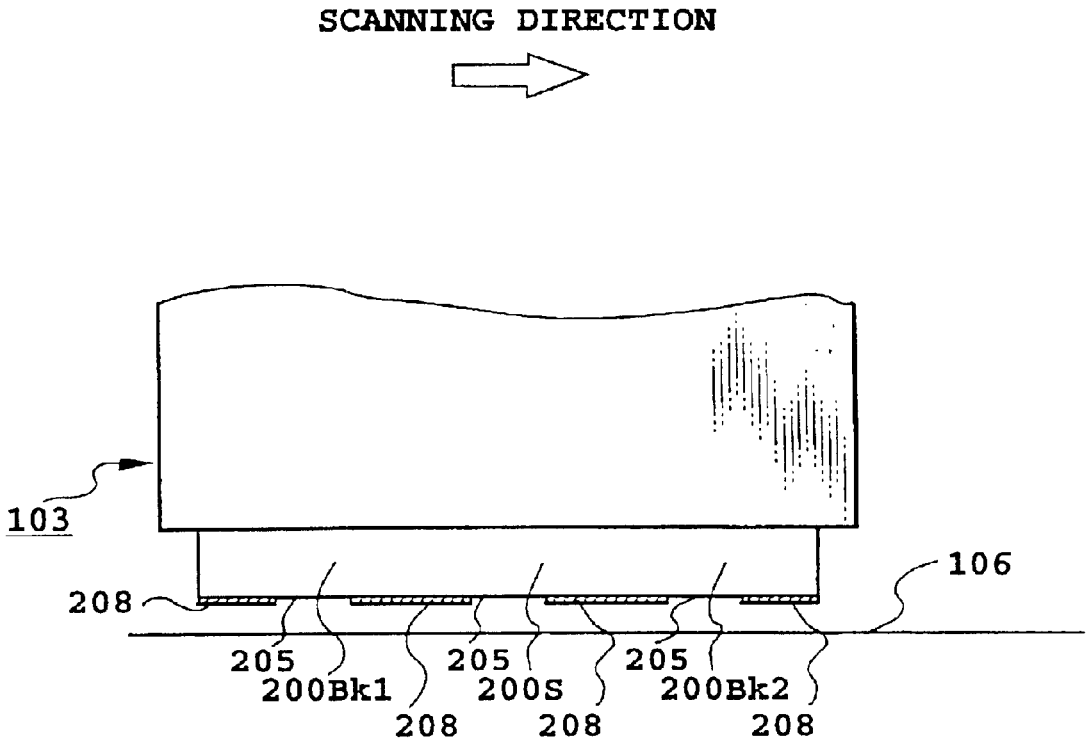
FIG. 25 is a top plan view showing a condition of the head unit during printing operation in the second embodiment.

The shown embodiment of the head unit is similar to that illustrated in FIG. 20. FIG. 25 is an illustration showing a condition where the head unit 102 performs the printing operation. It should be noted that the head units 102 for Y, M and C inks are omitted from the illustrations.

In the shown embodiment, in respective ink-jet heads, ejection openings 206 are arranged in two arrays. Arrangements of ejection openings in respective arrays are offset by ½ of the pitch of the ejection openings relative to each other. Because of this, it becomes possible to perform printing at twice the resolution realized by one ejection opening array.

The cover plate 208 covers the ejection opening forming surface 205 except for the portion around two ejection opening arrays. By this, as discussed with respect to FIGS. 23 and 24, the deposition range of the mist can be controlled by the air flow generated by motion of the carriage. It should be noted that, in the shown embodiment and the example discussed with respect to FIGS. 23 and 24, discussion has been given for the case where printing operation is performed in only one direction. The deposition range can be controlled even in the case of bidirectional printing as a matter of course.

In FIGS. 20 and 25, for respective ejection openings of respective ink-jet heads 200BK1, 200S, 200BK2, ink passages are provided in communication therewith. In each of the ink passages, the electrothermal transducer for generating thermal energy is formed. A contact pad 210A provided on a wiring substrate 210 is used for establishing electrical contact between the ink-jet head and the main body of the apparatus.

The cover plate 208 is formed by bonding a stainless (SUS) plate on the ejection opening forming surface. The ink-jet heads of respective colors are fixed by support members 209. Then, similarly to the above, ejection is performed in the order of heads 200BK2, 200S and then 200BK1, namely in the order of the black ink, the treatment liquid and then the black ink for printing one pixel.

In the shown embodiment, the thickness of the cover plate 208 is 0.3 mm, and the length of the opening portion of the cover plate 208 in the x-direction in the drawing is 2.5 mm and in the y-direction is 18 mm. The three opening portions illustrated are of the same dimension. On the other hand, the entire cover plate has sizes of 40 mm in the x direction, and 20 mm in the y-direction in the drawing. The plate width between respective heads in the x direction is 10.2 mm. Also, the edge of the opening portion is desirably substantially perpendicular to the general surface of the cover plate.

Each ink-jet head is designed to eject 8.5 pl in volume per liquid droplet at 18 m/s of ejection speed. On the other hand, ejection openings are arranged for achieving a resolution of 300 dpi in one array. Also, the distance from the ejection openings to the printing paper 106 is 1.3 mm. Furthermore, the driving frequency of the respective heads is 10 kHz, and the printing resolution is 1200 dpi.

Figure 26:
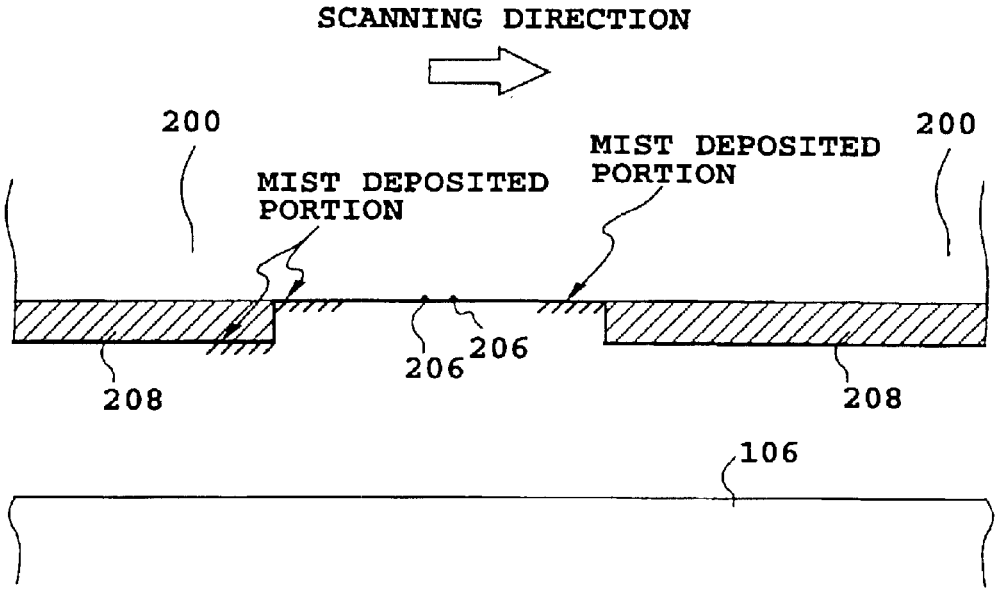
FIG. 26 is an illustration for explaining a result of control of the mist depositing range in a first example of the second embodiment.

In FIG. 25, the carriage travels in the direction shown by the arrow at a speed of 211.7 m/s. By this, between the carriage and the paper, relative air flow is generated in the direction opposite to that in which the carriage travels. In such construction, when printing is performed at 600 dpi× 1200 dpi, the rebounding mist from the paper surface is deposited on the ejection opening forming surface of each head as shown in FIG. 26 to reduce the amount of mist deposited in the vicinity of the ejection opening.

In addition, when the ink-jet head is removed from the main body of the printing apparatus and placed at a flat surface portion, such as on a desk or so forth, in the case of the prior art, the ejection opening portion may directly contact with the flat surface portion, become damaged and cause ejection failure. However, in the shown embodiment, since the cover plate is provided, direct contact of the ejection opening portion with the flat surface portion can be successfully prevented.

It should be noted that, while the SUS plate is employed as the cover plate in the shown embodiment, the present invention is not limited to this construction, but metal, such as aluminum, or resin material, such as Noryl (Trademark of General Electric), PP, polyethylene or so forth may be employed.

Furthermore, it is also possible to form the cover plate and the ink-jet head integrally instead of forming them separately. Also in this case, effects similar to the case where the cover plate and the ink-jet head are formed separately can be obtained.

Furthermore, while three ink-jet heads are supported on a single support member in the shown embodiment, it is possible to support one ink-jet head by one support member as long as the condition of the cover plate or so forth falls within the following range to attain the similar effect.

Namely, the required condition is 5 pl to 25 pl of ink ejection amount, 8 m/s to 25 m/s of ejection speed, 0.5 mm to 20 mm of distance between the head and the paper, 0.1 to 1.0 mm in thickness of the plate, 1.0 to 6.0 mm in the length of x-direction of the opening portion of the plate, greater than or equal to 1.0 mm in the width of the plate in x-direction, higher than or equal to 50 mm/s in the carriage speed and more preferably higher than or equal to 100 mm/s. Then, under the conditions set forth above, preferred kinetic momentum upon ejection from the head is less than or equal to 400 pl·Em/sec with respect to droplets less than or equal to 25 pl.

Figure 27:
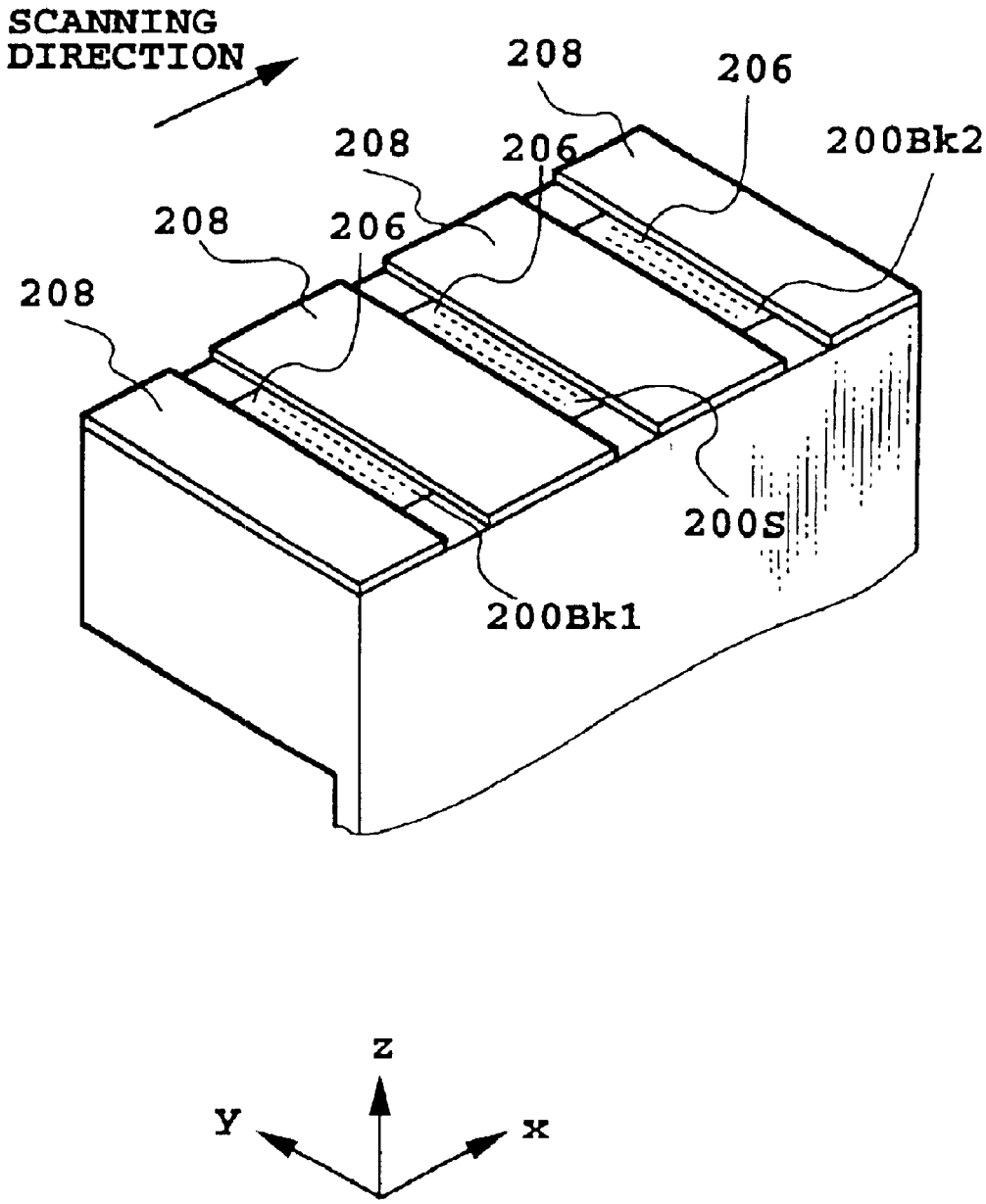
FIG. 27 is a perspective view showing the head unit in the second example of the second embodiment.

FIG. 27 shows an example, in which only the plate is differentiated from the construction shown in FIG. 25 or so forth. More specifically, as shown in FIG. 27, parts of the cover plate at both end portions in the direction of arrangement of the ejection openings in each head are removed.

In the ink-jet head, due to rebounding mist and other reasons, the ink droplet or so forth is deposited on the ejection opening forming surface during printing. Such deposited substance is removed by wiping. The shown embodiment provides good passing ability of a blade and improved wiping ability.

In the shown embodiment of the head, the ejection openings, each having an ejection volume of 17 pl and an ejection speed of 15 m/s, are arranged in two ejection opening arrays, each of which has a resolution of 300 dpi. The distance from the ejection opening to the printing paper is 1.6 mm. The driving frequency of each head is 10 kHz, and the printing resolution is 600 dpi.

Even in the shown embodiment, the amount of mist deposited in the vicinity of the ejection opening can be reduced as shown in FIG. 26.

Figure 28:
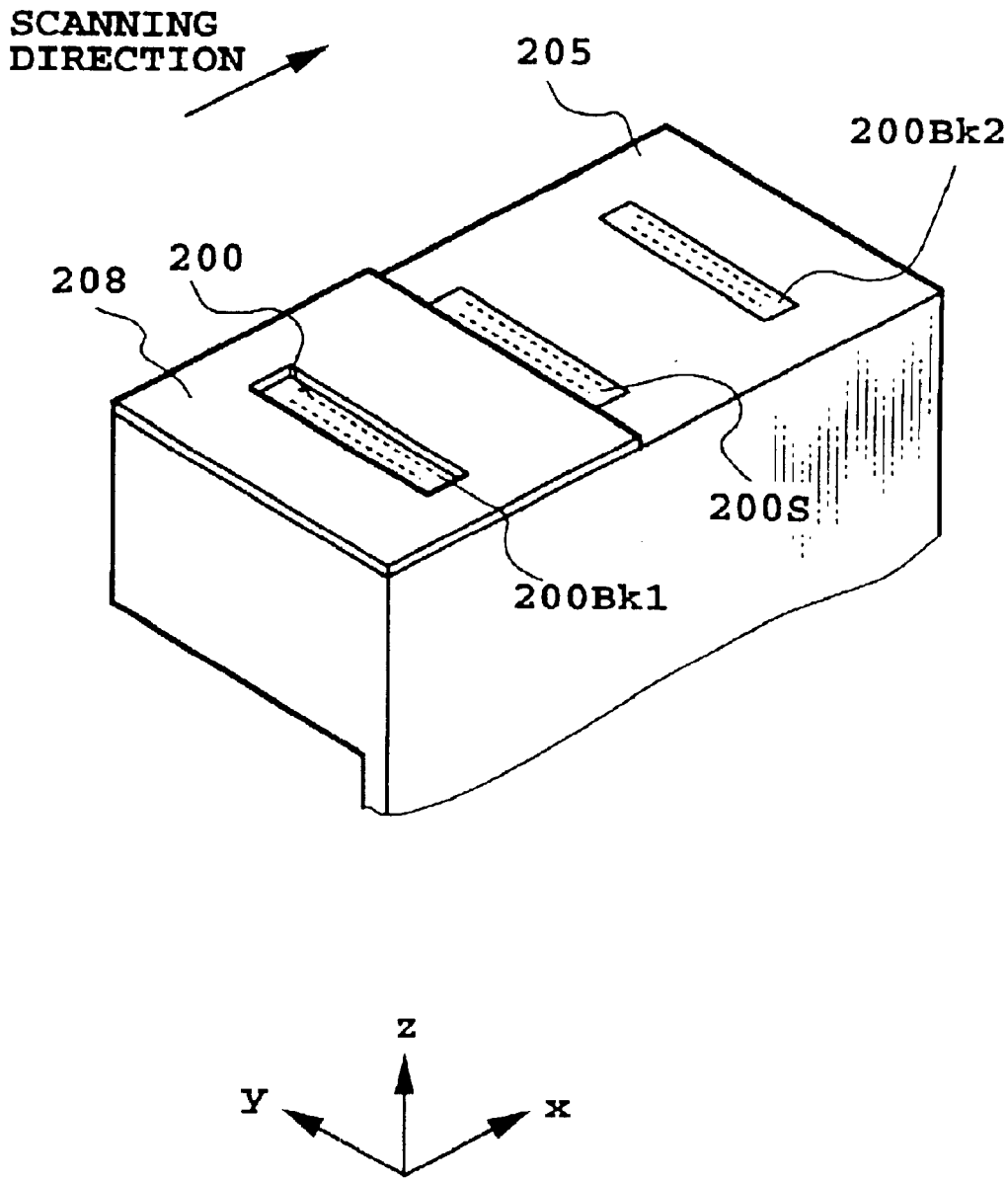
FIG. 28 is a perspective view showing the head unit in the third example of the second embodiment.
Figure 29:
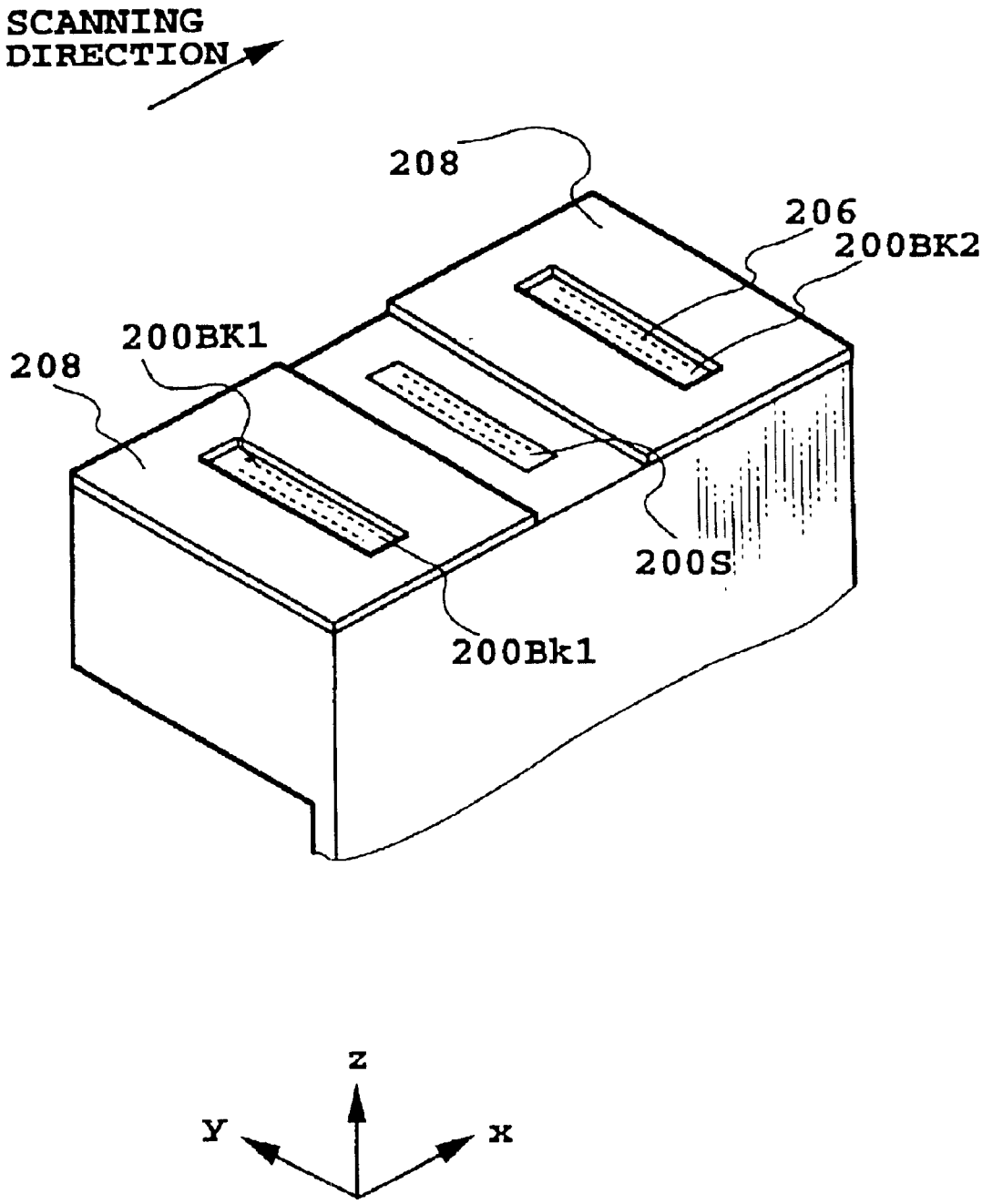
FIG. 29 is a perspective view showing the head unit in a modification of a third example of the second embodiment.

FIG. 28 is an illustration showing a further example of the cover plate P.

As shown, the cover plate 208 is provided only around the ejection opening array of the head BK1. The thickness of the cover plate is 0.25 mm, the length of the opening portion of the cover plate is 4.0 mm in the x-direction, and 20 mm in the y-direction. The overall plate is 18.5 mm in the x-direction and 20 mm in the y-direction.

The ejection volume in each ink-jet head is 4 pl, and the ejection speed is 22 m/s. The ejection openings are arranged in two arrays at a resolution of 300 dpi in each array. On the other hand, the distance between the ejection opening and the paper is 1.0 mm. The driving frequency of each head is 15 kHz, and the printing resolution is 1200 dpi. Namely, the carriage speed becomes 317.5 mm/s. In the apparatus of the shown embodiment, unidirectional printing is performed by performing ejection in the order of head BK2, then 200S and thereafter 200BK1.

In unidirectional printing, to each pixel, at first, the black ink is ejected from the ink-jet head 200BK2. At this time, the content in the rebounding mist is only black ink. Accordingly, in this case, even when the cover plate is not provided around the ejection opening of the head 200BK2, the mist or so forth deposited can be relatively easily removed by wiping. There is no possibility of serious ejection failure due to the presence of insoluble substances or so forth.

Next, the processing liquid is ejected from the ink-jet head 200S. In this case, as set forth above, black ink is ejected first, and then the processing liquid, generating the rebounding mist. Therefore, the amount of the insoluble substance contained in the mist to be deposited is small. Furthermore, the insoluble substance is included in the processing liquid. Accordingly, even in this case, the possibility of causing serious ejection failure is low.

Finally, when ejection of black ink is performed by the ink-jet head 200BK1, the ink is ejected on the processing liquid ejected immediately therebefore. In this case, rebounding mist containing a large amount of insoluble substance is generated. Therefore, the cover plate 208 is provided and the mist deposition range is controlled.

It should be noted that while the foregoing example shown in FIG. 28 is directed to unidirectional printing, in the case of the bidirectional printing, cover plates are provided around the ejection openings of respective ones of the ink-jet heads 200BK1 and 200BK2.

Figure 30:
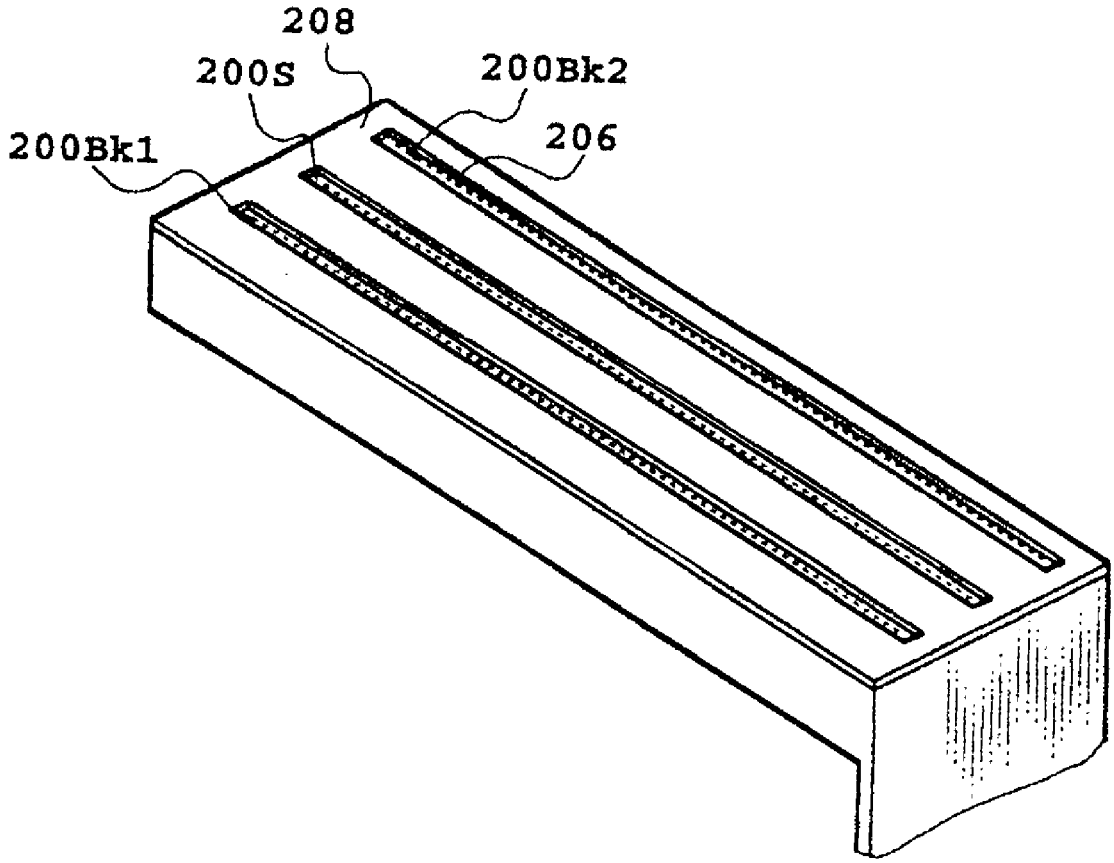
FIG. 30 is a perspective view showing the head unit in a fourth example of the second embodiment.

FIG. 30 is a perspective view showing another example of the shown embodiment of the ink-jet head.

In the ink-jet head of the shown example, the ejection openings are arranged in a width of 220 mm substantially corresponding to the length of the shorter edge of A4 size paper. The shown ink-jet head is a so-called full line type and is fixed on the main body of the apparatus. With respect to the ink-jet head in fixed condition, the printing paper is fed relative thereto.

In the shown embodiment, the thickness of the cover plate is 0.4 mm, and the length of the opening portion of the, cover plate is 6.0 mm in the x-direction and 240 mm in the y-direction. Also, the size of the entire plate is 14 mm in the x-direction and 260 mm in the y-direction.

On the other hand, the ejection volume of the ink-jet head is 17 pl, the ejection speed is 24 m/s. The ejection openings are arranged in a resolution of 600 dpi. The distance between the ejection openings and the paper is 1.2 mm. Also, the driving frequency is 1 kHz and the printing density is 600 dpi. Namely, the feeding speed of the paper is 42.3 mm/s.

Figure 31:
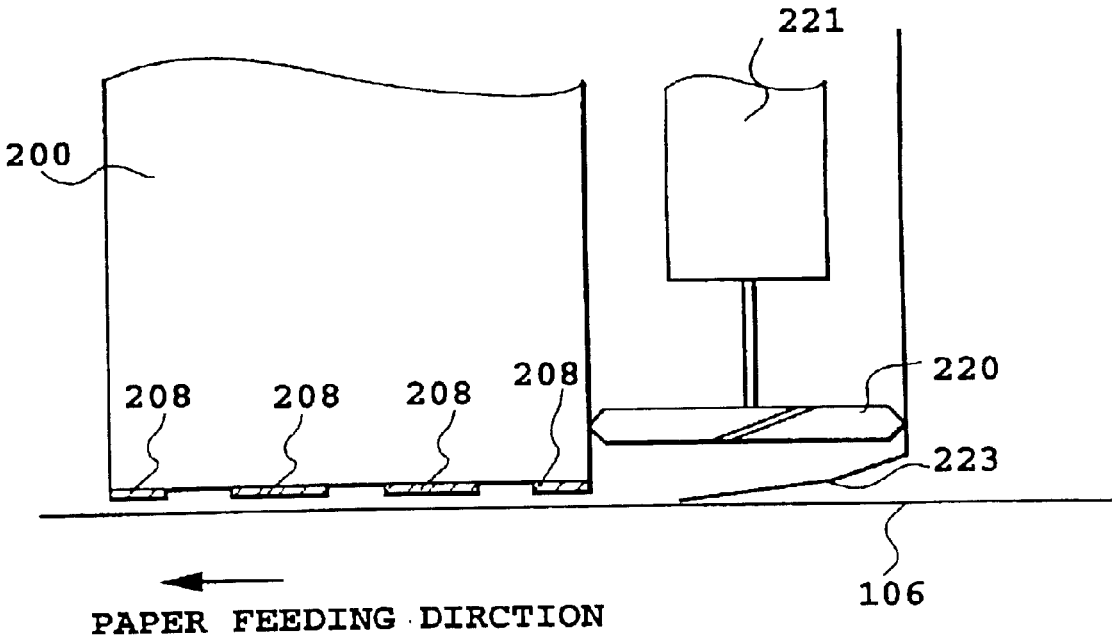
FIG. 31 is an illustration showing a construction for forecedly generating an air flow in the fourth example.

In the apparatus of the shown embodiment, the air flow flowing between the ink-jet head and the paper is generated by feeding of the paper, and thus the velocity of the air flow is relatively small to possibly be insufficient for controlling the deposition range of the rebounding mist. Therefore, as shown in FIG. 31, a fan 220 may be provided for generating a sufficient velocity of air flow between the ink-jet head 200 and the paper 106.

More specifically, in the shown embodiment, the fan 220 and a motor 221 for driving the fan are provided. The air flow generated by the fan 220 is guided by a guide 223 to cause 100 mm/s of air flow between the ejection opening and the paper to control deposition range of the mist, and thereby to reduce mist deposition amount in the vicinity of the ejection opening.

It should be noted that even in the head to be installed in the apparatus of the type performing scanning by means of the carriage as shown in FIG. 8, it is possible that sufficient air flow would not be generated by lowering of the carriage speed when high resolution printing is performed. For example, when printing is performed at a resolution of 4800 dpi at a driving frequency of 8 kHz for improving density, the carriage speed is 42.3 mm/s. At such low carriage speed, sufficient air flow cannot be generated. In this case, sufficient air flow may be generated by providing the fan similarly to the shown embodiment.

Figure 32:
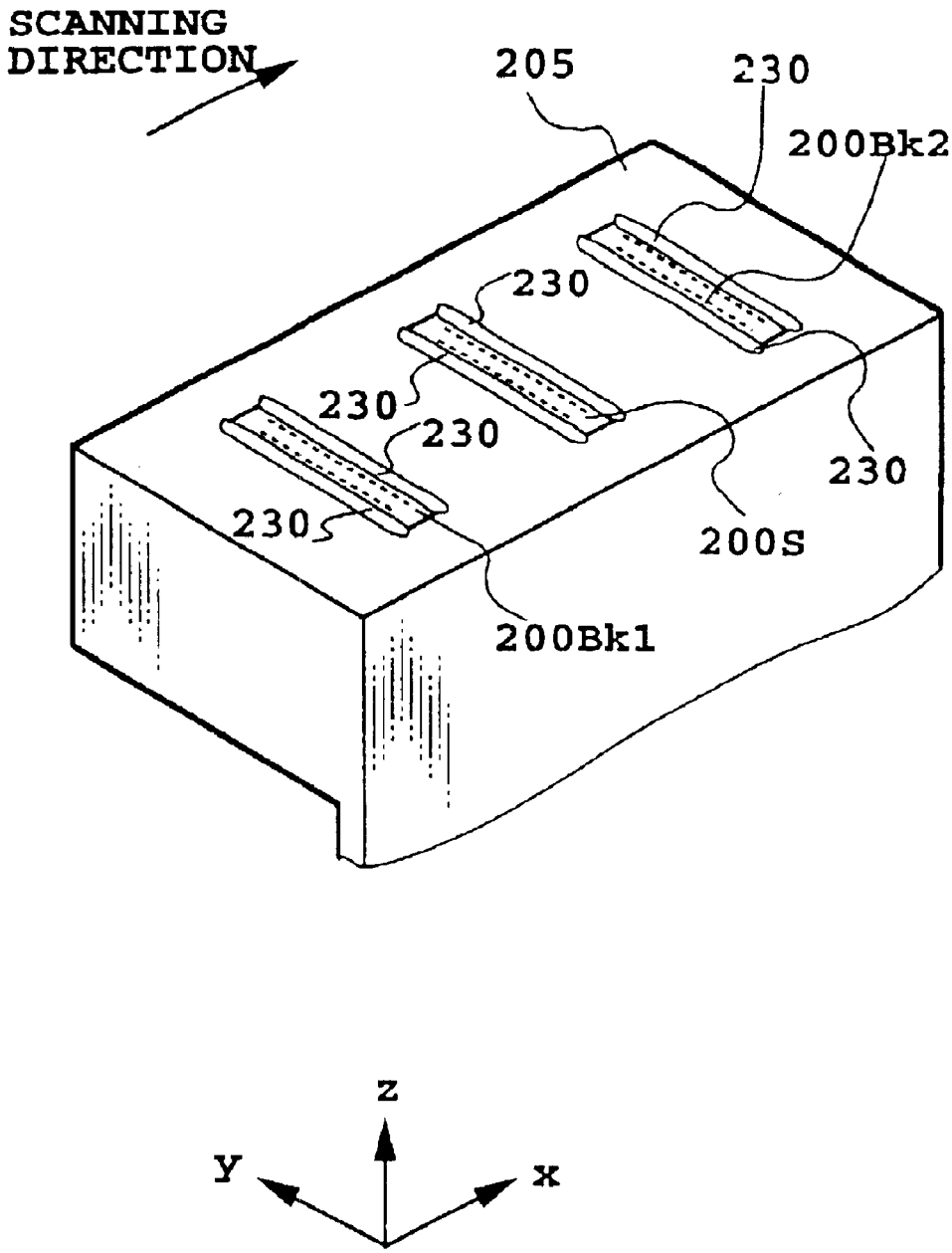
FIG. 32 is a perspective view showing a head unit in a fifth example of the second embodiment.

FIG. 32 is a perspective view showing a yet further example of the shown embodiment of the head unit.

In the shown embodiment, instead of controlling the mist deposition range utilizing the cover plate for preventing deposition of the rebounding mist or so forth, a projecting portion 230 is provided around the region of the ejection opening array of each ink-jet head. The projecting portion 230 has 1.0 mm of width, and 0.3 mm of height. Even in such construction, air flow shown in FIGS. 23 and 24 can be caused to control the range of deposition of the mist.

As can be clear from the discussion given hereabove, in the shown embodiment, the mist generated associated with liquid ejection from the head can be moved away from the ejection opening by the air flow. By this, deposition of the mist on the ejection opening, causing ejection failure, can be successfully prevented. Also, the mist can be held in a floating condition, namely in a condition easily controlled by the air flow, so the range of deposition of the mist can be easily controlled.

As a result the amount of the mist depositing on the ejection opening and in the vicinity thereof can be reduced to successfully prevent serious ejection failure.

Third Embodiment

A third embodiment of the present invention employs a cover plate partly covering the ejection opening forming surface for lowering the absolute amount of the insoluble substance deposited on the ejection opening forming surface of the ink-jet head (ejecting means). In addition, by utilizing such construction or by providing the stepped portion separately from the foregoing construction, control of position of the insoluble substance utilizing air flow becomes possible. Then, particularly in the third embodiment, the effect of wiping can be maximized.

More specifically, the shown embodiment is worked out in the novel viewpoint that, by the air flow generated upon scanning of the ink-jet head provided with the cover plate or the step similarly to the former embodiment, the deposition range of the insoluble substance can be controlled, and the range of deposition is differentiated depending upon the cause of mist generated by ejection of the ink and the processing liquid.

Figure 33:
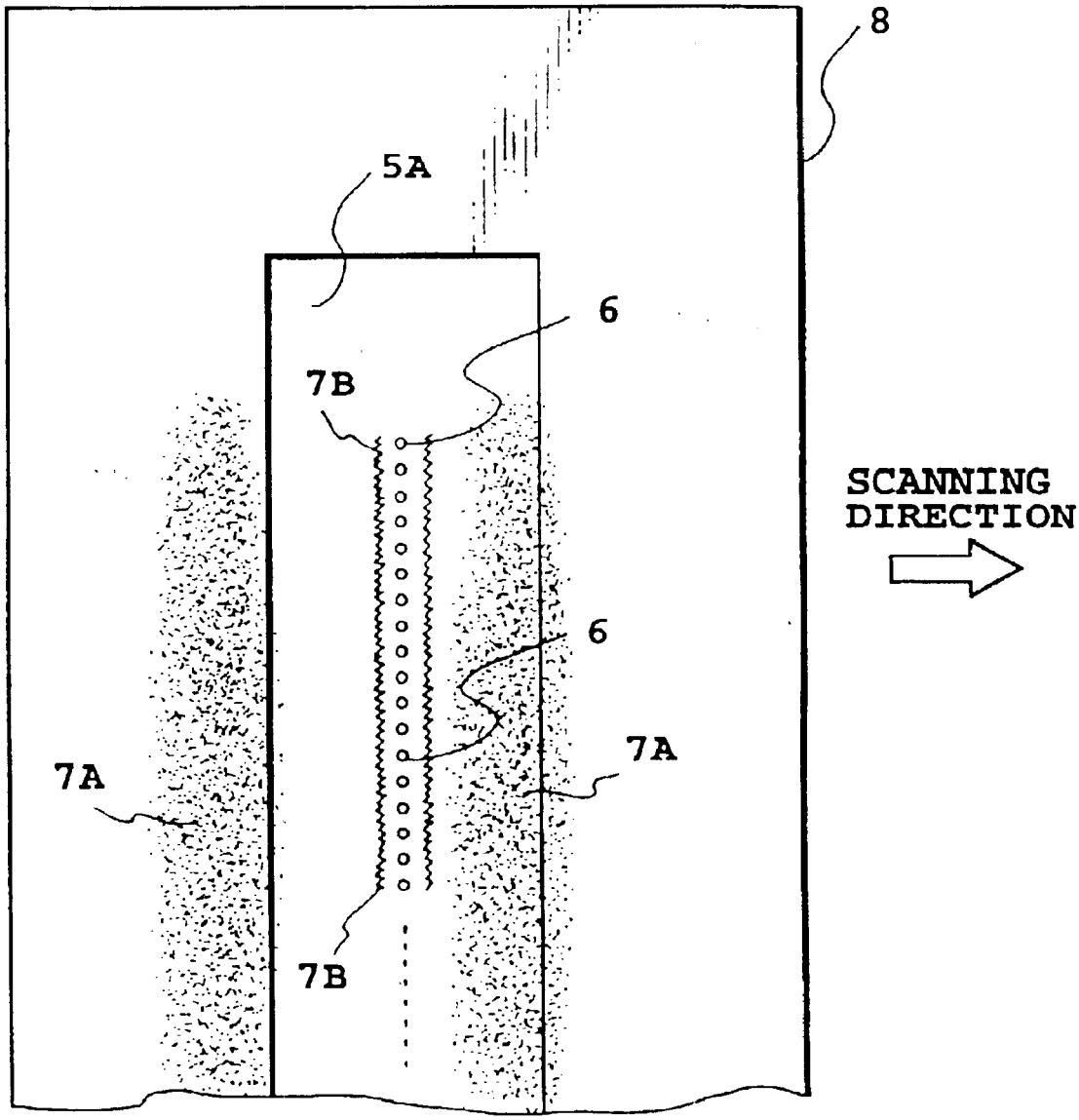
FIG. 33 is a front elevation of an ink-head unit showing depositing condition of the mist to be removed by wiping in a third embodiment of the present invention.
Figure 34:
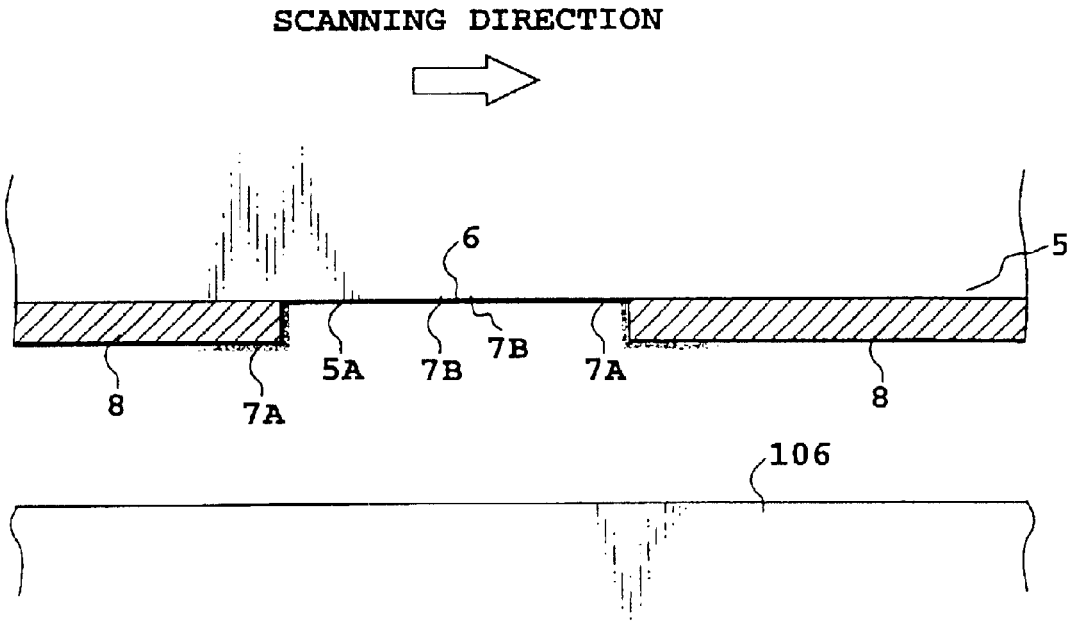
FIG. 34 is a top plan view showing the depositing condition of the mist.

FIGS. 33 and 34 are illustrations for explaining the deposition range control by the air flow and the difference of deposition range.

As shown in FIGS. 33 and 34, the ejection opening forming surface 5A of the ink-jet head, in which a plurality of ejection openings are arranged, is covered with the cover plate 8 except for the given range around the plurality of ejection openings. With such construction, while deposition of a mixture of the ink and the processing liquid on the ejection opening forming surface 5A cannot be prevented completely, the amount of the mist directly deposited on the ejection opening forming surface 5A can be significantly reduced. Also, the deposition range can be moved away from the range of arrangement of the ejection openings 6.

More specifically, the mist of the ink and the processing liquid deposited on the ejection opening forming surface 5A includes the mist generated by rebounding of the ink and the processing liquid ejected from the ejection openings 6 and the mist ejected from the ejection openings and directly deposited on the ejection opening forming surface. The deposition amount of the rebounding mist 7A is relatively large, which can otherwise be deposited on the ejection openings 6 and in the vicinity thereof. However, by control with the air flow, the rebounding mist 7A is deposited on the surface of the cover plate 8 and the ejection opening forming surface 5A in the vicinity of the stepped portion of the cover plate 8. On the other hand, the mist 7B ejected from the ejection openings 6 and directly deposited on the ejection opening forming surface has a small deposition amount. However, the directly deposited mist 7B is deposited along the array of the ejection openings 6 and at the position in the vicinity of the ejection openings.

With the shown embodiment, the mist in the deposition condition set forth above can be successfully removed by the blade.

More specifically, in one example of the shown embodiment, control of the deposition range by the air flow is combined with wiping with the blade. Thus, a relatively large amount of mist 7A is deposited at a position distanced away from the ejection opening 6 within wiping range of the blade. By this, occurrence of the problem that a relatively large amount of deposited substance moved close to the ejection openings 6 or in the vicinity thereof by a wiping action and entering into the ejection opening can be successfully prevented.

In another example of the shown embodiment, a relatively large amount of the deposited mist 7A can be wiped away from the ejection openings 6 by providing directionality of the wiping force of the blade.

In further example of the shown embodiment, even for the mist 7B directly deposited on the ejection opening forming surface, wiping can be performed to move the deposited mist way from the ejection openings 6.

It should be noted that control of the deposition range of the rebounding mist has been discussed with respect to the second embodiment with reference to FIGS. 23 and 24. Therefore, such discussion is omitted here.

In addition, even in the shown embodiment, an ink-jet printing apparatus, similar to the apparatus discussed with reference to FIGS. 8 to 12, is employed.

Figure 35:
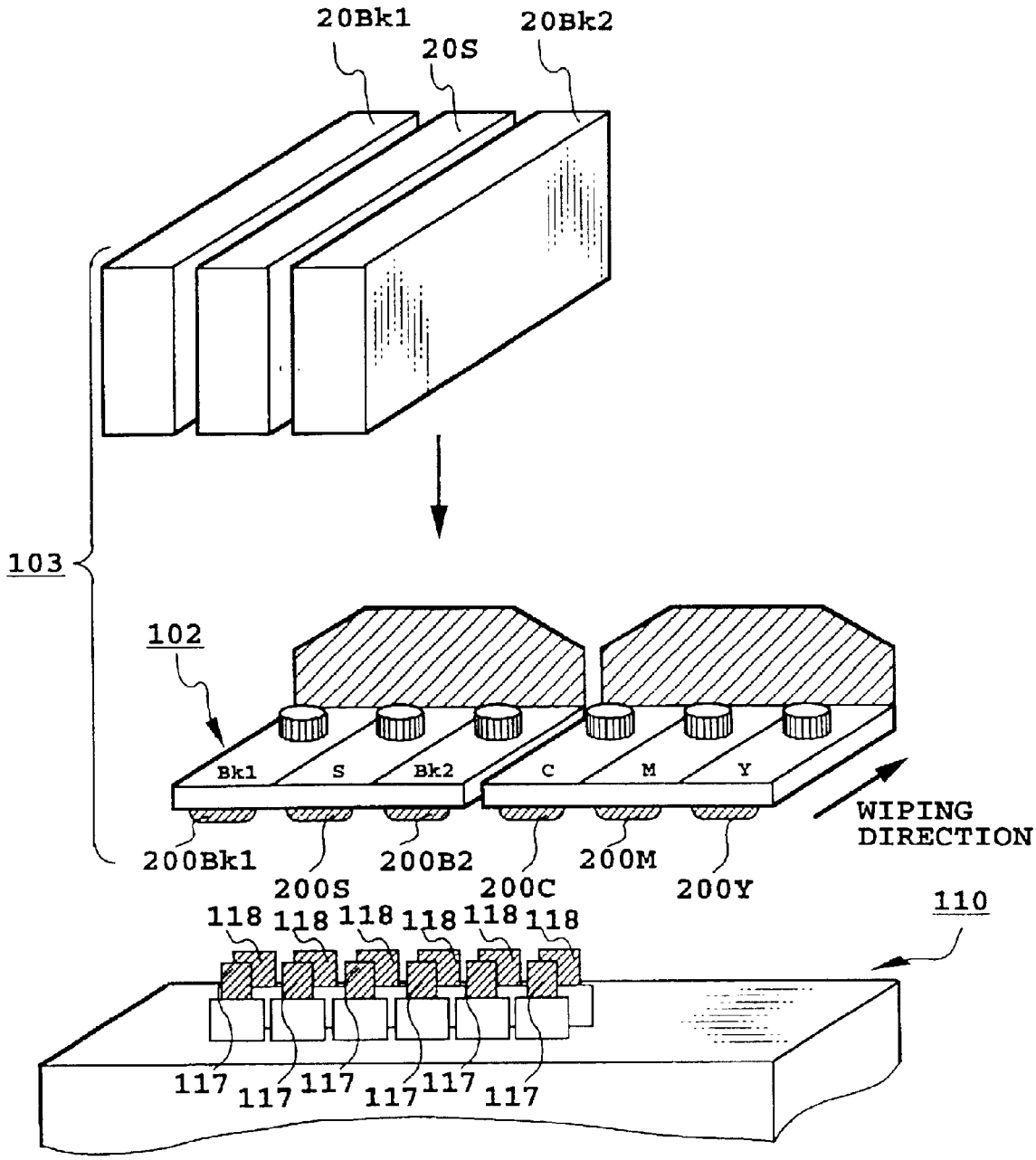
FIG. 35 is a diagrammatic illustration for explaining a mechanism for wiping in the third embodiment of an ink-jet printing apparatus.
Figure 36:
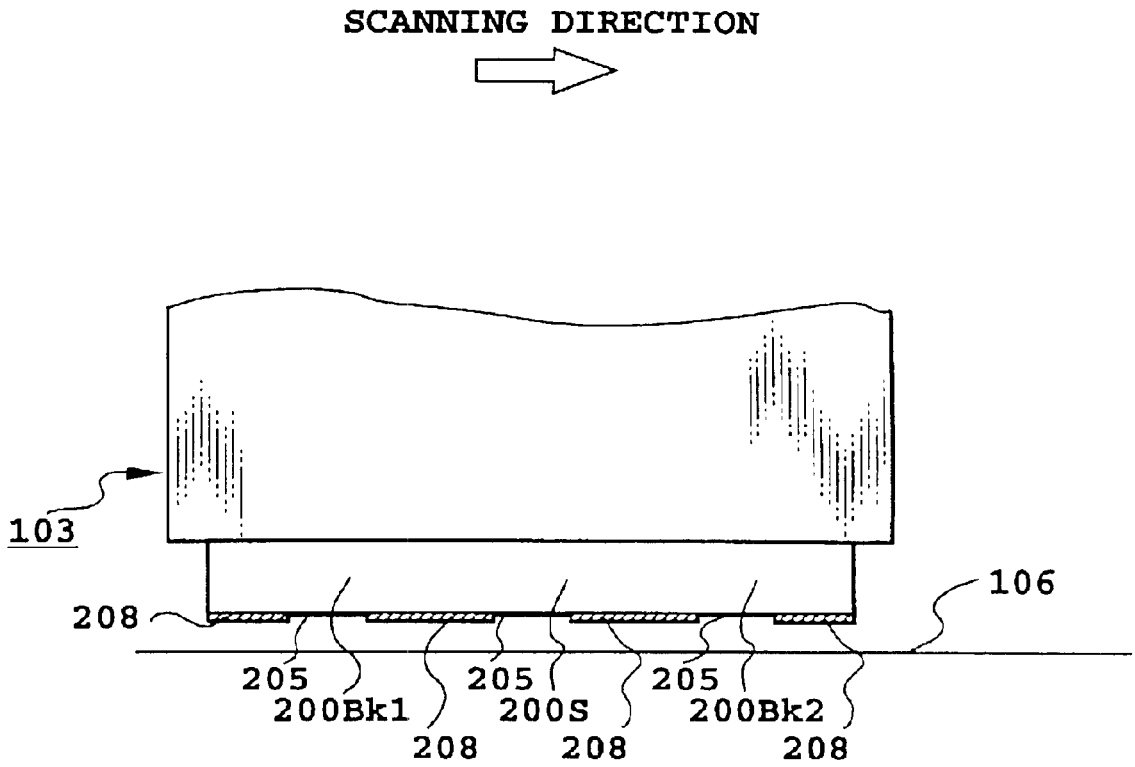
FIG. 36 is a top plan view showing a printing condition of the head unit.

FIG. 35 is a diagrammatic illustration for explaining operation of a wiping mechanism of the recovery unit 110 in the ink-jet printing apparatus shown in FIG. 8.

The ink-jet head unit 103 shown in FIG. 8 is constructed with the head unit 102 and respective ink tanks 20BK1, 20S, 20BK2 (ink tanks for Y, M and C inks are omitted from illustration). The head unit 102 includes ink-jet heads for respective inks, namely the black ink head 200 BK1 and 200 BK2, the processing liquid ejecting head 200S, the cyan ink head 200C, the magenta ink head 200M and the yellow ink head 200Y.

As shown in FIG. 35, blades 117 and 118 for wiping the ejection opening forming surface of the ink-jet head and the cover plate covering a part of the ejection opening forming surface are provided for each ink-jet head. The blades 117 and 118 corresponding to respective heads are integrally operated during the wiping operation. More specifically, the blades 117 and 118 are located at the position corresponding to the home position of the ink-jet head unit 103 and lifted up to the position to contact with the ejection opening forming surface and the cover plate when the wiping operation is to occur. Subsequently, they are moved in the wiping direction to perform wiping of the ejection opening forming surface and the cover plate. As the stand-by position of the blades 117 and 118, positions sliding in parallel to avoid interference with the head, instead of the positions requiring lifting up and down, are preferred.

The head unit of the shown embodiment is the same as that shown in FIG. 20. On the other hand, FIG. 26 shows the condition in which the head unit 102 performs the printing operation. It should be noted that, in these drawings, the head units 102 for Y, M and C are not shown.

In the shown embodiment, in each ink-jet head, the ejection openings 206 are arranged in two arrays. The ejection openings in respective arrays are offset by ½ of the pitch of the ejection openings relative to each other for performing printing at the resolution twice of the resolution realized by one array of the ejection openings. The ink-jet head shown in the drawing ejects in the direction perpendicular to the heater surface forming the electrothermal transducer. In addition, by the construction for appropriately determining the distance between the heater and the ejection opening, relatively fine ink droplets can be ejected.

The cover plate 208 covers the ejection opening forming surface except for the portion around the two ejection opening arrays. By this, as set forth above, the deposition range of the mist can be controlled by air flow generated by movement of the carriage. It should be noted that while the foregoing examples of the shown embodiment have been discussed for the case where the printing operation is performed in only one direction, control of the deposition range is effective even in bidirectional printing.

Figure 37:
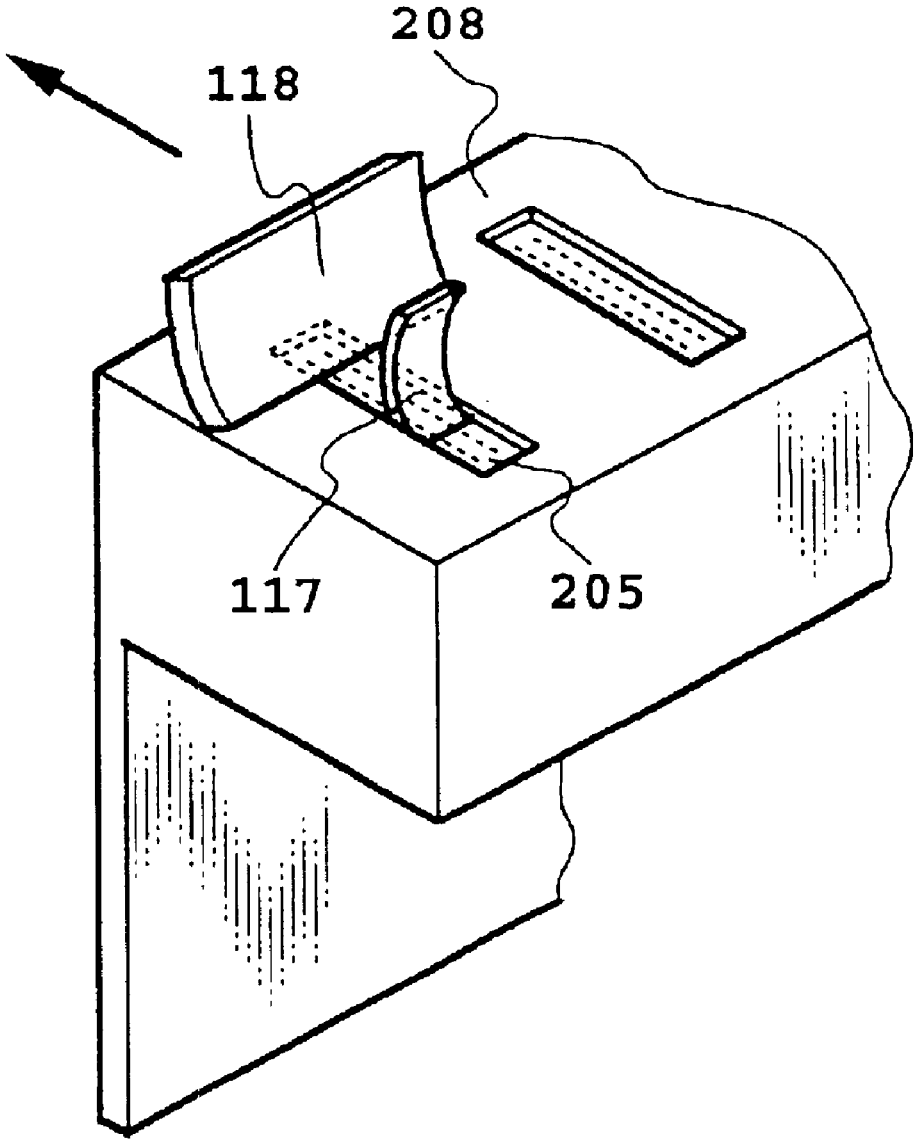
FIG. 37 is an illustration showing wiping operation for the head unit.

FIG. 37 is an illustration showing detail of wiping operation in the shown embodiment.

As shown in FIG. 37, in the wiping operation, the blade 118 wiping the surface of the cover plate 208 contacts the cover plate, at first. After the wiping operation by the blade 118, the blade 117 comes into contact with the ejection opening forming surface 205 and with the cover plate 208. By further movement, the mist or so forth deposited on the ejection opening forming surface 205 can be removed by the blade 117.

Here, assuming that the blade performing wiping of the ejection opening forming surface performs wiping in advance, since a relatively large amount of processing liquid or the insoluble substance can deposited on the cover plate, it is desirable to perform wiping only for the ejection opening forming surface, without contacting the cover plate. However, it is not easy to simplify the construction achieving such operation.

On the other hand, the method for performing wiping by relative motion of the blade and the head can be realized with a relatively simple wiping construction. However, when such method is employed in the construction where the wiping by the blade for the ejection opening forming surface is performed in advance, it will be difficult to wipe the ejection opening forming surface without wiping the cover plate. Then, in such case, when the processing liquid, ink or so forth is deposited on the portion of the cover plate to be wiped, the ink may enter into the edge portion of the blade when the blade passes through the stepped portion between the cover plate and the ejection opening forming surface. Therefore, upon wiping of the ejection opening forming surface, the blade can serve as a kind of application blade. Therefore, in the shown embodiment, the cover plate is wiped in advance, and thereafter, the ejection opening forming surface is wiped to effectively remove the ink, the processing liquid or so forth.

Various forms of blade 117 applicable to the shown embodiment will be discussed with reference to FIGS. 38 to 40.

Figure 38:
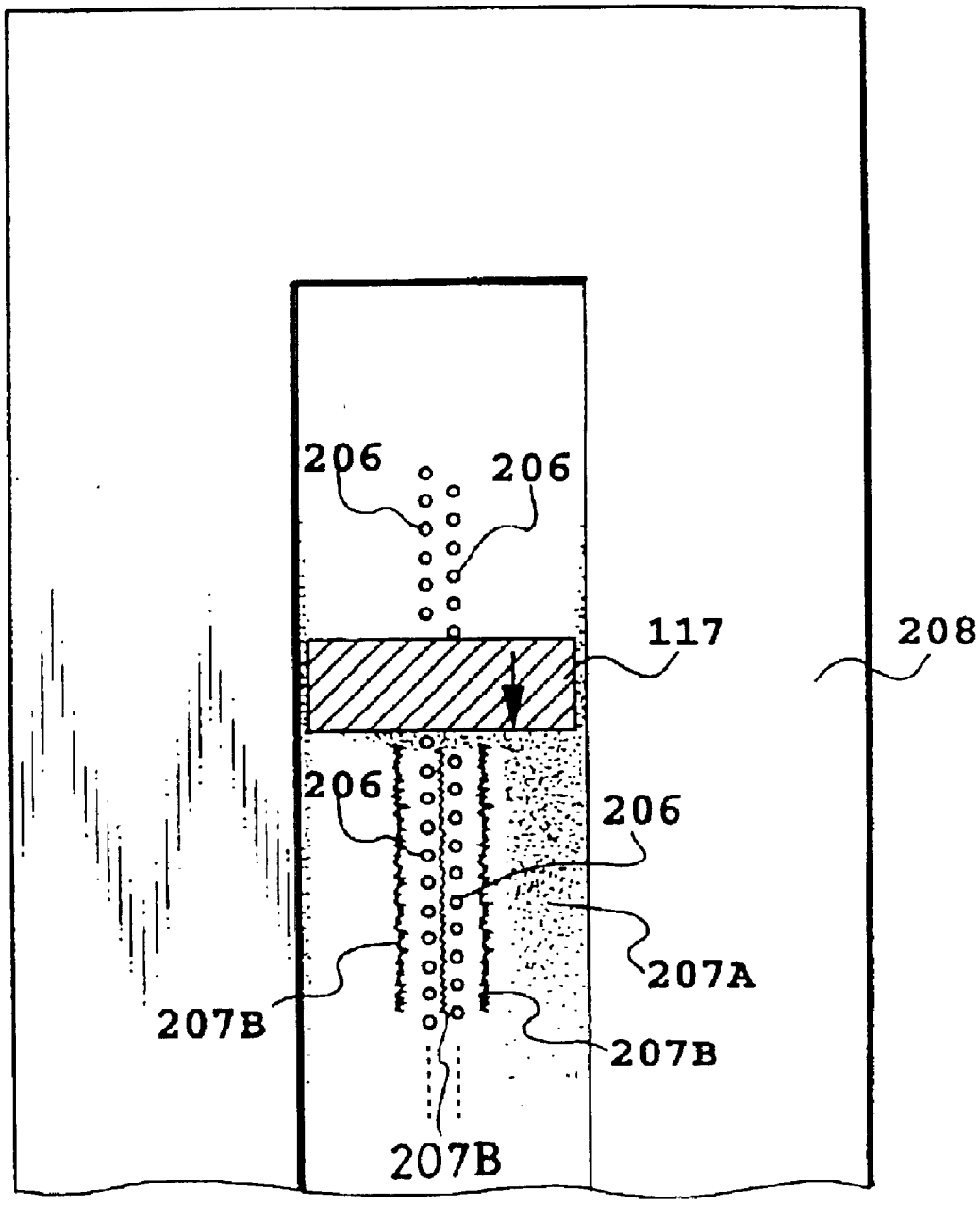
FIG. 38 is an illustration for explaining one example of wiping of a blade in a first example of the head unit in the third embodiment.

The blade shown in FIG. 38 has a width slightly smaller than the width of the portion not covered by the cover plate, and the cross-sectional configuration is rectangular. When such blade is employed, in the shown embodiment, since the deposition range of the relatively large amount of rebounding mist 207A is moved, by the air flow, toward an end of the range to be wiped with the blade, the possibility of moving of the mist 207A toward the ejection opening 206 by wiping operation of the blade 117 per se can be reduced.

On the other hand, concerning the mist 207B deposited on the vicinity of the ejection opening array, there is a high possibility of entering into the ejection opening by moving toward the ejection opening 206 by the wiping operation of the blade 117. However, concerning the mist 207B, the amount is relatively small and the ink or the processing liquid ejected from its own ejection opening is deposited directly, and the possibility of formation of the insoluble substance by admixing of the ink and the processing liquid is small. Therefore, the possibility of causing serious ejection failure is small. The mist or so forth penetrating into the ejection opening can be removed by performing the preliminary ejection or suction process immediately after the wiping operation with the blade.

It should be noted that the insoluble substance of the ink and the processing liquid which can be contained in relatively large amounts in the rebounding mist 207A becomes more difficult to remove depending on the elapsed time after deposition on the ejection opening forming surface. Accordingly, it is desirable to determine the timing to perform the wiping operation depending upon amount of the mist deposited on the ejection opening forming surface and whether the deposited mist can be removed by wiping or not, such as to perform wiping at every given period during the printing operation.

Figure 39:
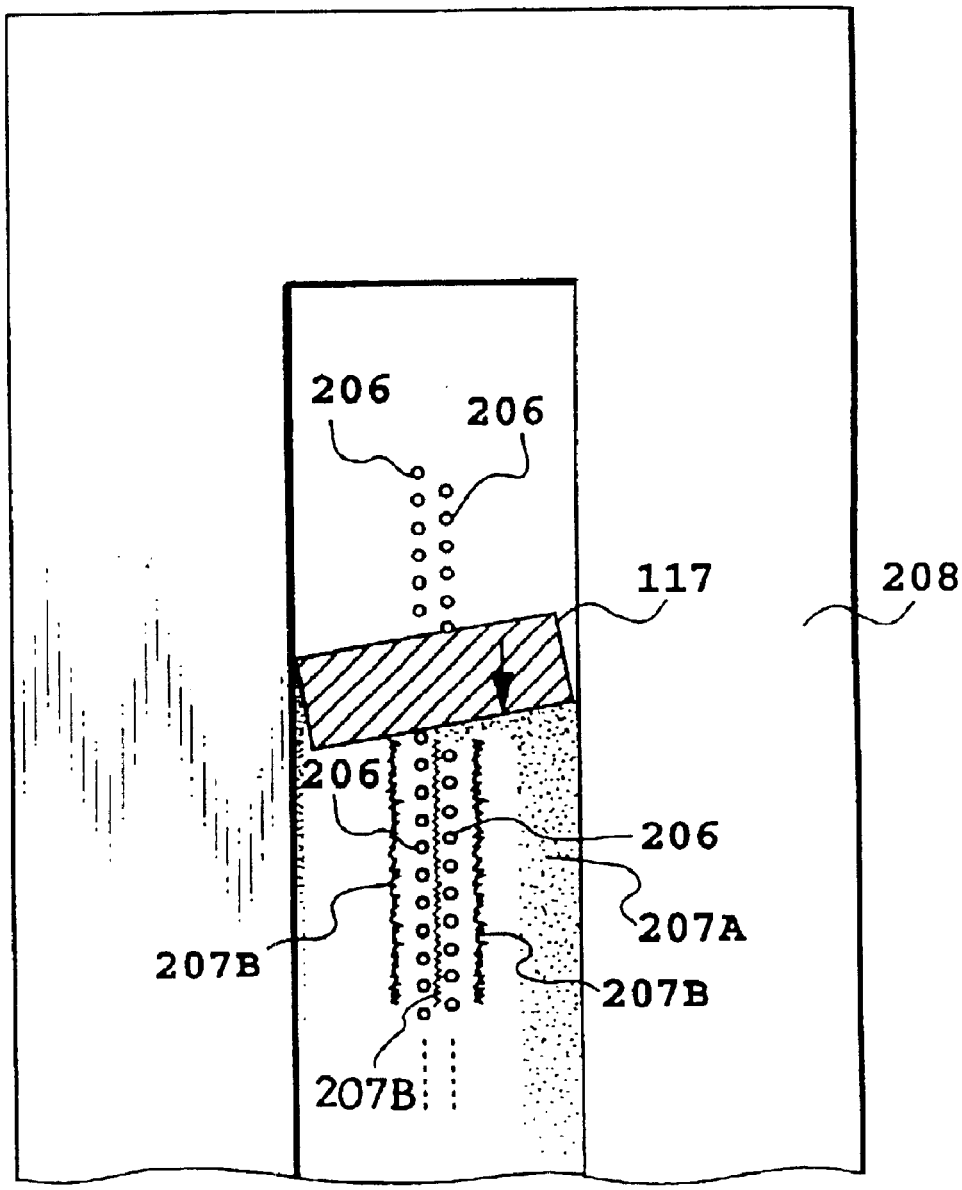
FIG. 39 is an illustration for explaining another example of wiping.

The blade shown in FIG. 39 has a shape similar to that shown in FIG. 38. However, the orientation of the blade in FIG. 39 during the wiping operation is oblique to the direction of motion thereof. The obliquity of the blade is provided so that the end corresponding to the region where the mist 207A is primarily deposited by control of the deposition range is shifted more rearwardly than the other end. By the oblique construction, the mist removed by the wiping operation of the blade 117 can be moved away from the ejection opening 206, namely toward the stepped portion formed by the cover plate 208. As a result, the possibility of entering of the mist to be removed by wiping operation can be further reduced.

Figure 40:
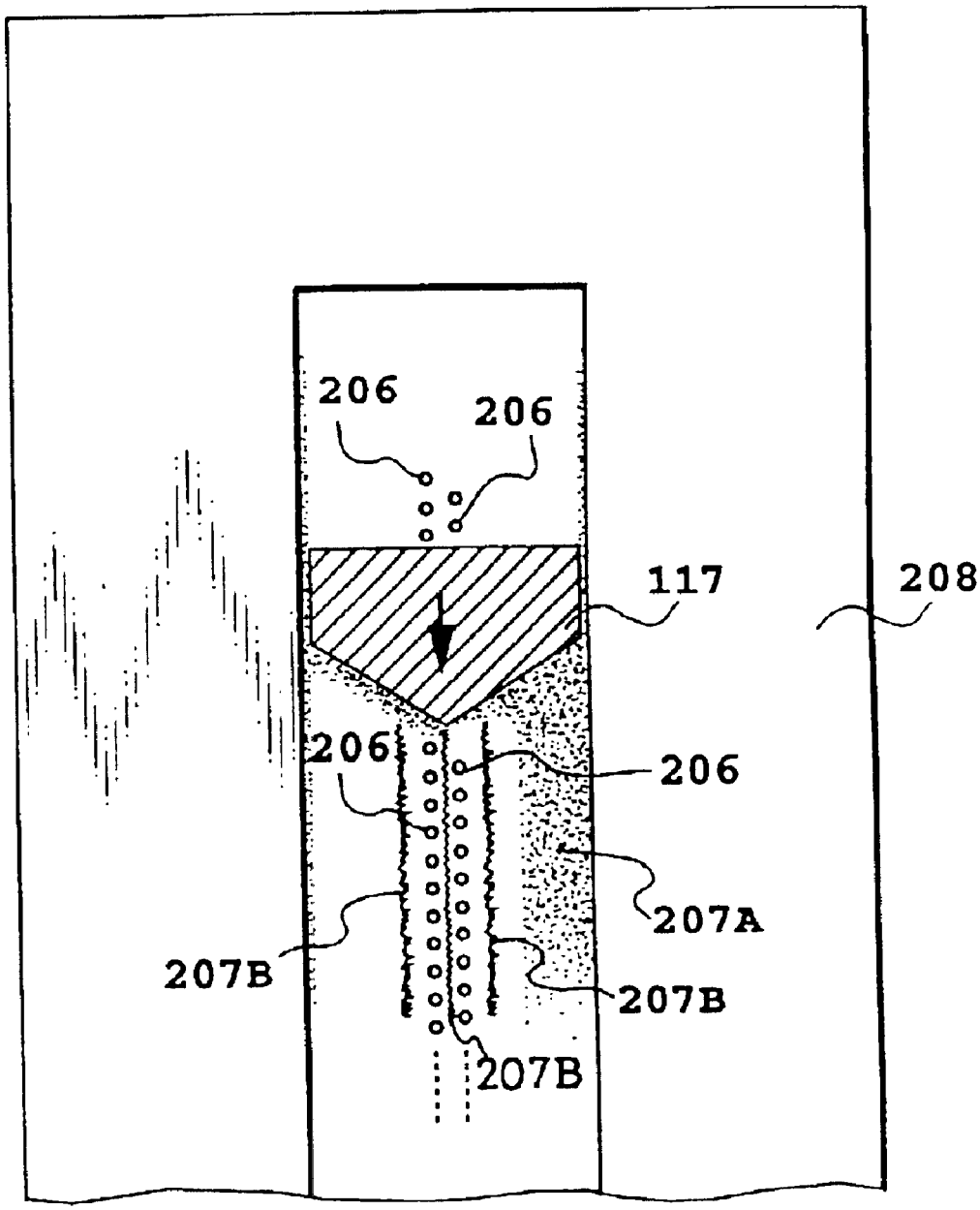
FIG. 40 is an illustration for explaining another example of wiping.

The blade shown in FIG. 40 has a cross-sectional configuration with a triangular providing portion projecting toward the traveling direction during the wiping operation, and the peak of the triangular projection is located at the center of the range to be wiped. With this construction, in addition to the effect of moving the ink mist 207A to one side as set forth above, the mist 207B deposited in the vicinity of the ejection opening array can be removed away from the ejection opening 206.

In addition, the blade shown in FIG. 40 can effectively remove the ink mist 207A caused in bidirectional printing by scanning the carriage. In contrast to this, the blade shown in FIG. 39 is effective in unidirectional printing. More specifically, the blade of FIG. 39 is effective in the case where the range of deposition of the mist 207 on the ejection opening forming surface 205A is limited to one side as shown in FIG. 39. However, even with the blade of the construction shown in FIG. 39, it becomes effective for bidirectional printing when the direction of obliquity can be reversed depending upon the scanning direction.

Figure 41A:
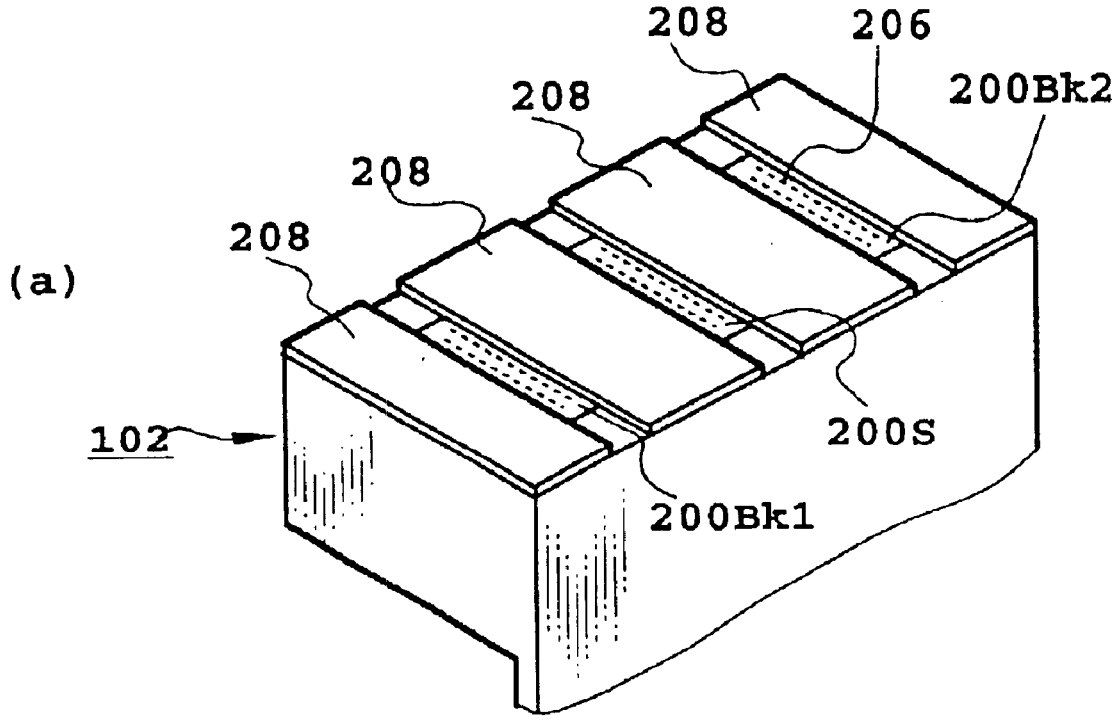
FIG. 41A is a perspective view showing the head unit in the second example of the third embodiment.
Figure 41B:
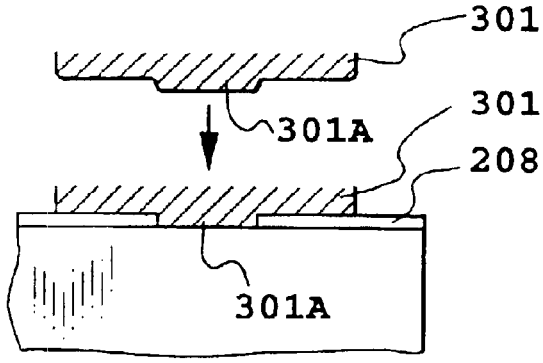
FIGS. 41B and 41C are sections showing a cap applied for the head unit.
Figure 41C:
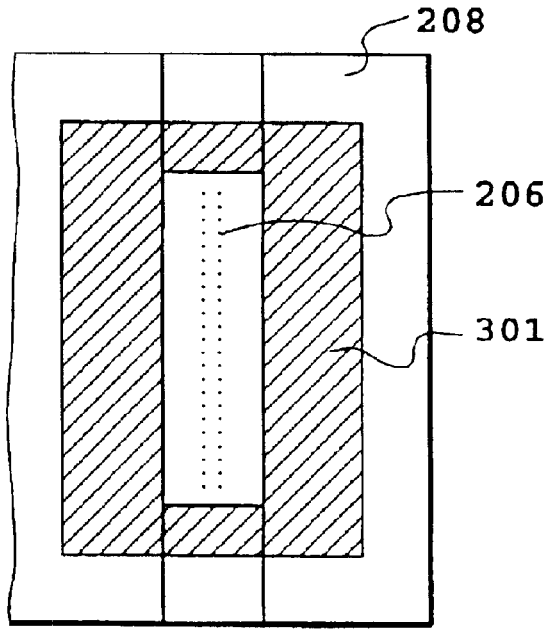

FIG. 41A is a perspective view showing the external appearance of another example of the head unit in the shown embodiment. FIGS. 41B and 41C are sections showing a cap to be employed in the head unit of FIG. 41A.

As shown in FIG. 41A, the shown example is differentiated from the first example of the shown embodiment, in that the cover plate 208 is not present in a range where the blade moves during the wiping operation with respect to the range where the cover plate 208 covers the ejection opening forming surface 205. More specifically, both end portions in the arrangement direction of the ejection opening in the ejection opening forming surface 205 are not covered by the cover plate 208. By this, in the first example, the blade 117 has to contact with the cover plate 208 located at closer position before reaching the ejection opening forming surface 205 in the wiping operation. Therefore, it is not possible to provide high bending stiffness for the blade in the contacting direction. In contrast to this, the shown example permits the use of blade 117 having higher bending stiffness with respect to the ejection opening forming surface 205.

FIGS. 42 to 46 show various forms of the blade which can be employed in the shown example.

Figure 42:
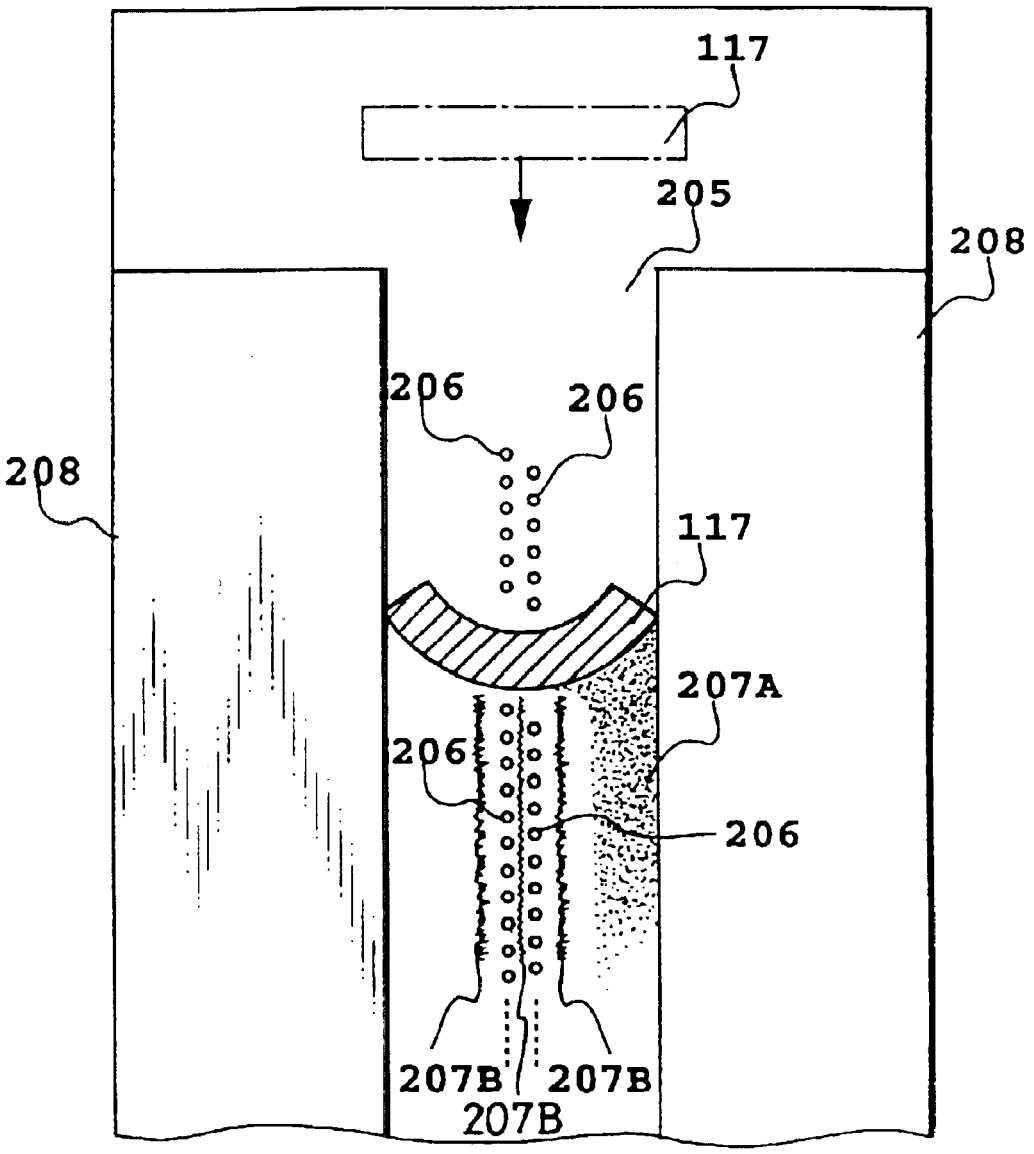
FIG. 42 is an illustration for explaining one example of wiping of the blade in the second example of the head unit.

The blade shown in FIG. 42 has a rectangular cross-section in a non-deformed state, and has a width greater than a width between the cover plates 208 to pass through the blade. With this construction, during the wiping operation, the blade 117 is deformed between two cover plates into a convex shape toward the traveling direction. By this, a similar effect as the blade shown in FIG. 40 can be achieved. Associated therewith, by providing a larger width than the width to pass through, the contacting force to the stepped portion of the cover plate 208 can be increased at both ends. By this, the amount of mist passing through to the back side of the blade, and residual mist, can be reduced.

Figure 43:
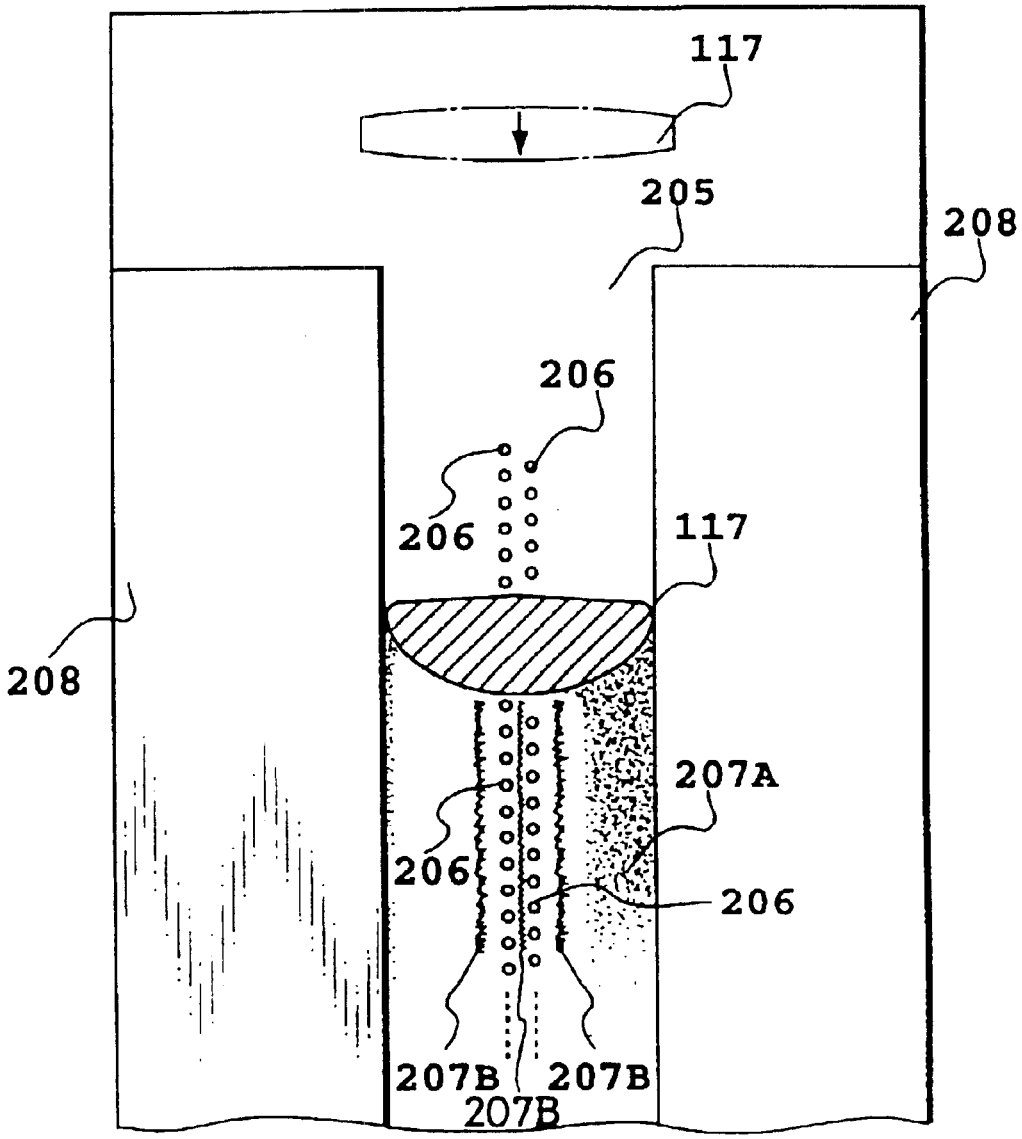
FIG. 43 is an illustration for explaining a further example of wiping.

The blade shown in FIG. 43 is designed to provide a higher bending stiffness when making contact with the ejection opening forming surface 205 by providing a greater thickness at a center portion, and can appropriately adjust the contact force with respect to the stepped portion of the cover plate 208 by providing a smaller thickness at both end portions. The shown blade 117 may deform by contacting with the cover plate 208 at both sides similarly to the blade shown in FIG. 42. Thus, shown blade can remove both of the depositing mists 207A and 207B away from the ejection opening 206.

Figure 44:
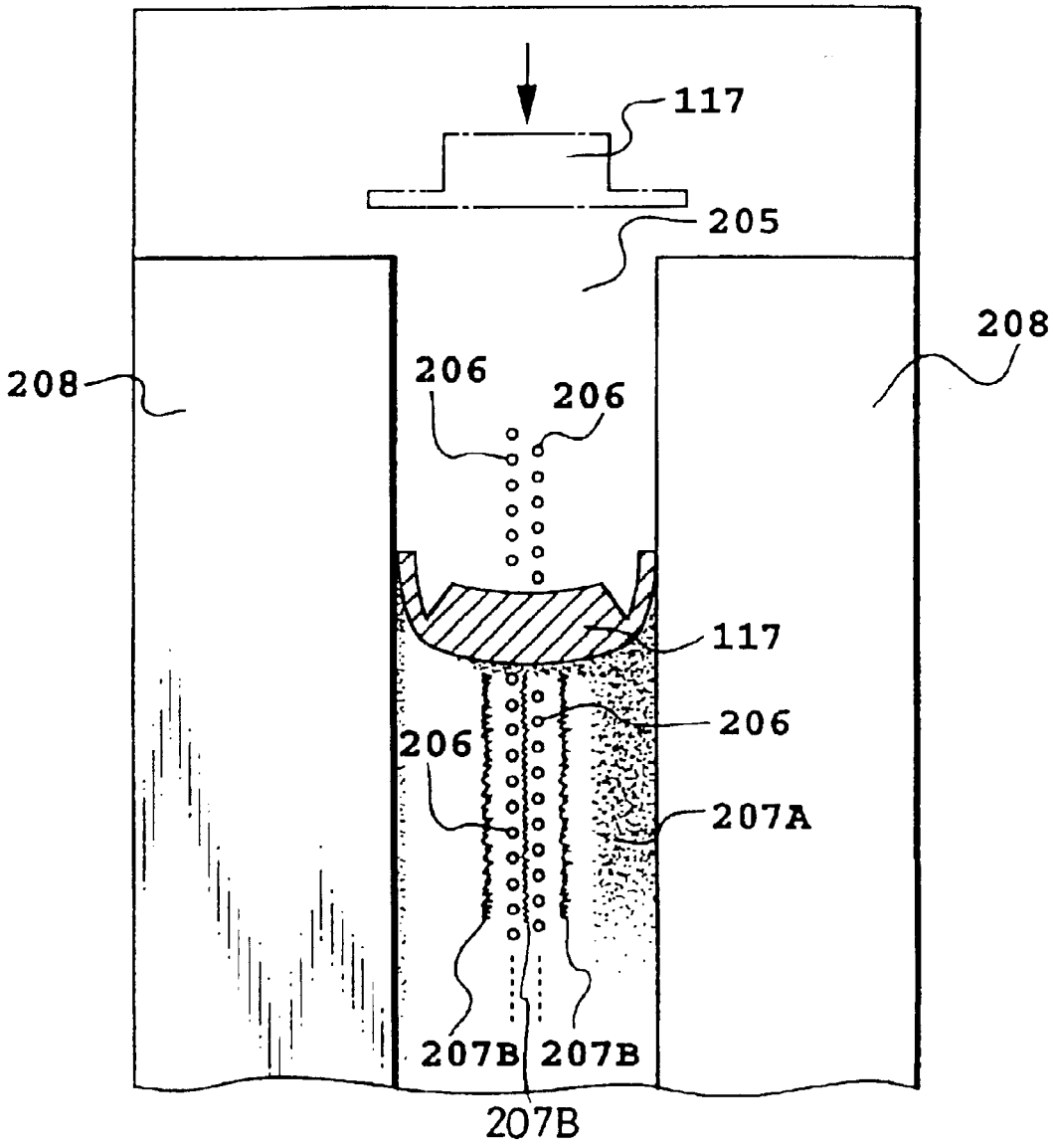
FIG. 44 is an illustration showing a still further example of wiping.

The blade shown in FIG. 44 increases the contact force with respect to the ejection opening forming surface 205 by providing a greater thickness at the center portion similarly to the blade of FIG. 43, and can appropriately adjust the contact force at the contact portion with the cover plate 208 at both ends to reduce the deposited mist passing through and, in conjunction therewith, enhance the sliding ability of the blade.

Figure 45A:
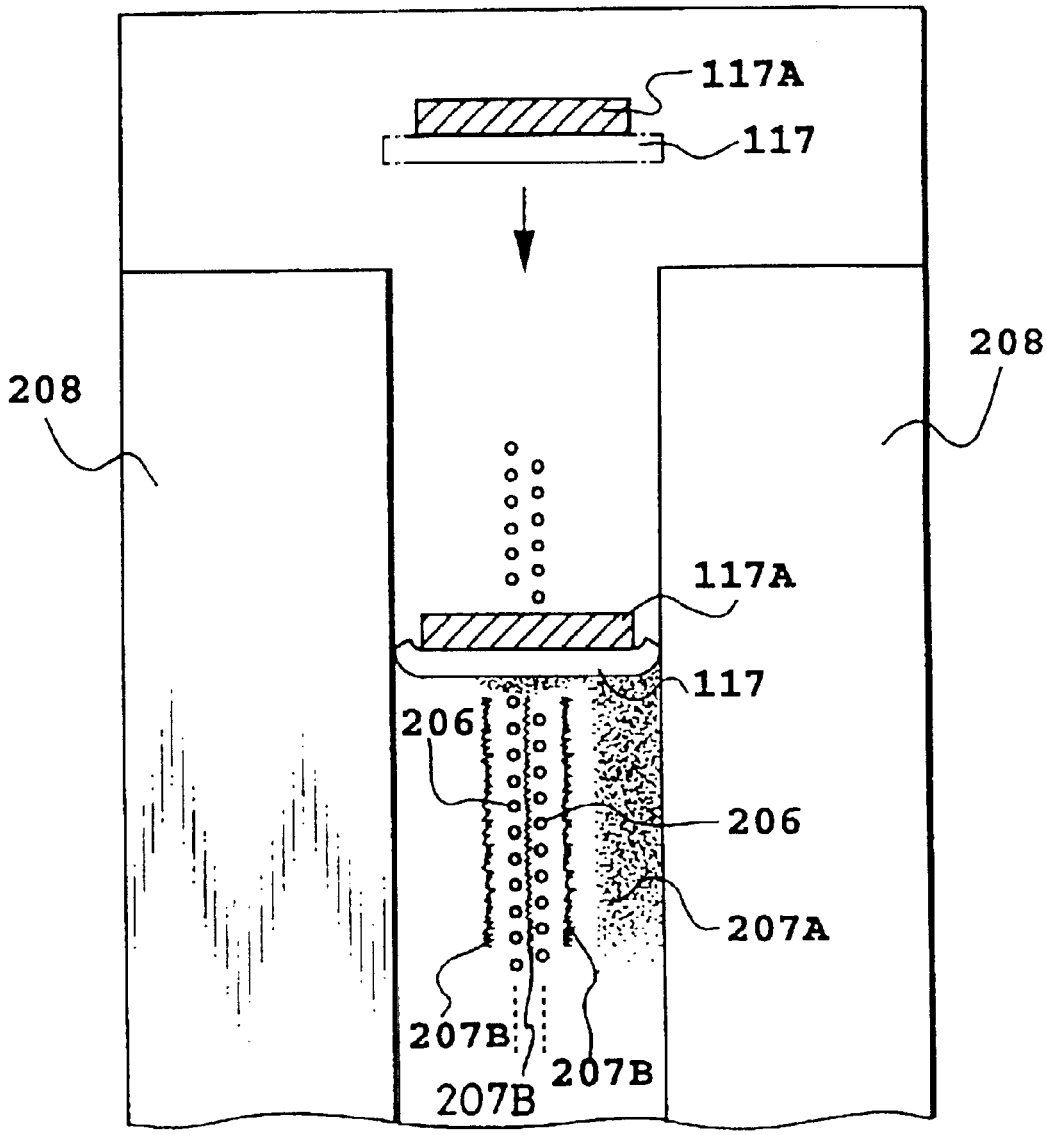
FIGS. 45A and 45B are illustrations for explaining a yet further example of wiping.
Figure 45B:
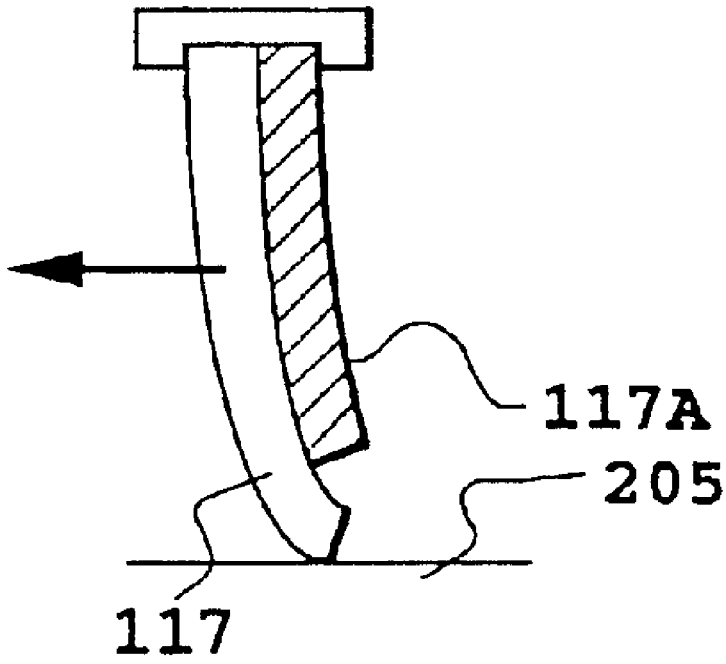

The blade shown in FIGS. 45A and 45B is provided with a biasing member 117A at the backside of the blade 117 instead of increasing the bending stiffness by increasing the thickness at the center portion. The width of the biasing member 117A is set to be smaller than the width of the range to be wiped. Therefore, the blade may deform appropriately at the ends for reducing residual mist after wiping.

Figure 46:
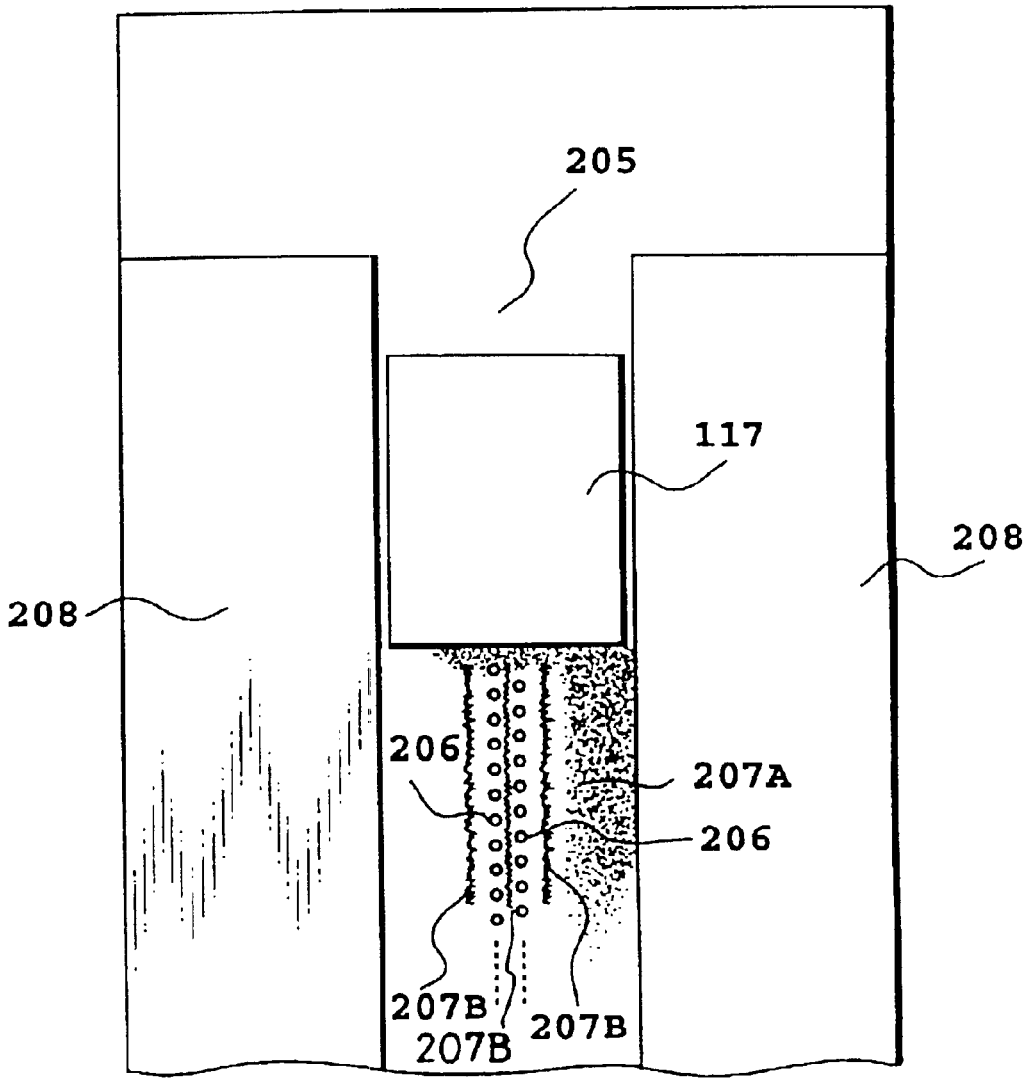
FIG. 46 is an illustration for explaining a still further example of wiping.

The blade shown in FIG. 46 has greater thickness in the direction of the wiping operation to increase the bending stiffness by contact with the ejection opening forming surface. In the case of this blade, both ends of the blade do not have a portion to contact with the cover plate 208 for providing an appropriate contact force. However, due to increased thickness, the distance to pass the deposited mist or so forth therethrough can be increased to successfully reduce the amount of the mist or so forth passing therethrough, namely residual after wiping operation.

It should be appreciated that the problem discussed in the foregoing first example can be resolved even with the blades set forth above.

In addition, the cap employed in the shown embodiment of the head unit is designed as shown in FIGS. 41B and 41C for presence of a recessed portion having a bottom surface formed with the ejection opening forming surface and the surface continuous thereto by providing the cover plate. Namely, a cap 301 has projecting capping portions 301A engaging with the recessed portions corresponding to both ends of the ejection opening forming surface as shown in FIG. 41C.

Figure 47:
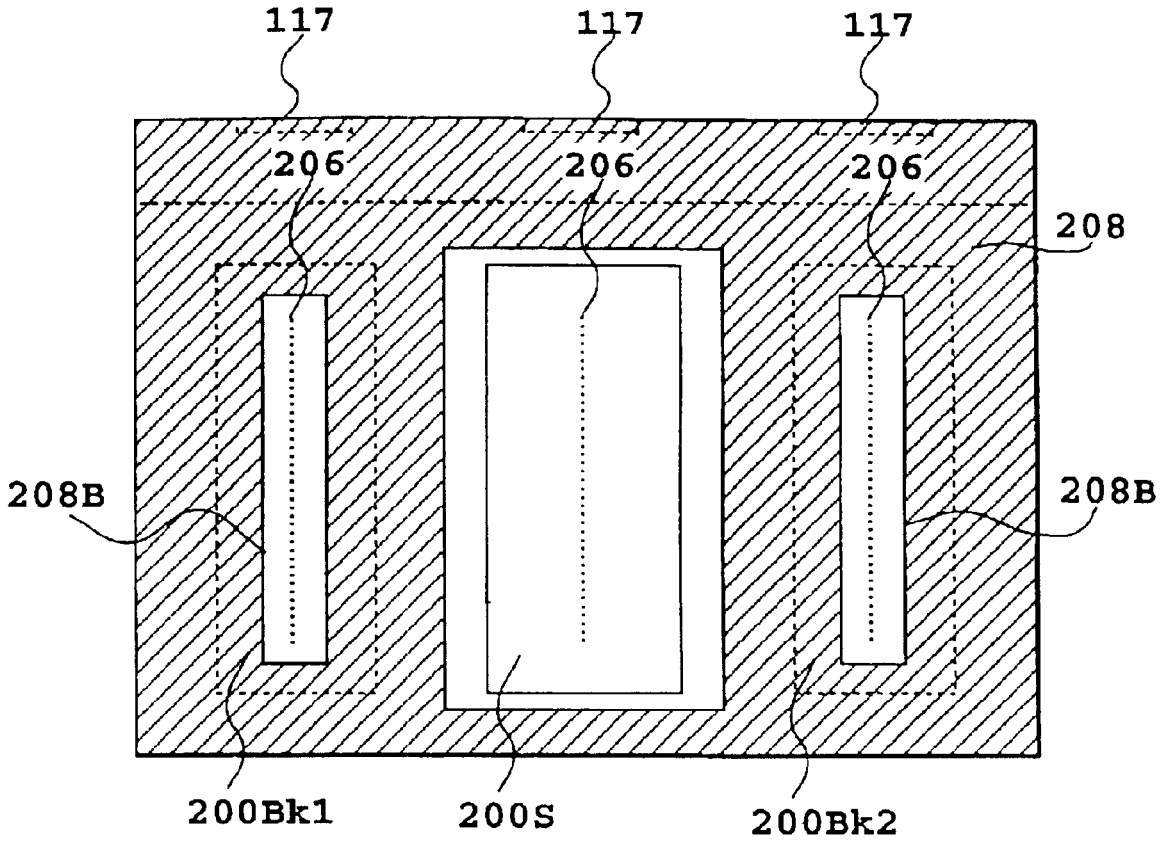
FIG. 47 is an illustration showing the another example of the head unit of the third embodiment.

An example shown in FIG. 47 employs a cover plate different from those in the foregoing first and second examples for the ink-jet head similar to the ink-jet heads in the first and second examples. It should be noted that the ink-jet head employed in the shown example has a single ejection opening array.

The cover plate 208 employed in the shown example is designed so as not to cover the ejection opening forming surface of the ink-jet head 200S ejecting the processing liquid. This is because the content of the insoluble substance (coagulates formed by admixing of the ink and the processing liquid) in the rebounding mist can be varied significantly depending upon the order of ejection of the ink and the processing liquid onto the same position.

More specifically, in the case of the shown example, printing is performed in both of the forward and reverse scanning of the carriage. During printing, ejection is performed by using the heads 200BK1 and 200S in this order during scanning in one direction, and ejection is performed by using the heads 200BK2 and 2005 in this order during scanning in the other direction. Accordingly, in either scanning direction, ejection is effected in the order of black ink and then the processing liquid. In this case, small amounts of insoluble substance may be contained in the rebounding mist. Therefore, the ejection opening forming surface of the ink-jet head ejecting the processing liquid and receiving the rebounding mist containing little amount of the insoluble substance is not required to be covered with the cover plate.

Figure 48A:
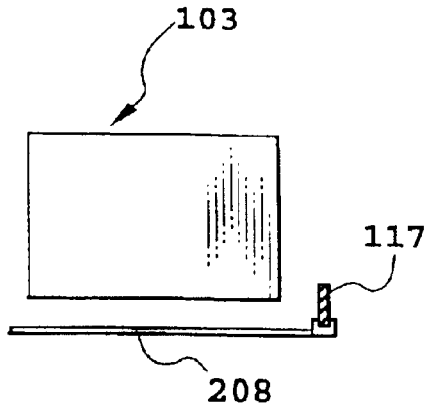
FIGS. 48A to 48C are illustrations for explaining wiping operation in the head unit shown in FIG. 47.
Figure 48B:
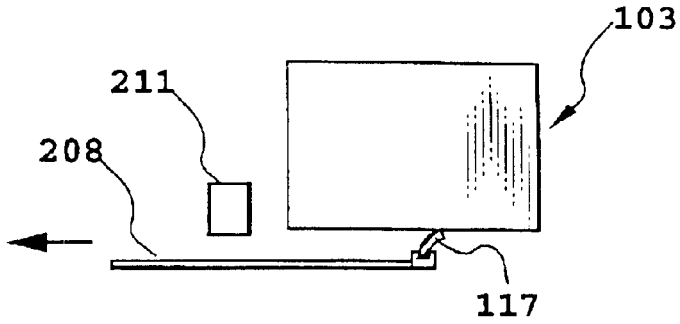
Figure 48C:
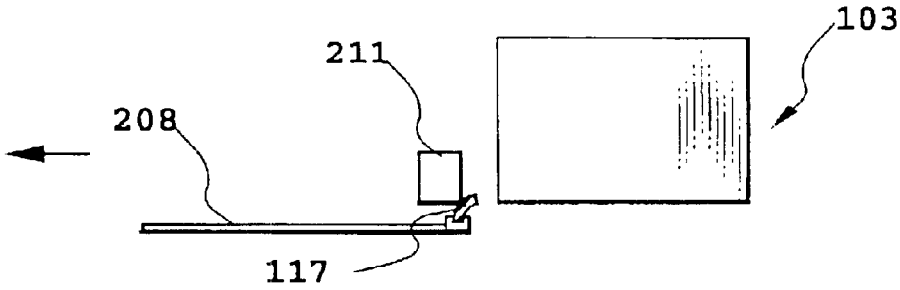

FIGS. 48A to 48C are illustrations for explaining the wiping operation in the example illustrated in FIG. 47.

The blade 117 in the shown example is integrally mounted to the cover plate 208 corresponding to each ink-jet head as shown in FIG. 47. The cover plate 208 is moved while holding the blade 117 by means of not shown holding mechanism to performing wiping of the ejection opening forming surface during motion of the cover plate.

Figure 49A:
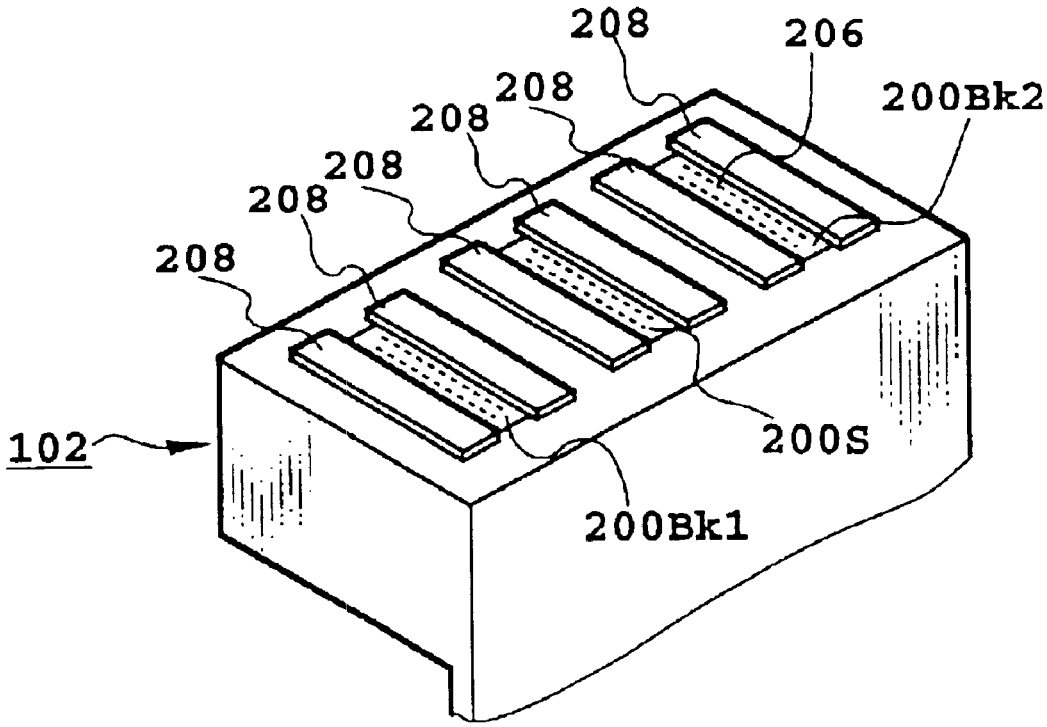
FIG. 49A is a perspective view showing the head unit of a further example of the third embodiment.
Figure 49B:
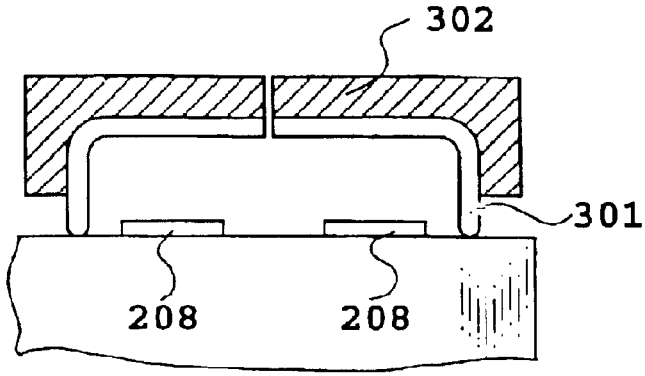
FIGS. 49B and 49C are sections showing a cap to be applied for the head unit of the further example of the third embodiment.
Figure 49C:
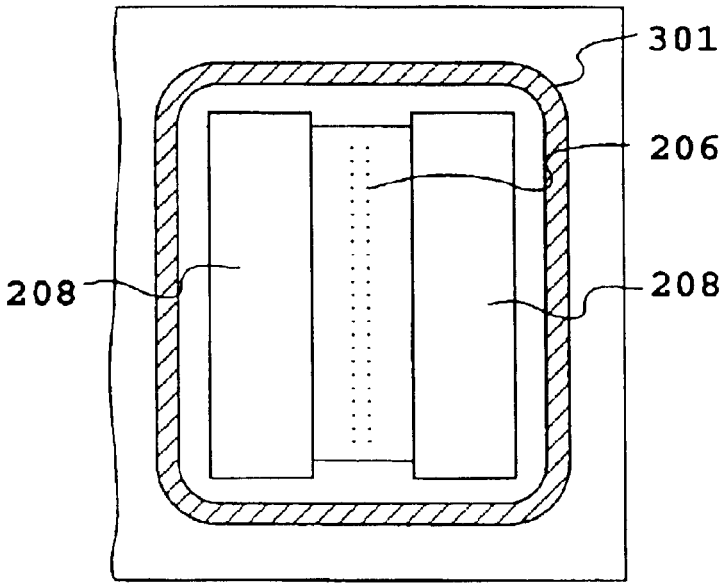

FIG. 49A is a perspective view showing the head unit having another example of the cover plate, and FIGS. 49B and 49C are sections showing construction of the cap to be applied for the shown example of the head unit.

As shown in FIG. 49A, the cover plate of the shown embodiment is provided with a given width at both sides along two ejection opening arrays. In case of the head having such cover plate, capping is performed with including the cover plate.

More specifically, as shown in FIGS. 49B and 49C, a cap 301 held by a cap holder 302 covers the cover plates at both sides of the ejection opening forming surface, in which the ejection openings are arranged. With this construction, by providing the cover plate, satisfactory capping can be done despite of the step caused by printing the cover plate.

As can be clear from the discussion given hereabove, according to the third embodiment of the present invention, the deposition position of the mist of the ink, the processing liquid and the mixture of the ink and the processing liquid is controlled so as to be located away from the ejection opening. Therefore, the possibility of ink or so forth entering by wiping employing the wiping member can be reduced. Also, since the wiping operation by means of the wiping member is performed so that deposition of foreign matters can be controlled to be moved away from the ejection opening, the possibility of the foreign matters entering the ejection opening can be reduced.

Also, despite of presence of the stepped portion, the region between the stepped portion can be wiped appropriately.

As a result, even in printing with the ink and the processing liquid, ejection failure, due to plugging or so forth can be successfully avoided.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments which can be embodied within a scope encompassed and equivalents thereof with respect to the features set out in the appended claims.

What is claimed is:

1. An ink-jet printing apparatus for performing printing by using an ink-jet head having a plurality of ejection openings for ejecting an ink toward a printing medium, comprising:

a plate member having a plurality of holes for covering around respective ejection openings of the plurality of ejection openings or around groups of ejection openings from among the plurality of ejection openings of the ink-jet head at least when the ink-jet head performs ink ejection for printing, wherein said plate member is detachable and a space is formed between said plate member and a face of the ink-jet head on which the plurality of ink ejection openings are formed.

2. An ink-jet printing apparatus as claimed in claim 1, wherein a range to be covered by said plate member is determined depending upon at least a distance between the ink-jet head and the printing medium.

3. An ink-jet printing apparatus for performing printing by using an ink ejecting portion having an ink ejection opening for ejecting an ink and a processing liquid ejecting portion having a processing liquid ejection opening for ejecting a processing liquid for processing the ink, and by ejecting the ink and the processing liquid on a printing medium in an overlaying manner, comprising:

a plate member having a plurality of holes, one of said plurality of holes for covering around the ink ejection opening and another of said plurality of holes for covering around the processing liquid ejection opening at least when the ink ejecting portion and the processing liquid ejecting portion perform ejection of the ink and the processing liquid, respectively, for printing, wherein said plate member is detachable.

4. An ink-jet printing apparatus as claimed in claim 3, wherein a range to be covered by said plate member is determined at least depending upon a distance between the printing medium and the ink ejecting and processing liquid ejecting portions.

5. An ink-jet printing apparatus as claimed in claim 4, further comprising carriage means for arranging the ink ejecting portion and the processing liquid ejecting portion in a predetermined direction and performing movement in the predetermined direction.

6. An ink-jet printing apparatus as claimed in claim 5, further comprising ejection control means for effecting ejection of the processing liquid in advance of ejection of the ink when the ink and the processing liquid are ejected on the printing medium in the overlaying manner.

7. An inkjet printing apparatus as claimed in claim 6, wherein said plate member is arranged on the entire surface around the ejection openings.

8. An ink-jet printing apparatus as claimed in claim 7, wherein said plate member is provided movably with respect to at least one of the ink ejecting portion and the processing liquid ejecting portion.

9. An ink-jet printing apparatus as claimed in claim 8, wherein said plate member has a wiping member for wiping an ejection opening forming surface of the ink ejecting portion and/or an ejection opening forming surface of the processing liquid ejecting portion in accordance with movement of said plate member relative to said ink ejecting portion or said processing liquid ejecting portion.

10. An ink-jet printing apparatus as claimed in claim 9, further comprising a wiping member for wiping the ejection opening forming surface of the ink ejecting portion and/or the ejection opening forming surface of the processing liquid ejecting portion in accordance with attaching and detaching operations of said plate member to and from said ink ejecting portion or said processing liquid ejecting portion.

11. An ink-jet printing apparatus as claimed in claim 9, further comprising a wiping member for wiping the ejection opening forming surface of the ink ejecting portion and/or the ejection opening forming surface of the processing liquid ejecting portion in accordance with movement of said plate member relative to said ink ejecting portion or said processing liquid ejecting portion, and for further wiping the surface of said plate member.

12. An ink-jet printing apparatus as claimed in claim 3, wherein the processing liquid processes the ink so as to make the ink insoluble.

13. An ink-jet printing apparatus as claimed in claim 3, wherein the processing liquid processes a pigment dispersed in the ink so as to aggregate the pigment.

14. A head unit comprising:

an ink ejecting portion having a plurality of ejection openings for ejecting an ink; and a plate member having a plurality of holes to cover around respective ejection openings of said plurality of ejection openings or around groups of ejection openings from among said plurality of ejection openings, wherein said plate member is detachable and a space is formed between said plate member and a face of said ink ejecting portion on which the plurality of ink ejection openings are formed.

15. A head unit comprising:

an ink ejecting portion having an ink ejection opening for ejecting an ink;

a processing liquid ejecting portion having a processing liquid ejection opening for ejecting a processing liquid for processing the ink; and a plate member having a plurality of holes, one of said plurality of holes being for covering around said ink ejection opening and another of said plurality of holes being for covering around said processing liquid ejection opening;

wherein said plate member is detachable.

16. A head unit as claimed in claim 15, wherein a range covered by said plate member is determined depending upon characteristics of the processing liquid ejected.

17. A head unit as claimed in claim 15, wherein the processing liquid processes the ink so as to make the ink insoluble.

18. A head unit as claimed in claim 15, wherein the processing liquid processes a pigment dispersed in the ink so as to aggregate the pigment.

19. An ink-jet cartridge including an ink-jet head having a plurality of ejection openings for ejecting an ink and an ink tank integral with the ink-jet head and storing an ink to be supplied to the ink-jet head, comprising:

a plate member having a plurality of holes for covering around respective ejection openings of the plurality of ejection openings or around groups of ejection openings from among the plurality of ejection openings of the ink-jet head;

wherein said plate member is detachable and a space is formed between said plate member and a face of the ink-jet head on which the plurality of ink ejection openings are formed.

20. An ink-jet cartridge integrally including an ink ejecting portion having an ink ejection opening for ejecting an ink, a processing liquid ejecting portion having a processing liquid ejection opening for ejecting a processing liquid for processing the ink, an ink tank storing the ink to be supplied to the ink ejecting portion and a processing liquid tank storing the processing liquid to be supplied to the processing liquid ejecting portion, comprising:

a plate member having a plurality of holes, one of said plurality of holes being for covering around the ink ejection opening and another of said plurality of holes being for covering around the processing liquid ejection opening;

wherein said plate member is detachable.

21. An ink-jet cartridge as claimed in claim 20, wherein a range covered by said plate member is determined depending upon characteristics of the processing liquid ejected from the processing liquid ejecting portion.

22. An ink-jet cartridge as claimed in claim 20, wherein the processing liquid processes the ink so as to make the ink insoluble.

23. An ink-jet cartridge as claimed in claim 20, wherein the processing liquid processes a pigment dispersed in the ink so as to aggregate the pigment.

* * * * *

UNITED STATES PATENT AND TRADEMARK OFFICE

CERTIFICATE OF CORRECTION

PATENT NO. : 6,883,895 B2
DATED : April 26, 2005
INVENTOR(S) : Murakami et al.

It is certified that error appears in the above-identified patent and that said Letters Patent is hereby corrected as shown below:

Title page,
Item [56], References Cited, FOREIGN PATENT DOCUMENTS,
"JP 0 063 637 11/1982" should read
-- EP 0 063 637 11/1982 --.

Column 7,
Line 40, "and wiping" should read -- and --, and "wiping" should begin a new paragraph.

Column 9,
Line 15, "forecedly" should read -- forcedly --.
Line 51, "the" should be deleted.

Column 11,
Line 38, "openings" should read -- opening --.

Column 12,
Line 40, "subject" should read -- subjected to --.

Column 13,
Line 35, "difference" should read -- differences --.
Line 55, "is S" should read -- S is --.

Column 17,
Line 38, "a nd" should read -- and --.

Column 21,
Line 10, "(m/s)<." should read -- (m/s) --.
Line 11, "CMY>" should read -- <CMY> --.
Line 16, "16 Block)" should read -- 16 Blocks) --.
Line 22, "shown" should read -- shown in --.

Column 22,
Line 16, "th" should read -- the --.
Line 58, "slate" should read -- plate --.

Column 26,
Line 38, "135 carts" should read -- 135 parts --.

UNITED STATES PATENT AND TRADEMARK OFFICE

CERTIFICATE OF CORRECTION

PATENT NO. : 6,883,895 B2
DATED : April 26, 2005
INVENTOR(S) : Murakami et al.

It is certified that error appears in the above-identified patent and that said Letters Patent is hereby corrected as shown below:

Column 27,
Line 32, “the” (second occurrence) should be deleted.
Line 61, “swirl-shaped” should read -- swirl-shaped, --.

Column 28,
Line 32, “caused” should read -- causes --.
Line 33, “cause” should read -- causes --.
Line 36, “may;” should read -- may --.

Column 31,
Line 53, “the, cover” should read -- the cover --.

Column 33,
Line 47, “way” should read -- away --.

Column 37,
Line 45, “2005” should read -- 200S --.
Line 60, “performing” should read -- perform --.

Column 38,
Line 2, “with” should read -- by --.
Line 9, “of” should be deleted.
Line 22, “of” (first occurrence) should read -- the --.

UNITED STATES PATENT AND TRADEMARK OFFICE

CERTIFICATE OF CORRECTION

PATENT NO. : 6,883,895 B2
DATED : April 26, 2005
INVENTOR(S) : Murakami et al.

It is certified that error appears in the above-identified patent and that said Letters Patent is hereby corrected as shown below:

Column 40,
Lines 14 and 50, “opening;” should read -- opening, --.
Line 33, “head;” should read -- head, --.

Signed and Sealed this

Seventh Day of March, 2006

JON W. DUDAS
*Director of the United States Patent and Trademark Office*